US008720221B2

(12) United States Patent
Anselmino et al.

(10) Patent No.: US 8,720,221 B2
(45) Date of Patent: May 13, 2014

(54) IN THE DOOR ICE MAKER

(75) Inventors: Jeffery J. Anselmino, Saint Joseph, MI (US); Nihat Cur, Saint Joseph, MI (US); Marcus R. Fischer, Stevensville, MI (US); Tushar Kulkarni, Saint Joseph, MI (US); Douglas D. LeClear, Benton Harbor, MI (US); Frank W. Maglinger, Evansville, IN (US); Jim J. Pastryk, Sawyer, MI (US); Andrew M. Tenbarge, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/608,511

(22) Filed: Sep. 10, 2012

(65) Prior Publication Data

US 2012/0324940 A1 Dec. 27, 2012

Related U.S. Application Data

(60) Continuation of application No. 12/985,451, filed on Jan. 6, 2011, now Pat. No. 8,627,679, which is a continuation of application No. 12/388,096, filed on Feb. 18, 2009, now Pat. No. 7,895,859, which is a division of application No. 11/830,162, filed on Jul. 30, 2007, now Pat. No. 7,509,818, which is a division of application No. 10/973,516, filed on Oct. 26, 2004, now Pat. No. 7,266,951.

(51) Int. Cl.

| | |
|---|---|
| ***F25C 5/18*** | (2006.01) |
| ***F25D 25/00*** | (2006.01) |
| ***F25D 3/02*** | (2006.01) |
| ***F25C 1/22*** | (2006.01) |

(52) U.S. Cl.
USPC ..... 62/344; 62/377; 62/420; 62/340; 62/425

(58) Field of Classification Search
USPC ..... 62/344, 420, 425, 377, 66
See application file for complete search history.

(56) References Cited

U.S. PATENT DOCUMENTS

| | | | | |
|---|---|---|---|---|
| 2,199,413 | A | | 5/1940 | Patrignani |
| 2,443,926 | A | | 6/1948 | Page |
| 2,692,809 | A | | 10/1954 | Kesling |
| 2,712,733 | A | | 7/1955 | King |
| 2,900,803 | A | | 8/1959 | Horton, Jr |
| 3,025,679 | A | | 3/1962 | Keighley |
| 3,025,683 | A | | 3/1962 | Baker et al. |
| 3,146,601 | A | * | 9/1964 | Gould ..... 62/3.6 |
| 3,146,606 | A | * | 9/1964 | Grimes et al. ..... 62/233 |
| 3,211,338 | A | | 10/1965 | Weil et al. |
| 3,226,939 | A | | 1/1966 | Harbison |
| 3,270,519 | A | | 9/1966 | Pohl, Jr. |

(Continued)

FOREIGN PATENT DOCUMENTS

| | | |
|---|---|---|
| EP | 1445558 A2 | 11/2004 |
| JP | 47-026464 | 11/1972 |

(Continued)

*Primary Examiner* — Brandon M Rosati
*Assistant Examiner* — Elizabeth Martin

(57) ABSTRACT

A refrigerator that has a refrigerating compartment and a freezer compartment. A refrigerating compartment door covers at least a portion of the refrigerating compartment. An ice compartment located in the refrigerating compartment is located on the refrigerating compartment door. An ice maker is located in the ice compartment and a dispenser is located on the refrigerating compartment door.

14 Claims, 43 Drawing Sheets

(56) References Cited

U.S. PATENT DOCUMENTS

| | | | | |
|---|---|---|---|---|
| 3,350,899 | A | | 11/1967 | Jones et al. |
| 3,390,537 | A | | 7/1968 | Callen |
| 3,429,140 | A | | 2/1969 | White |
| 3,433,030 | A | | 3/1969 | Jacobs |
| 3,545,217 | A | | 12/1970 | Linstromberg |
| 3,561,231 | A | | 2/1971 | Webb |
| 3,580,428 | A | | 5/1971 | Garber |
| 3,602,007 | A | | 8/1971 | Drieci |
| 3,640,088 | A | | 2/1972 | Jacobus et al. |
| 3,650,088 | A | | 3/1972 | Wilson |
| 3,715,119 | A | | 2/1973 | Shelley et al. |
| 3,747,363 | A | | 7/1973 | Grimm |
| 3,789,620 | A | | 2/1974 | Benassutti et al. |
| 3,798,923 | A | | 3/1974 | Pink et al. |
| 3,877,241 | A | | 4/1975 | Wade |
| 3,913,343 | A | | 10/1975 | Rowland et al. |
| 3,918,266 | A | | 11/1975 | Gindy et al. |
| 3,933,198 | A | | 1/1976 | Hara et al. |
| 3,969,909 | A | | 7/1976 | Barto et al. |
| 4,009,595 | A | | 3/1977 | Barnard et al. |
| 4,084,725 | A | | 4/1978 | Buchser |
| 4,087,140 | A | | 5/1978 | Linstromberg |
| 4,100,761 | A | | 7/1978 | Linstromberg |
| 4,176,527 | A | | 12/1979 | Linstromberg et al. |
| 4,176,528 | A | | 12/1979 | Frohbieter |
| 4,209,999 | A | | 7/1980 | Falk et al. |
| 4,227,383 | A | | 10/1980 | Horvay |
| 4,285,212 | A | | 8/1981 | Prada |
| 4,306,757 | A | | 12/1981 | Horvay |
| 4,333,588 | A | | 6/1982 | Schreck |
| 4,368,622 | A | | 1/1983 | Brooks |
| 4,543,800 | A | | 10/1985 | Mawby |
| 4,732,301 | A | | 3/1988 | Tobias et al. |
| 4,942,979 | A | | 7/1990 | Linstromberg et al. |
| 4,970,871 | A | | 11/1990 | Rudick |
| 5,077,985 | A | | 1/1992 | Buchser |
| 5,092,137 | A | * | 3/1992 | Elsom ..... 62/408 |
| 5,105,631 | A | | 4/1992 | Watanabe et al. |
| 5,117,654 | A | | 6/1992 | Steffenhagen |
| 5,125,242 | A | | 6/1992 | Von Blanquet |
| 5,165,255 | A | | 11/1992 | Alvarez et al. |
| 5,211,462 | A | | 5/1993 | Bien |
| 5,230,448 | A | | 7/1993 | Strohmeyer et al. |
| 5,272,888 | A | | 12/1993 | Fisher |
| 5,273,219 | A | | 12/1993 | Beach, Jr. |
| 5,359,795 | A | | 11/1994 | Mawby et al. |
| 5,375,432 | A | * | 12/1994 | Cur ..... 62/320 |
| 5,729,997 | A | | 3/1998 | Witsoe |
| 5,737,932 | A | | 4/1998 | Lee |
| 5,787,724 | A | | 8/1998 | Pohl et al. |
| 5,813,245 | A | | 9/1998 | Coates et al. |
| 5,896,752 | A | | 4/1999 | Park |
| 5,899,083 | A | | 5/1999 | Peterson |
| 5,947,342 | A | | 9/1999 | Song |
| 5,956,967 | A | | 9/1999 | Kim |
| 6,019,447 | A | | 2/2000 | Jackovin |
| 6,036,294 | A | * | 3/2000 | Banicevic et al. ..... 312/407 |
| 6,050,097 | A | * | 4/2000 | Nelson et al. ..... 62/137 |
| 6,082,130 | A | | 7/2000 | Pastryk |
| 6,085,542 | A | | 7/2000 | Johnson et al. |
| 6,120,685 | A | | 9/2000 | Carlson et al. |
| 6,135,173 | A | | 10/2000 | Lee et al. |
| 6,148,624 | A | * | 11/2000 | Bishop et al. ..... 62/137 |
| 6,167,711 | B1 | | 1/2001 | Slattery et al. |
| 6,209,339 | B1 | | 4/2001 | Schroeder et al. |
| 6,276,146 | B1 | | 8/2001 | Kim et al. |
| 6,286,324 | B1 | | 9/2001 | Pastryk |
| 6,314,745 | B1 | | 11/2001 | Janke |
| 6,351,958 | B1 | | 3/2002 | Pastryk |
| 6,425,259 | B2 | * | 7/2002 | Nelson et al. ..... 62/344 |
| 6,438,976 | B2 | | 8/2002 | Shapiro |
| 6,438,988 | B1 | | 8/2002 | Paskey |
| 6,442,954 | B1 | | 9/2002 | Shapiro |
| 6,460,367 | B1 | | 10/2002 | DuHack |
| 6,474,094 | B2 | | 11/2002 | Kim |
| 6,484,529 | B2 | | 11/2002 | Dasher et al. |
| 6,532,758 | B2 | | 3/2003 | DuHack |
| 6,539,742 | B2 | | 4/2003 | Mitchell et al. |
| 6,571,567 | B2 | | 6/2003 | An et al. |
| 6,735,959 | B1 | | 5/2004 | Najewicz |
| 6,742,353 | B2 | | 6/2004 | Ohashi et al. |
| 6,745,578 | B2 | | 6/2004 | Collins et al. |
| 6,810,682 | B1 | | 11/2004 | Schuchart et al. |
| 6,880,355 | B2 | | 4/2005 | Jung |
| 6,945,068 | B2 | | 9/2005 | Kim et al. |
| 6,952,935 | B2 | | 10/2005 | Vorosmarti et al. |
| 6,964,177 | B2 | | 11/2005 | Lee et al. |
| 7,065,975 | B1 | | 6/2006 | Herndon et al. |
| 7,076,967 | B2 | | 7/2006 | Lee et al. |
| 7,185,508 | B2 | | 3/2007 | Voglewede et al. |
| 7,188,479 | B2 | | 3/2007 | Anselmino et al. |
| 7,201,005 | B2 | | 4/2007 | Voglewede et al. |
| 7,210,601 | B2 | | 5/2007 | Hortin et |
| 7,228,703 | B2 | | 6/2007 | Kim et al. |
| 7,266,972 | B2 | | 9/2007 | Anselmino et al. |
| 7,272,949 | B2 | | 9/2007 | Lee et al. |
| 7,392,665 | B2 | | 7/2008 | Lee et al. |
| 7,428,820 | B2 | | 9/2008 | Kim et al. |
| 7,437,885 | B2 | | 10/2008 | Wu et al. |
| 7,484,382 | B2 | | 2/2009 | Kim et al. |
| 7,490,475 | B2 | | 2/2009 | Kim et al. |
| 7,493,777 | B2 | | 2/2009 | Kim et al. |
| 7,509,818 | B2 | | 3/2009 | Anselmino et al. |
| 7,895,859 | B2 | | 3/2011 | Anselmino et al. |
| 2001/0025505 | A1 | | 10/2001 | Nelson |
| 2002/0083731 | A1 | | 7/2002 | Kim |
| 2005/0210909 | A1 | | 9/2005 | Kim et al. |
| 2005/0257536 | A1 | | 11/2005 | Chung et al. |
| 2006/0090496 | A1 | | 5/2006 | Adamski et al. |
| 2006/0201189 | A1 | | 9/2006 | Adamski et al. |
| 2006/0218961 | A1 | | 10/2006 | Kim |

FOREIGN PATENT DOCUMENTS

| | | | |
|---|---|---|---|
| JP | 50069644 | A | 6/1975 |
| JP | S50-154565 | A | 12/1975 |
| JP | S53-41815 | A | 11/1978 |
| JP | S56-94462 | U | 7/1981 |
| JP | 06-011228 | A | 1/1994 |
| JP | 06-33326 | B | 8/1994 |
| JP | 07-190578 | A | 7/1995 |
| JP | 10-148437 | A | 6/1998 |
| JP | 10-188125 | A | 7/1998 |
| JP | 10-197119 | A | 7/1998 |
| JP | H10-206004 | A | 8/1998 |
| JP | 1999325691 | A | 11/1999 |
| JP | 2000009372 | A | 1/2000 |
| JP | 2000105052 | A | 4/2000 |
| JP | 2000111229 | A | 4/2000 |
| JP | 2000146421 | A | 5/2000 |
| JP | 2000320943 | A | 11/2000 |
| JP | 2001221555 | A | 8/2001 |
| JP | 2002162139 | A | 6/2002 |
| JP | 2002350021 | A | 12/2002 |
| JP | 2002372349 | A | 12/2002 |
| JP | 2003056966 | A | 2/2003 |
| JP | 2003075050 | A | 3/2003 |
| JP | 2003090667 | A | 3/2003 |
| JP | 2003121043 | A | 4/2003 |
| KR | 19970001294 | B1 | 2/1997 |
| KR | 1998018912 | U | 7/1998 |
| KR | 1999021017 | A | 3/1999 |
| KR | 1999030143 | A | 4/1999 |
| KR | 19970001293 | A | 5/1999 |
| KR | 19990031465 | A | 5/1999 |
| KR | 19970062375 | B1 | 6/1999 |
| KR | 19990021540 | U | 6/1999 |
| KR | 19990043740 | A | 6/1999 |
| KR | 19990062189 | A | 7/1999 |
| KR | 19990065602 | A | 8/1999 |
| KR | 19990066209 | A | 8/1999 |
| KR | 20000028513 | A | 5/2000 |
| KR | 20000050416 | A | 8/2000 |
| KR | 20010008710 | A | 2/2001 |

(56) References Cited

FOREIGN PATENT DOCUMENTS

| | | | | | |
|---|---|---|---|---|---|
| KR | 20010029590 | A | | 4/2001 | |
| KR | 2003-0030961 | A | | 4/2003 | |
| WO | 03033976 | A1 | | 4/2003 | |
| WO | 03102481 | A1 | | 12/2003 | |
| WO | WO 2004085937 | A1 | * | 10/2004 | ..... F25D 11/02 |

* cited by examiner

IN THE DOOR ICE MAKER

CROSS-REFERENCE TO RELATED APPLICATIONS

The present application constitutes a continuation of U.S. patent application Ser. No. 12/985,451, entitled "Ice Making and Dispensing System", which is a continuation of U.S. patent application Ser. No. 12/388,096, entitled "Ice Making and Dispensing System", now U.S. Pat. No. 7,895,859, which is a divisional application of U.S. patent application Ser. No. 11/830,162, entitled "ice making and dispensing system", now U.S. Pat. No. 7,509,818, which is a division of U.S. patent application Ser. No. 10/973,516, entitled "ice making and dispensing system" now U.S. Pat. No. 7,266,951.

BACKGROUND OF THE INVENTION

1. Field of the Invention

The invention relates to an ice making and dispensing system. In one aspect, the invention relates to a bottom-mount refrigerator comprising a freezer-mounted ice maker and an ice cube lifter for delivering ice cubes to a dispenser mounted in the refrigerator compartment door. In another aspect, the invention relates to an under-the-counter ice maker having an ice cube lifter for delivering ice cubes to above-the-counter dispenser outlet. Further, the invention relates to an ice and water dispenser positioned on the refrigerator compartment door of a bottom freezer refrigerator.

2. Description of the Related Art

In today's household refrigerator market, there are three basic configurations to choose from: a bottom-mount refrigerator in which the refrigerated compartment is located above the freezer compartment, a top-mount refrigerator in which the freezer compartment is located above the refrigerated compartment, and a side-by-side refrigerator in which the refrigerated compartment and freezer compartment extend the entire height of the refrigerator.

Of these three configurations, the bottom-mount configuration is considered by many consumers to have the most convenient configuration since most consumers access the refrigerated compartment of a refrigerator far more frequently than the freezer compartment. The upper position of the refrigerated compartment in a bottom-mount configuration positions the majority of the contents of the refrigerated compartment at the standing height of the consumer, negating the need for the consumer to stoop or bend over to see or select items. Therefore, a combination refrigerator with the freezer on the bottom provides the user with the greatest convenience by providing the maximum fresh food compartment space at eye-level and within easy reach.

Automatic ice making systems for use in refrigerator freezers are well known. Typically, ice making systems include an ice maker mounted in the freezer compartment with an ice cube storage bin supported under the ice maker. Ice making systems may also include ice dispensing systems for delivering ice cubes through a dispenser on the face of the refrigerator freezer. Side by side refrigerator freezers typically have the ice dispenser on the face of the freezer compartment door. Side by side refrigerator freezers can have the ice storage bin, and even the ice maker positioned on the freezer compartment door.

Automatic ice making systems mounted in the refrigerator compartment or on the refrigerator compartment door are also known. Top freezer or side by side refrigerators having an automatic ice maker in the freezer compartment and an ice dispenser on the face of the refrigerator compartment door are also known.

One of the most desired accessories for a household refrigerator is a through-the-door ice and water dispenser. A through-the-door ice and water dispenser is desirable because it greatly simplifies the process of retrieving ice cubes, i.e. it eliminates opening the door, removing the ice storage container, separating and scooping ice cubes, and pouring the ice cubes into a glass. The feature also is viewed as an energy saver, since the freezer door is not opened as often.

However, of these three configurations, typically only the side-by-side configuration offers a through-the-door ice and water system. The side-by-side configuration is best suited for through-the-door ice dispensing because the freezer door extends the height of the refrigerator cabinet, which permits the ice dispenser to be located in the freezer door at a height convenient for the user. In contrast, the top-mount and bottom-mount refrigerators have freezer door locations that would place the ice dispenser either too high or too low for convenient use by the consumer. In particular, locating the ice dispenser in a bottom-mount refrigerator involves two problems that must be overcome. First, if ice is made and/or stored in the refrigerated compartment, it will melt if not insulated from and chilled independently of the refrigerated compartment. Second, if ice is made and/or stored in the freezer compartment, it must be transported upwardly for dispensing through the ice and water dispenser.

With current ice making and dispensing technology, it has not been possible for a consumer to have the most convenient refrigerator configuration with the most desired accessory. In other words, bottom-mount refrigerators have not been available with through-the-door ice and water dispensing. Thus, it would be desirable to have an ice making and dispensing system that can be used to dispense the ice through the refrigerated compartment door of a bottom-mount refrigerator to provide the consumer with both the bottom-mount configuration and the through-the-door ice and water dispensing functionality.

Undercounter ice makers are a desirable addition to kitchens and entertainment centers in homes. However, undercounter ice makers for home use have not been available with dispensers for dispensing ice at the countertop level.

SUMMARY OF THE INVENTION

In one aspect, the invention relates to an ice maker and dispenser for a bottom freezer refrigerator having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. The ice maker is positioned on the refrigerator compartment door, an ice cube storage bin is positioned on the refrigerator door below the ice maker, and an ice dispenser positioned on the refrigerator door for dispensing ice pieces from the ice cube storage bin through the refrigerator door. The bottom freezer refrigerator includes an air delivery system leading to the ice maker and ice cube storage bin from a source of below 0° C. air for supplying air cooled to below 0° C., to the ice maker and to the ice storage bin.

The air delivery system can lead from the freezer compartment to the ice maker and ice cube storage bin and can include a supply duct and a return duct. The supply duct and return duct can each include a first air delivery portion carried on the refrigerator compartment door and a second air delivery portion leading from the bottom of the refrigerator door to the freezer compartment.

The supply duct and return duct can include a seal to seal the first air delivery portion to the second air delivery portion when the refrigerator door is closed.

The air delivery system can include an ice maker fan connected to the air delivery system wherein operation of the ice maker fan causes air from the below freezing compartment to flow to the ice maker and t the ice cube storage bin and return to the freezer compartment. The ice maker fan can be connected to the return duct so that the ice maker fan draws below 0° C. air from the freezer compartment through the supply duct to the ice maker and ice cube storage bin and then through the return duct to the ice maker fan. The ice maker fan can discharge air from the return duct into the freezer compartment.

In another aspect the invention relates to an air delivery system for a bottom freezer refrigerator that leads from the evaporator compartment of the refrigeration system to the ice maker and ice cube storage bin.

In another aspect the invention relates to an ice maker and dispenser for a bottom freezer refrigerator having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. An ice maker is positioned in an insulated ice maker sub-compartment on the refrigerator door, an insulated ice cube storage bin is positioned on the refrigerator door below the ice maker, and an ice dispenser is positioned on the refrigerator door below the ice cube storage bin or dispensing ice pieces from the ice cube storage bin through the refrigerator door. An air delivery system leads to the ice maker and ice cube storage bin from a source of below 0° C. air for supplying air cooled to below 0° C. to the ice maker and to the ice storage bin.

The ice cube storage bin can be positioned in an insulated ice cube storage bin sub-compartment on the refrigerator door. The insulated ice cube storage bin sub-compartment can comprise a space enclosed by an insulated over movably carried by the refrigerator compartment door. The insulated cover can be transparent and the insulated cover can be pivotally mounted on the refrigerator door. The insulated cover can include a gasket for forming a seal to the refrigerator door liner.

In another aspect the insulated ice cube storage bin comprises side walls and a bottom wall formed of insulating material. The ice cube storage bin can be formed of clear insulating double wall material.

In another aspect the invention relates to an ice maker and dispenser for a bottom freezer having a freezer compartment maintained at a temperature below 0° C., a refrigerator compartment positioned above the freezer compartment maintained at a temperature above 0° C., an insulated freezer compartment door, an insulated refrigerator compartment door, and a refrigeration system for cooling the freezer compartment and the refrigerator compartment. An ice maker is positioned in an insulated ice maker sub-compartment on the refrigerator compartment door having a mold for forming ice pieces, an ice cube storage bin is positioned on the refrigerator door below the ice maker, and an ice dispenser is positioned on the refrigerator door below the ice cube storage bin for dispensing ice pieces from the ice cube storage bin through the refrigerator door. The bottom freezer refrigerator includes air delivery system having a supply duct and a return duct leading to the ice maker and ice cube storage bin from a source of below 0° C. air for supplying air cooled to below 0° C. to the ice maker and to the ice storage bin. The air delivery system includes an ice maker fan connected to the air delivery system wherein operation of the ice make source of below 0° C. air to flow to the ice maker and to the ice storage bin. The supply duct and the return duct include a first air delivery portion carried on the refrigerator door and a second air delivery portion leading from the bottom of the refrigerator door to the source of below 0° C. air.

The first air delivery portion of the supply duct and the return duct includes a vertical portion extending from the bottom of the refrigerator door to the ice maker sub-compartment.

The ice maker mold includes side walls and a bottom wall and the ice maker further comprises a housing enclosing the side walls and bottom wall of the ice mold forming an air flow passage around the ice maker mold. The housing includes side walls and a bottom wall spaced from the side walls and a bottom wall spaced from the side walls and bottom wall of the ice mold and the air flow passage comprises the space between the ice mold and the housing.

The ice maker mold can include a plurality of fins extending from the side walls and bottom wall of the ice mold and extending substantially to the side walls and bottom wall of the housing. The fins can be arranged to form an elongated air flow passage around the bottom and sides of the ice maker mold.

A supply connector can be provided to lead from the outlet in the top of the vertical portion of the supply duct t the air flow passage around the ice maker mold to the return duct.

An inlet port can be provided in the vertical portion of the supply duct adjacent to the ice cube storage bin and an outlet port can be provided in the vertical portion of the return duct adjacent to the ice storage bin. An ice cube storage bin damper can be provided to control air flow through one or both of the inlet port and the outlet port.

An ice cube storage bin temperature sensor can be positioned adjacent the ice cube storage bin and connected to a control to regulate the position of the ice cube storage bin damper in response to the temperature sensed by the ice cube storage bin sensor. The ice storage damper can be a two position damper arranged to open or close one or both the inlet and outlet ports.

In another aspect of the invention the ice storage damper can be continuously adjustable in response to the temperature sensed by the ice cube storage bin temperature sensor.

Another aspect of the invention relates to an ice maker and dispenser for a bottom freezer refrigerator a freezer compartment maintained at a temperature below 0° C., a refrigerator compartment positioned above the freezer compartment maintained at a temperature above 0° C., an insulated freezer compartment door, an insulated refrigerator compartment door, and a refrigerator system for cooling the freezer compartment and the refrigerator compartment including a compressor. An automatic ice maker is positioned on the refrigerator compartment door, an ice cube storage bin is positioned on the refrigerator door below the ice maker, an ice cube storage bin temperature sensor is positioned adjacent the ice storage bin, and an ice dispenser positioned on the refrigerator door below the ice cube storage bin for dispensing ice pieces from the ice cube storage bin through the refrigerator door. An air delivery system is provided leading to the ice maker and ice cube storage bin from a source of below 0° C. air for supplying air cooled to below 0° C. to the ice maker and ice cube storage bin and having a least one port adjacent the ice storage bin, an ice cube storage bin damper to control air flow through the at least one port, and an ice maker fan connected to the air delivery system wherein operation of the ice maker fan causes air from the source of below 0° C. air to flow to the ice maker and to the ice storage bin. An ice maker control is provided for the automatic ice maker, the ice maker fan and the ice cube storage bin damper to open the ice cube storage bin damper and operate the ice maker fan when the ice cube storage bin temperature sensor indicates ice cube storage bin needs cooling, and to operator the ice maker fan when the ice maker is producing ice.

The control can include a quick ice mode of operation and the compressor can be arranged to operate at multiple speeds including high speed and the ice maker can be arranged to operate at a high speed and a normal speed. In the quick ice mode the control is arranged to operate the compressor at high speed and the ice maker fan at high speed.

The bottom freezer refrigerator can include a freezer temperature controller and a refrigerator compartment controller connected to the ice maker control. The ice maker control can be arranged to reduce the compressor speed when the freezer compartment temperature control or the refrigerator compartment temperature control sense a temperature below a predetermined temperature in the refrigerator compartment or the freezer compartment.

The ice maker control can be arranged to operate the ice maker fan at normal speed when the quick ice mode is not selected. The ice maker control can be arranged to turn off the compressor in the event the freezer compartment or refrigerator compartment temperature controls sense a temperature below a predetermined temperature and the compressor is operating at the lowest speed.

The ice maker control can be arranged to stop the ice maker fan when the ice cube storage bin temperature sensor indicates the ice cube storage bin does not need cooling.

In another aspect the invention relates to the method of producing ice cubes in a bottom freezer refrigerator having a refrigerator compartment maintained at a temperature above 0° C. positioned above a freezer compartment maintained at a temperature below 0° C., a refrigeration system for cooling the refrigerator and freezer compartments, and an automatic ice maker positioned on the refrigerator compartment door comprising he steps of operating the refrigeration system to provide cooling to the refrigerator and freezer compartments, filling the ice maker with water, and supplying the ice maker with below 0° C. air for forming ice cubes.

The step of supplying below 0° C. air can comprise causing below 0° C. air to flow through an air delivery system leading from a source of below 0° C. air to flow through a supply duct to the ice maker and returning below 0° C. air from the ice maker through a return duct.

The bottom freezer refrigerator can include an ice cube storage bin on the refrigerator compartment door below the ice maker and the method of producing ice cubes further includes the step of supplying below 0° C. air to the ice storage bin.

In another aspect the invention relates to a method of producing and storing ice pieces in a bottom freezer refrigerator having a freezer compartment maintained at a temperature below 0° C., a refrigerator positioned above the freezer compartment maintained at a temperature above 0° C., an insulated refrigerator compartment door, and a refrigeration system for cooling the freezer compartment and the refrigerator compartment having a compressor. An ice maker is positioned on the refrigerator door, an ice cube storage bin is positioned on the refrigerator door below the ice maker, and an air delivery system is provided leading to the ice maker and ice cube storage bin from a source of below 0° C. air for supplying air cooled to below 0° C. to the ice maker and ice cube storage bin and having at least one port adjacent to the ice bin and having an ice bin damper for selectively opening and closing he at least one port. An ice maker fan connected to the air delivery system wherein operation of the ice maker fan supplies air cooled to below 0° C. to the ice make and ice cube storage bin, and the method comprises opening the ice maker damper and operating the ice maker fan when the ice cube storage bin needs cooling and closing the ice maker damper when the ice cube storage bin no longer requires cooling.

The automatic ice maker can have a quick ice mode of operation and the method of producing and storing ice pieces can further comprises operating the compressor at high speed and the ice maker fan at high speed when the quick mode is requested, and reducing the compressor speed when the refrigerator or freezer compartment temperatures are below a predetermined minimum temperature.

The method of producing and storing ice pieces can include the step of turning off the compressor if the step of reducing the compressor speed reduces the compressor speed below a predetermined minimum speed. The method can further comprise operating the ice maker fan at the normal speed when the quick ice mode is not requested.

The method of producing and storing ice pieces can include the step of operating the ice maker fan when ice is requested form the ice maker. The method can include the step of stopping the ice maker fan when ice is not requested from the ice maker and the ice cube storage bin does not required cooling.

DESCRIPTION OF THE INVENTION

The inventive concept described herein relates to an ice dispensing unit for dispensing ice at a height convenient for a user, i.e. the user can retrieve ice while in a standing position, which is located above the ice maker apparatus. Several embodiments are described with an ice making and storage unit located in a compartment for forming ice cubes and a lifting apparatus for transporting the ice upwardly to a dispensing unit mounted in a space located above the ice cube forming compartment having an above-freezing temperature.

It should be noted that the embodiments described hereinafter share many of the same elements, such as a refrigerated compartment, freezer compartment, refrigerator and freezer compartment doors, a dispenser outlet mounted in the refrigerator compartment door, an ice maker, an ice cube storage container, and the like. It will be understood that the operation of these elements will generally be the same for each embodiment, and a description of their operation will not be repeated for each embodiment, unless otherwise noted. As well, elements common to more than one embodiment will be identified with common numerals. Ice cubes are illustrated in the Figures as generally semicircular pieces of ice, although the inventive concepts described herein are not so limited, and are equally applicable to ice particles having a cylindrical, rectilinear, or other shape. The term refrigerator is generally used to refer to an appliance with having both a refrigerated compartment and freezer compartment. However, it can apply to an appliance with only a refrigerated compartment or with only a freezer compartment.

The ice lifting apparatus embodiments according to the invention can be used with an undercounter ice maker or undercounter freezer to supply ice cubes to an ice dispenser outlet positioned on the counter top adjacent the ice maker. As above, operation of elements of the ice lifter apparatus used with an undercounter ice maker will be generally the same as when used in conjunction with a bottom-freezer refrigerator, and a description of their operation will not be repeated, unless otherwise noted.

Figure 1:
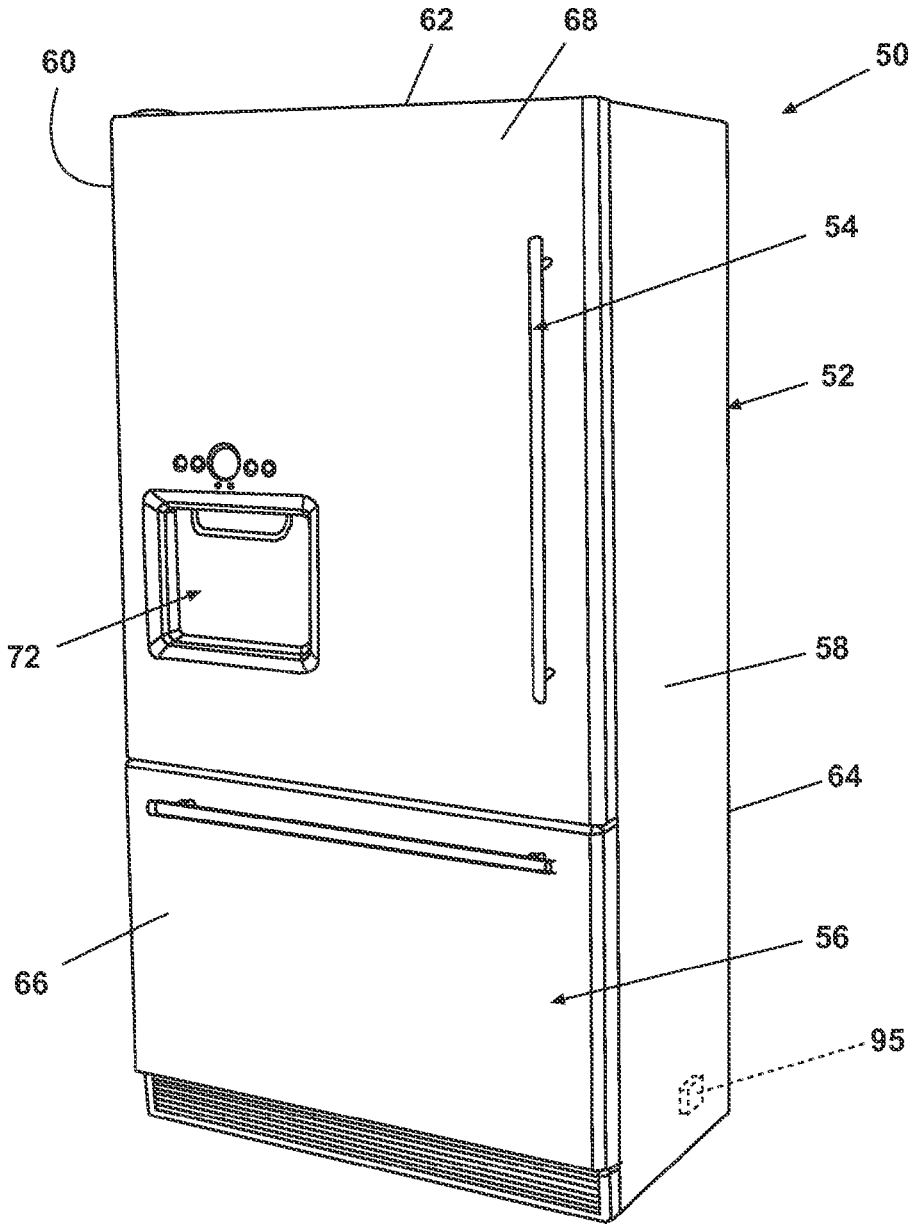
FIG. 1 is a perspective view of a bottom-mount freezer refrigerator comprising alternate embodiments of an ice forming and dispensing unit providing through-the-door ice cube and water dispensing.
Figure 2:
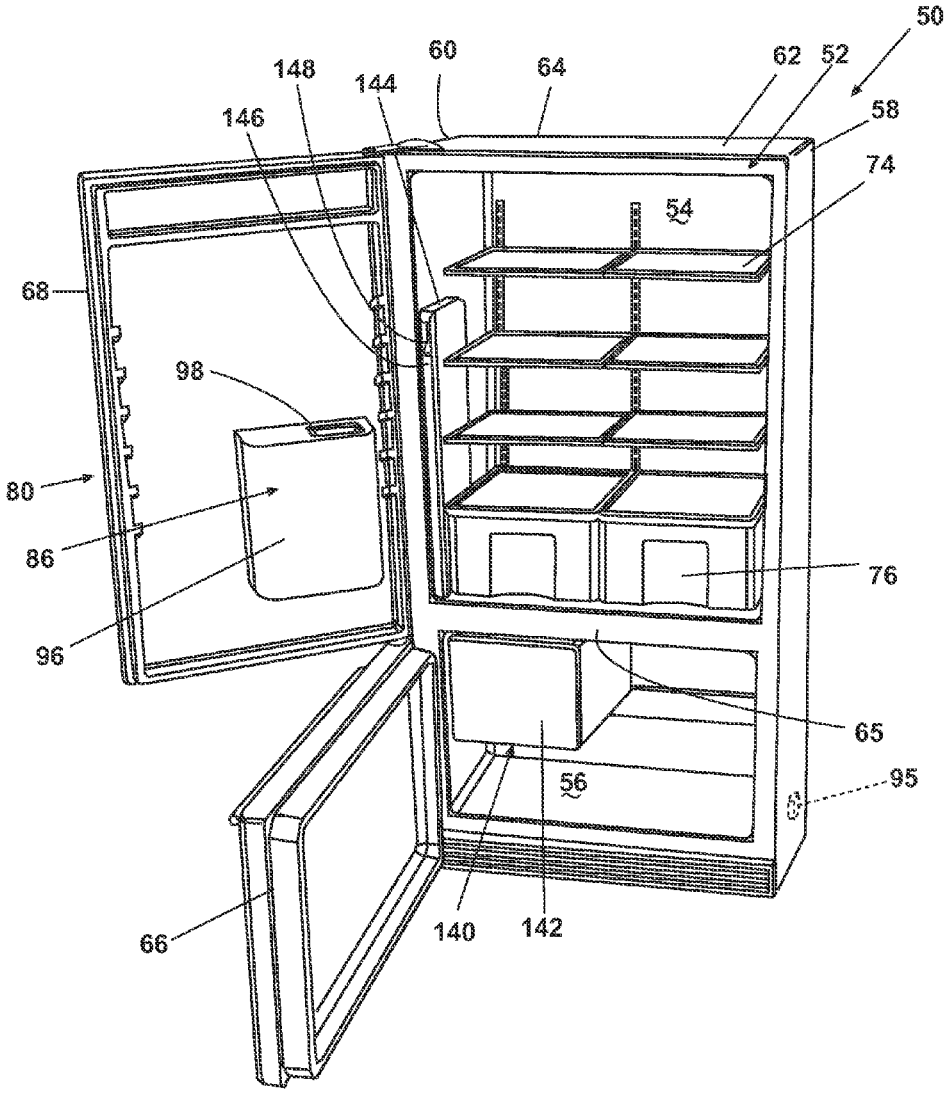
FIG. 2 is a perspective view similar to FIG. 1 with the refrigerator and freezer compartment doors open illustrating a freezer-mounted ice cube forming and dispensing apparatus and ice lifter according to the invention.

FIGS. 1 and 2 illustrate a bottom-mount refrigerator 50 comprising an embodiment of an ice-making and dispensing apparatus according to the invention. The refrigerator 50 comprises a generally well-known insulated cabinet 52 defining an upper refrigerator compartment 54 arranged to operate at above 0° C. temperatures and a lower freezer compartment 56 arranged to operate at below 0° C. temperatures and located beneath the refrigerator compartment 54. The cabinet 52 comprises a pair of insulated sidewalls 58, 60, an insulated top wall 62, and an insulated back wall 64. A compartment separator 65 bisects the interior of the cabinet 52 and separates the refrigerator compartment 54 from the freezer compartment 56.

An insulated freezer compartment door 66 can be hingedly mounted to the cabinet 52 to provide selective access to the freezer compartment 56. Similarly, an insulated refrigerator compartment door 68 can be hingedly mounted to the cabinet 52 to provide selective access to the refrigerator compartment 54. While the freezer compartment door 66 is illustrated as being hingedly mounted about a vertical axis, it could also be configured as a horizontally translating pullout freezer drawer.

The refrigerator 50 also comprises shelves 74 and storage bins 76, which are illustrated in FIG. 2 in the refrigerated compartment 54, but which can also be located in the freezer compartment 56. The refrigerator 50 also comprises a traditional cooling system comprising a motor driven compressor and evaporator containing a suitable coolant, one or more ventilation fans, appropriate thermostatic controls for maintaining the refrigerator compartment 54 and the freezer compartment 56 at selected temperatures, and other well-known functional features (not shown), which are not germane to the inventive concepts and will not be further described herein, except as necessary for a complete understanding of the inventive concepts.

Figure 4:
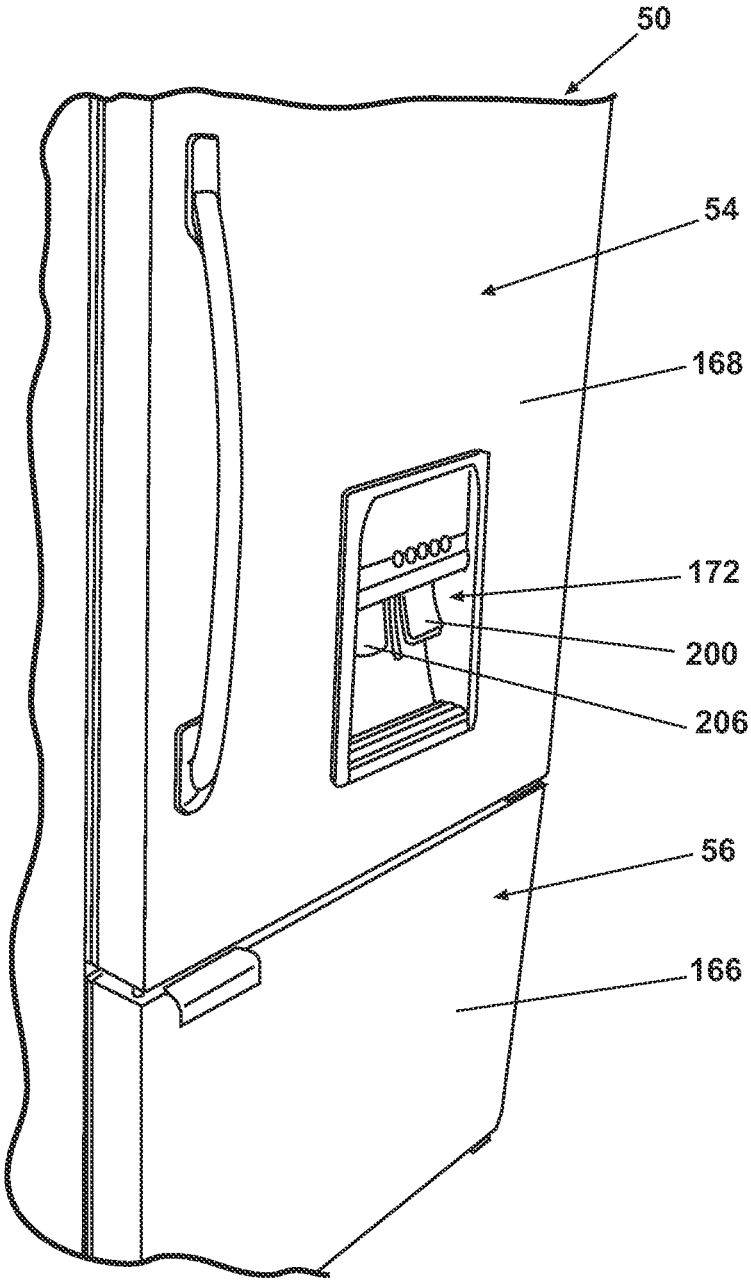
FIG. 4 is a perspective view of another embodiment of a bottom-mount freezer refrigerator comprising an embodiment of an ice forming and dispensing unit providing through-the-door ice cube and water dispensing.

An ice and water dispenser 72 including an ice dispenser outlet, not shown, can be installed in refrigerator compartment door 68 for delivering ice and water through the refrigerated compartment door 68. The dispenser 72 can be similar in many respects to an ice and water dispenser disclosed in U.S. Pat. No. 6,082,130 to Pastryk et al which is incorporated herein in its entirety. Dispenser 72 can also be similar to water and ice dispensers disclosed in U.S. Pat. No. 4,084,725 to Buchser, U.S. Pat. No. 4,176,527 to Linstromberg et al, and U.S. Pat. No. 4,942,979 to Linstromberg et al which are each incorporated herein in their entirety. While the Pastryk et al patent and Linstromberg et al patents disclose ice crushing mechanisms incorporated in the ice storage bin and ice dispensing apparatus, those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. Typically through-the-door dispensers include one or two actuators (see FIG. 4) for activating ice cube or chilled water dispensing by pressing a glass or suitable container against the actuator. As is well understood by those skilled in the art, pressing the ice dispensing actuator can cause an ice passage door, not shown, to open a dispenser outlet, not shown, and close a switch to activate the ice dispensing apparatus. When the glass or container is removed the ice passage door can close and the ice dispensing apparatus de-energized. Dispenser 72 can also include a user interface, not shown, that can include suitable controls for the ice and water dispenser and, if desired, other refrigerator functions. The ice and water dispenser controls can be similar to the ice and water dispenser controls disclosed in U.S. patent application Ser. No. 10/861,203, now U.S. Pat. No. 7,201,005, which is incorporated herein in its entirety.

FIG. 2 illustrates an embodiment of an ice making and dispensing apparatus 140 comprising an ice maker and storage container module 142 mounted in the freezer compartment 56. Ice making and dispensing apparatus 140 can include a lifting mechanism 144 for lifting ice cubes from the freezer compartment 56 to a dispenser module 86 in operable communication with a dispenser 72 that can be positioned on refrigerator compartment door 68 as described above or on a countertop. If desired, an ice cube storage bin (not shown) can be included in module 86 and can be provided with an ice crushing feature as described in the Pastryk et al patent as described above. Those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. If an ice cube storage bin is included in module 86 suitable cooling arrangements can be included to maintain the ice cube storage bin below 0° C. Examples of a cooling arrangement for an ice storage bin on a refrigerator compartment door are described in U.S. patent application Ser. No. 10/973,543, now U.S. Pat. No. 7,188,479, filed by Anselmino et al, which application is entirely incorporated by reference in this application, and included in the present disclosure below. Dispenser module 86 can be provided with an insulated enclosure 96 to facilitate maintaining a below 0° C. temperature in module 86. Ice maker and storage module 142 can form an ice maker compartment in freezer compartment 56. Those skilled in the art will understand that the entire freezer compartment 56 can comprise the ice maker compartment and that the compartment housing the ice maker and ice cube storage bin can be eliminated if desired. In this embodiment, the ice maker and storage container module 142 is generally similar to a conventional freezer compartment ice making and storage device. An ice cube lifter 144 can extend from the freezer compartment 56 into the refrigerated compartment 54 to transport ice cubes from the ice maker and storage container 142 to the dispenser 72 on the refrigerator compartment door as hereinafter described. The ice cube lifter 144 is illustrated in FIG. 2 as comprising an insulated lifter conduit 146 incorporated into or installed to the insulated side wall 60 of the cabinet 52. The ice cube lifter conduit 146 can be suitably insulated and sealed to eliminate the flow of chilled air from the ice cube lifter 144 into the refrigerated compartment 54. Ice cube lifter 144 can have an outlet 148 for delivering ice cubes to dispenser inlet 98 when refrigerator compartment door 68 is closed. Those skilled in the art will readily understand that the dispenser control, not shown, can be arranged to operate only when refrigerator compartment door 68 is closed so that ice cubes delivered from outlet 148 can fall into dispenser inlet 98. The ice maker and storage module 142 can include a suitable mover (not shown) in the ice storage container to move ice cubes toward the ice cube lifter 144, or the ice cube storage container can be arranged to allow gravity feed of ice cubes to the ice cube lifter.

As is well-known in the art a water dispenser (not shown) can be integrated into the dispenser 72 so that, in addition to ice cubes, water, or a combination of both ice cubes and water can be selectively provided to a user. Suitable flexible connectors for water lines leading from a water valve 95 in the machinery compartment to the ice and water dispenser 72 can be provided to accommodate the movement of the door 68 between the open and closed positions.

Figure 3:
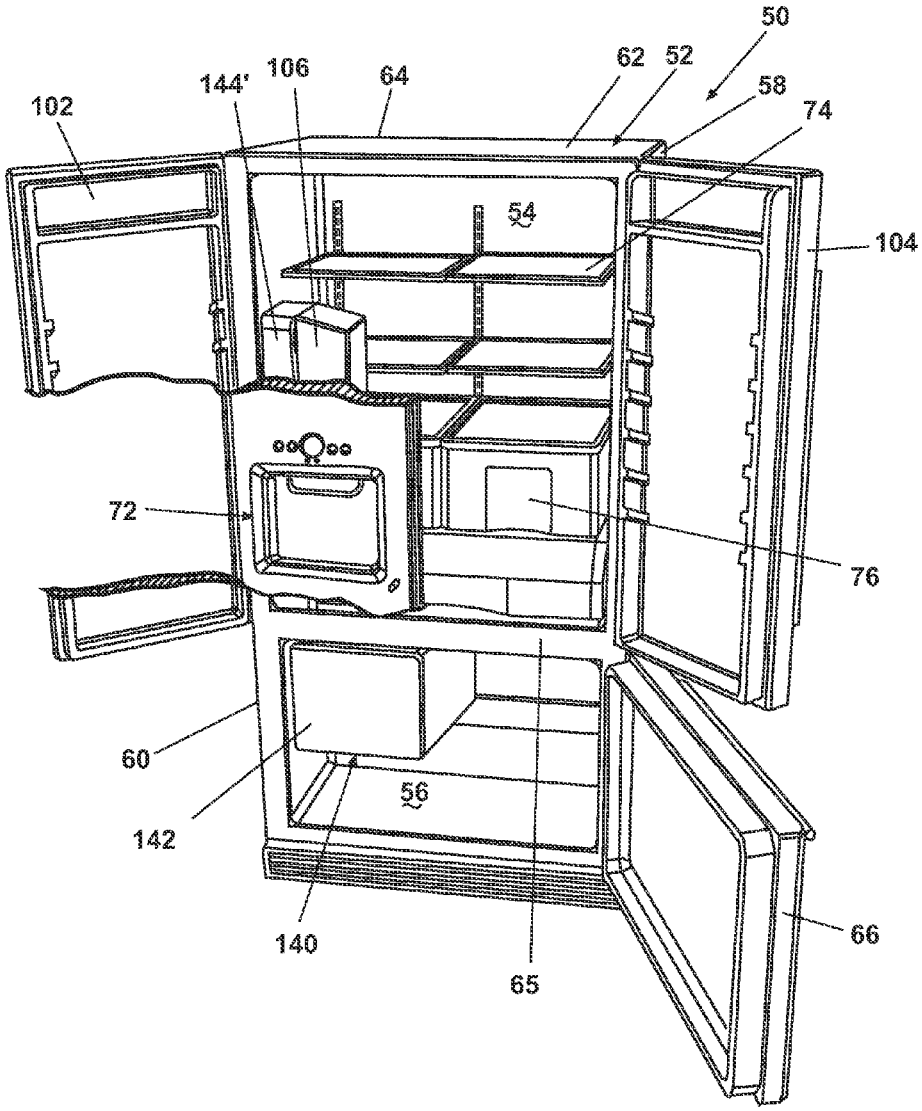
FIG. 3 is a perspective view similar to FIG. 1 illustrating another embodiment of freezer-mounted ice cube forming and dispensing apparatus and ice cube lifter according to the invention with another embodiment of refrigerator compartment door partially cut away to illustrate a through-the-door ice cube and water dispenser.

Referring now to FIG. 3, an alternate embodiment of a bottom-mount freezer refrigerator 50 is illustrated, which is similar to many respects to the embodiment illustrated in FIGS. 1 and 2. In this embodiment, a pair of refrigerator compartment doors 102 and 104 can be provided instead of a single door 68. An ice maker 140 can be mounted in the freezer compartment 56 as in the embodiment of FIGS. 1 and 2. Shelves 74 and one or more bins 76 can be provide in the refrigerator and/of the freezer compartment as is well-known in the art. An ice cube lifter 144' can be provided along and/or wholly or partially imbedded in side wall 60 as described above. In this embodiment, ice dispenser 72 can have a dispenser inlet 106 extending upward above dispenser 72 on the inside of refrigerator compartment door 102 to connect with ice cube lifter 144'. Dispenser inlet 106 can connect and seal to ice cube lifter 144' when refrigerator compartment door 102 is closed. Those skilled in the art will understand that suitable seals can be provided to facilitate sealing the outlet, not shown, of ice cube lifter 144' to dispenser inlet 106.

Figure 5:
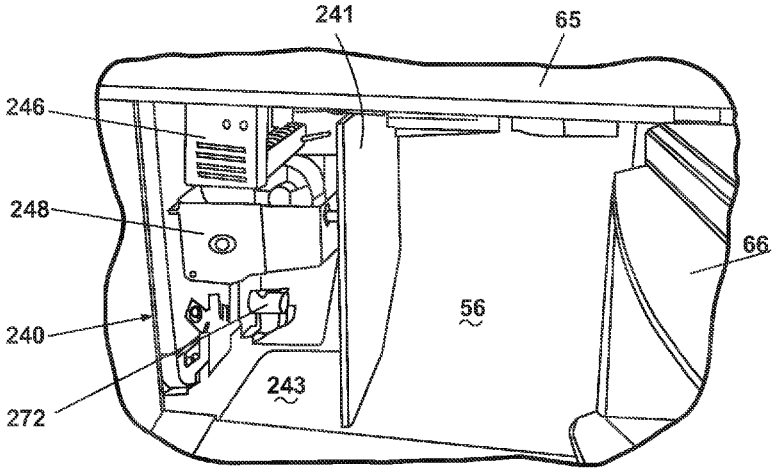
FIG. 5 is a partial perspective view of the bottom-mount freezer refrigerator of FIG. 1 and FIG. 2 illustrating one embodiment of a freezer-mounted ice maker, ice cube storage bin and dispensing apparatus positioned in the freezer compartment.
Figure 6:
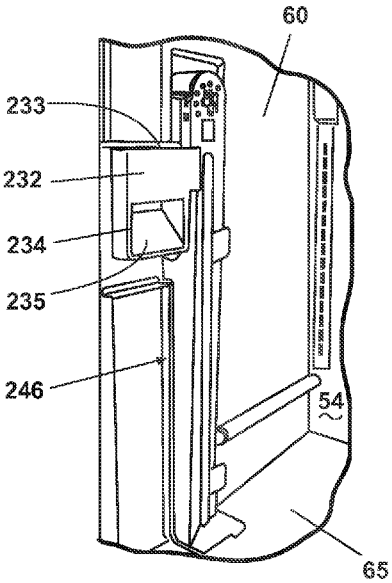
FIG. 6 is a partial perspective view of the bottom-mount freezer refrigerator of FIG. 1 and FIG. 2 illustrating the ice lifter apparatus in the refrigerator compartment.
Figure 7:
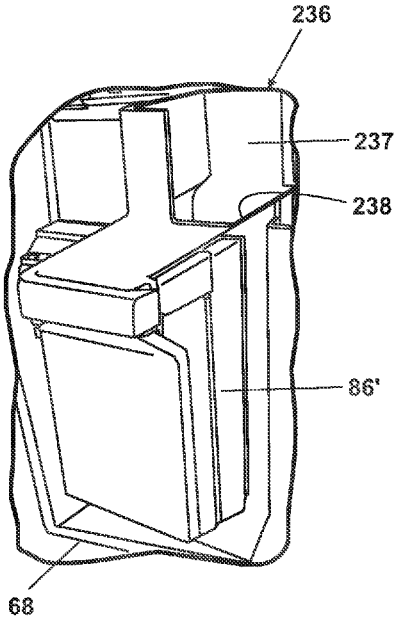
FIG. 7 is a partial perspective view of the bottom-mount freezer refrigerator of FIG. 1 and FIG. 2 illustrating the inside of the refrigerator compartment door and the connection of the ice lifter apparatus to the ice dispenser on the refrigerator compartment door.
Figure 8:
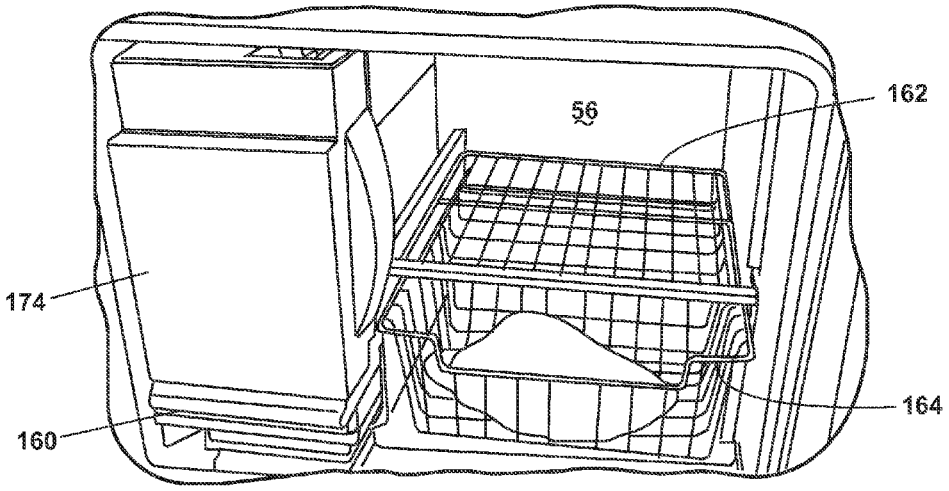
FIG. 8 is a partial perspective view of the bottom-mount freezer refrigerator of FIG. 4 illustrating another embodiment of a freezer-mounted ice maker, ice cube storage bin and dispensing apparatus positioned in the freezer compartment.
Figure 12A:
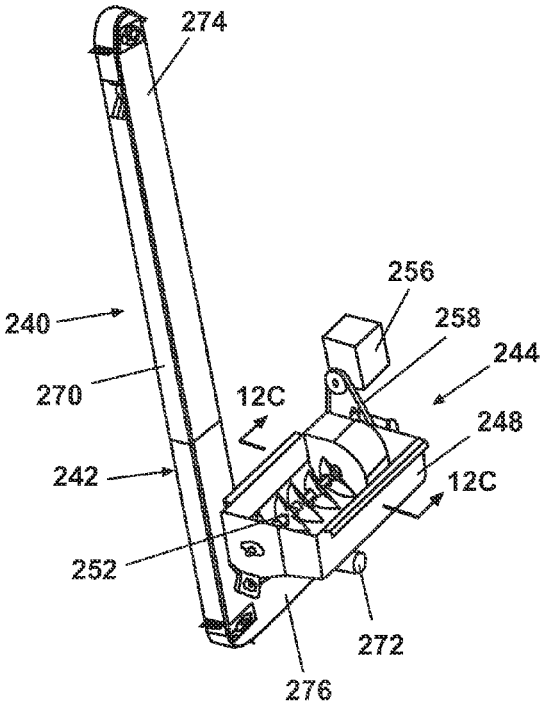
FIG. 12A is a first perspective view of a conveyor belt lifting apparatus for lifting ice cubes from a freezer-mounted ice cube forming apparatus to a refrigerator-mounted dispenser.

Referring to FIGS. 5 to 7, a bottom-mount refrigerator 50 having an alternate embodiment of ice cube lifter is illustrated. Freezer compartment 56 can have an ice cube maker 246 positioned above an ice cube storage bin 248. A wall 241 can be provided to separate ice maker 246 and ice cube storage bin 248 from the remainder of freezer compartment 56 and can form ice maker compartment 243. A vertical belt ice cube lifter 240 can be seen positioned adjacent ice maker compartment 243 along the side wall of freezer compartment 56 extending through compartment separator 65 into refrigerator compartment 54. Vertical belt ice cube lifter 240 can include an outlet 292 (FIG. 12A and 12G) and an ice cube lifter outlet chute 232 positioned along side wall 60 of the refrigerator compartment 54. Outlet chute 232 can include an outlet chute inlet 233 that can be positioned adjacent outlet 292 so that ice cubes exiting vertical ice cube lifter 240 can fall into outlet chute 232. Outlet chute 232 can include an outlet 234 at the end of outlet chute slide 235. Ice cubes falling into outlet chute 232 can freely fall onto outlet slide 235 and slide toward outlet 234. Dispenser module 86' can be positioned on refrigerator compartment door 68 and can include dispenser inlet chute 236 that can be secured to the top of dispenser module 86' overlying the dispenser inlet, not shown. Dispenser module 86' can be in operable communication with dispenser 72 described above. Inlet chute 236 can include an inlet 237 and an inlet chute slide 238 leading down to the dispenser inlet. As can be seen by referring to FIGS. 6 and 7, outlet chute outlet 234 and inlet chute inlet 237 can be arranged to form a substantially closed chute leading from vertical belt ice cube lifter 240 to dispenser 86' inlet, not shown, when refrigerator compartment door 68 is closed. Operation of vertical belt ice cube lifter 240 is described in greater detail below in connection with the description of FIGS. 12A to 12I.

Referring to FIGS. 4 and 8 to 11, a bottom-mount freezer refrigerator 50 can be seen. Bottom-mount freezer refrigerator 50 can have a refrigerator compartment door 168 that can have an ice and water dispenser 172 positioned on the door generally similar to dispenser 72 described above, and that can include a dispenser outlet, not shown. Bottom freezer refrigerator 50 can also have a freezer compartment door 166. Ice and water dispenser 172 can include an ice dispenser paddle 200 and a water dispenser paddle 206. When ice dispenser paddle 200 and water dispenser paddle 206 are operated by a user such as by pressing a glass against the desired paddle, the ice and water dispenser control (not shown) can cause dispensing of ice cubes or water as is well known in the art. Another embodiment of an ice making and dispensing apparatus 174 according to the invention can be positioned in freezer compartment 56 having a portion extending up into refrigerator compartment 54. Freezer compartment 56 can include a shelf 162 and a basket 164. An additional storage basket 160 can be slideably mounted under ice making and dispensing apparatus 174 for storage of frozen juice cans and the like. Those skilled in the art will understand that shelves 74 and bins 76 described above can be used in refrigerator compartment 54 and freezer compartment 56 if desired.

Figure 11A:
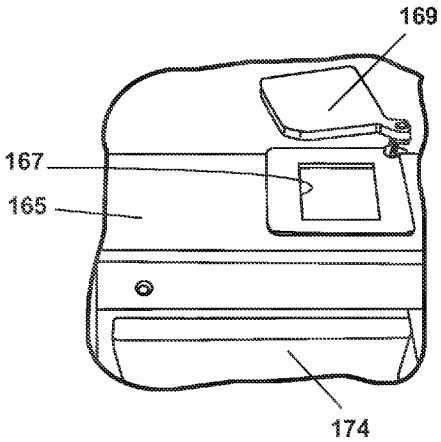
FIG. 11A is a partial perspective view of the bottom-mount freezer refrigerator of FIG. 8 illustrating the ice lifter apparatus passage through the compartment separator with the closure open.
Figure 11B:
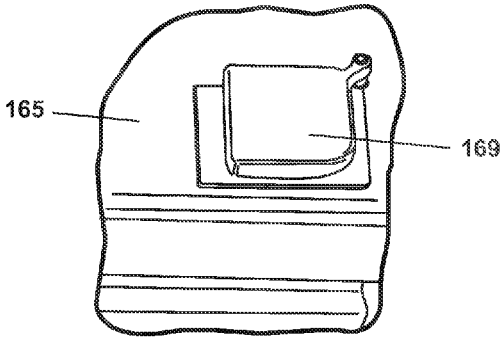
FIG. 11B is a partial perspective view of the bottom-mount freezer refrigerator of FIG. 8 illustrating the ice lifter apparatus passage through the compartment separator with the closure in the closed position.

Ice making and dispensing apparatus 174 can include an ice maker 176 and an accelerator 173 for propelling ice cubes from an ice cube storage bin 178 to dispenser 172. Accelerator 173 can include an accelerator wheel housing 175 that can be a volute, enclosing an accelerator wheel 186. Ice making and dispensing apparatus 174 can comprise an ice making compartment including an ice maker 176 and ice cube storage bin 178. Accelerator wheel housing 175 can transition into a generally upwardly directed conduit 171 that can have an outlet 191 adjacent compartment separator 165. A passage 167 can be provided in compartment separator 165 to provide a passage between the freezer compartment 56 and refrigerator compartment 54 that can connect conduit 171 with an upper conduit 188. As shown in FIGS. 11A and 11B passage 167 can have a passage door 169 that can be pivotally mounted to compartment separator 165. Passage door 169 can be arranged to selectively open and close accelerator passage 167 as shown in FIGS. 11A and 11B. Passage door 169 can be arranged to be spring loaded to allow door 169 to close as shown in FIG. 11B when refrigerator compartment door 168 is open and to open as shown in FIG. 11A when refrigerator compartment door 168 is closed. Those skilled in the art will understand that passage door 169 can be arranged to be operated by refrigerator compartment door 168 or by other operating elements including a solenoid or a wax motor, both not shown. Also, passage door 169 can be arranged to be opened by operation of the ice dispenser paddle 200 when the dispenser is activated to limit the amount of time passage door 169 is open to allow below 0° C. air from freezer compartment 56 to migrate into refrigerator compartment 54.

Figure 9:
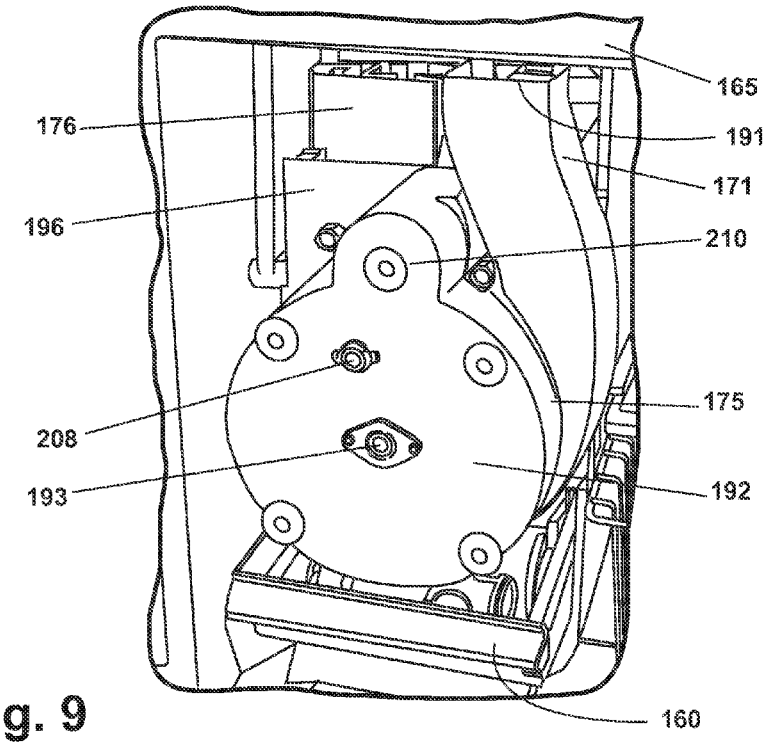
FIG. 9 is a partial perspective view of the bottom-freezer refrigerator of FIG. 8 illustrating the ice lifter apparatus positioned in the freezer compartment.
Figure 9A:
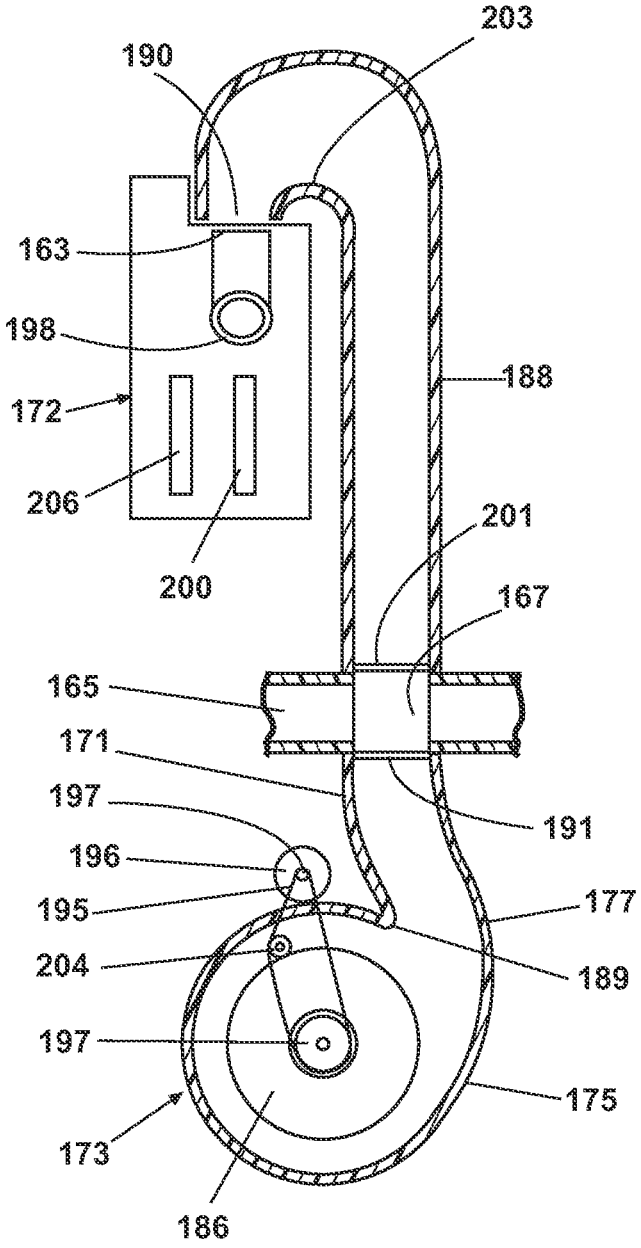
FIG. 9A is a schematic sectional front view illustrating the ice lifter apparatus of FIG. 8.
Figure 9B:
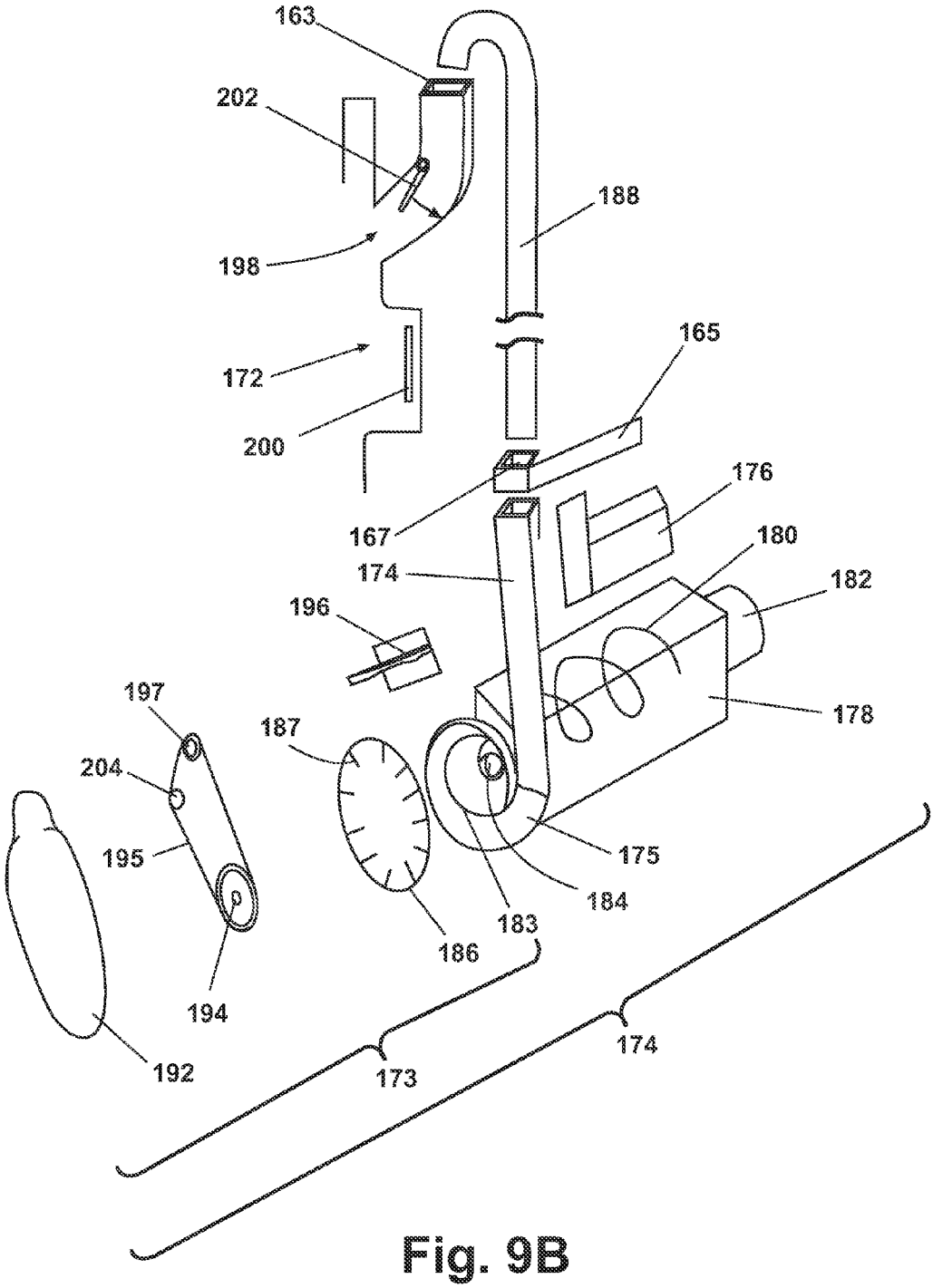
FIG. 9B is an exploded side view illustrating the ice lifter apparatus of FIG. 8.
Figure 10:
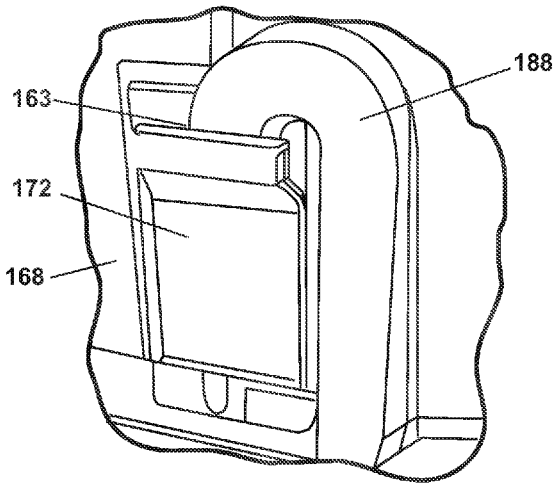
FIG. 10 is a partial perspective view of the bottom-mount freezer refrigerator of FIG. 4 illustrating the inside of the refrigerator compartment door and the connection of the ice lifter apparatus to the ice dispenser on the refrigerator compartment door.

Upper conduit 188 can be arranged on the inside of refrigerator compartment door 168. Dispenser 172 can include a dispenser outlet 198 and can be generally similar to dispenser 72 described above. Upper conduit 188 can lead from accelerator passage 167 in the compartment separator 165 to dispenser 172 and dispenser inlet 163 as can be seen in FIGS. 9A, 9B and 10. Upper conduit 188 can include an inlet 201 adjacent compartment separator 165 and can be positioned in line with accelerator passage 167 and accelerator conduit 171 when refrigerator compartment door 168 is closed. Upper conduit 188 can also include a conduit outlet 190 adjacent dispenser inlet 163. Thus, accelerator housing 175, conduit 171, compartment separator passage 167 and upper conduit 188 can form a substantially continuous passageway from accelerator wheel 186 to dispenser inlet 163 for ice cubes propelled by accelerator wheel 186. As above, dispenser 172 can be any well known ice or ice and water dispenser as used on side by side refrigerator freezers or as described in U.S. Pat. No. 4,084,725 to Buchser, U.S. Pat. No. 4,176,527 to Linstromberg et al, U.S. Pat. No. 4,942,979 to Linstromberg et al and U.S. Pat. No. 6,082,130 to Pastryk et al identified and incorporated by reference above. Ice and water dispenser 172 can have an ice cube dispenser outlet 198 and an ice dispenser paddle or actuator 200. Ice dispenser paddle 200 can be arranged to open an ice dispenser door 202 that can be arranged to close the ice cube passage to substantially prevent the escape of refrigerated air except when dispensing ice cubes as is well known in the art. Similarly, such through-the-door dispensers typically include a water dispenser that can include a water dispenser outlet, not shown, and a water dispenser paddle 206 to activate the water dispensing apparatus.

Referring to FIGS. 9, 9A, 9B and 9C accelerator 173 can include accelerator housing 175 that can be mounted at the front of ice cube storage bin 178. Accelerator housing 175 can include a central opening 183 that can be aligned with ice cube bin outlet 184 that can be positioned in the front wall of the ice cube storage bin 178. Ice cube storage bin 178 can include a mover for moving ice cubes in the ice cube storage bin 178 forward. The mover can be an auger 180 that can be rotatably mounted in ice cube storage bin 178 and arranged to move ice cubes forward in the ice cube storage bin 178 when auger 180 is operated. Auger 180 and be operatively connected to an auger motor 182. When auger motor 182 is activated by pressing on the ice dispenser paddle 200, auger 180 rotates moving ice cubes forward in ice cube storage bin 178 and out through ice cube bin outlet 184. Ice cubes exiting ice cube bin outlet 184 can fall into accelerator 186 to be propelled by accelerator 186 out of accelerator housing 175 through conduit 171, passage 167 in compartment separator 165 and upper conduit 188 and into dispenser 172.

Accelerator wheel 186 can be rotatably mounted in accelerator housing 175 and can be arranged to be driven by accelerator motor 196 via accelerator motor pulley 197, idler pulley 204, accelerator wheel drive belt 195 and accelerator drive pulley 194. An accelerator cover 192 can be provided to close accelerator housing 175. Accelerator cover 192 can support accelerator wheel bearing 193, idler pulley bearing 208 and accelerator motor bearing 210. Accelerator wheel bearing 193 can rotatable support accelerator wheel 186 in accelerator housing 175. Likewise, idler pulley bearing 208 can support idler pulley 204 in accelerator housing 175. Motor shaft bearing 210 can support the end of the motor shaft (not shown) on which accelerator motor pulley 197 is attached. Those skilled in the art will understand that accelerator wheel 186 can be arranged to be coupled to a motor in other well known operating arrangements. Accelerator wheel 186 can be arranged to rotate at 500 to 3500 rpm to reliably propel ice cubes from accelerator housing 175 to ice dispenser 172. Accelerator motor 196 and auger motor 182 can be arranged to be operably supported adjacent ice cube storage bin 178. Similarly, an ice maker 176 can be positioned above ice cube storage bin 178 and arranged to drop ice cubes harvested from the ice maker into the ice cube storage bin 178 as is well known in the art. Thus, when a user activates the ice dispenser 172 by pressing ice dispenser paddle 200, auger motor 182 can be energized to move ice cubes 185 into the center of accelerator wheel 186. Accelerator motor 196 can also be energized to cause accelerator wheel 186 to rotate.

Figure 9C:
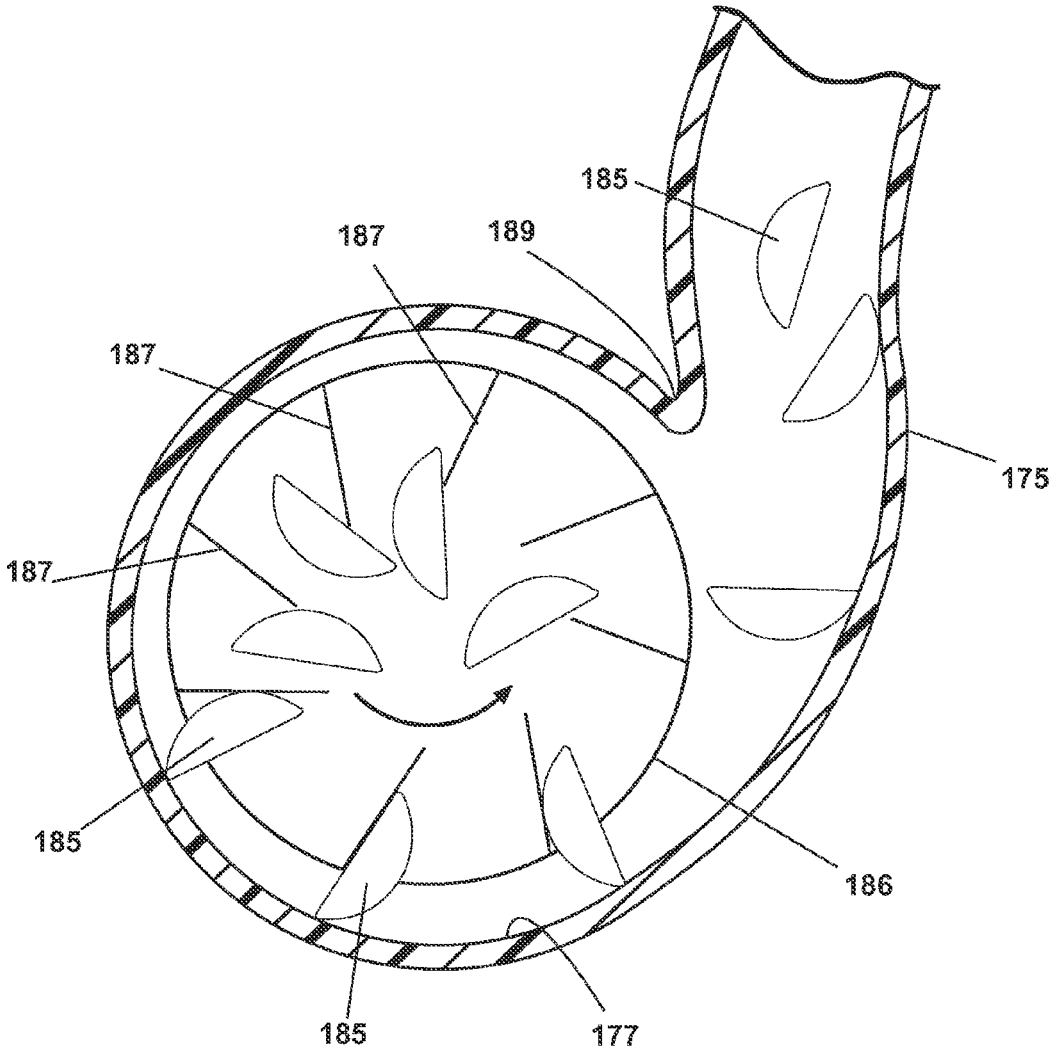
FIG. 9C is a schematic view of a portion of the ice lifter apparatus of FIG. 9.

As ice cubes fall into the center of accelerator wheel 186 they are contacted by blades 187. Blades 187 propel ice cubes 185 rotationally and radially against accelerator wheel housing inner wall 177 with sufficient energy to cause the ice cubes 185 to escape accelerator wheel 186 when there is sufficient space between accelerator wheel 186 and accelerator wheel housing 175 as illustrated in FIG. 9C. Blades 187 can be positioned generally radially on accelerator wheel 186, or as illustrated in FIG. 9C, at an angle from radial in the direction of rotation. Those skilled in the art will understand that the position of blades 187 on accelerator wheel 186 can be determined in order to achieve optimal performance in specific applications depending on parameters that can include system geometry and ice cube configuration among other parameters. As mentioned above, accelerator wheel housing 175 can take a volute shape around accelerator wheel 186 and define a widening gap between the accelerator wheel 186 and accelerator wheel housing inner wall 177 moving counter clockwise from cutoff 189. As ice cubes 185 are propelled off of accelerator wheel 186 the momentum and direction of discharge can cause the ice cubes 185 to move up through conduit 171 and upper conduit 188 and into dispenser 172. Ice cubes that fail to carry over the top 203 of upper conduit 188 can fall back into accelerator wheel 186 to again be propelled up to conduit 188. Alternately, accelerator conduit 171 can include a bypass, not shown, to direct ice cubes falling back into ice cube storage bin 178. Those skilled in the art will understand the ice cube storage bin 178 can be arranged to provide gravity feed of ice cubes stored in the storage bin to the inlet to the accelerator, although, use of a mover such as auger 180 can provide more certain dispensing of ice cubes.

In the embodiments described above, the ice cube storage bin has been shown positioned in the freezer compartment adjacent the ice maker. Those skilled in the art will understand that the ice cube storage bin can be located on the refrigerator compartment door combined with the ice dispenser as generally shown in U.S. Pat. No. 6,082,130 to Pastryk et al fully incorporated herein by reference. When the ice cube storage bin is positioned on the inside of the refrigerator compartment door those skilled in the art will readily understand that a supply of below 0° C. air or an auxiliary evaporator or other chilling mechanism can be provided to maintain ice cubes in the ice cube storage bin at below 0° C. temperatures.

Referring now to FIGS. 12A-I, a vertical conveyor belt lifter 240 is illustrated comprising a conveyor belt assembly 242 in cooperative register with an ice storage and delivery assembly 244. The ice storage and delivery assembly 244 can include a well-known ice maker 246 (FIG. 12C) for forming ice cubes 260, and an ice cube storage bin 248 positioned relative thereto for storing the formed ice cubes 260.

Figure 12B:
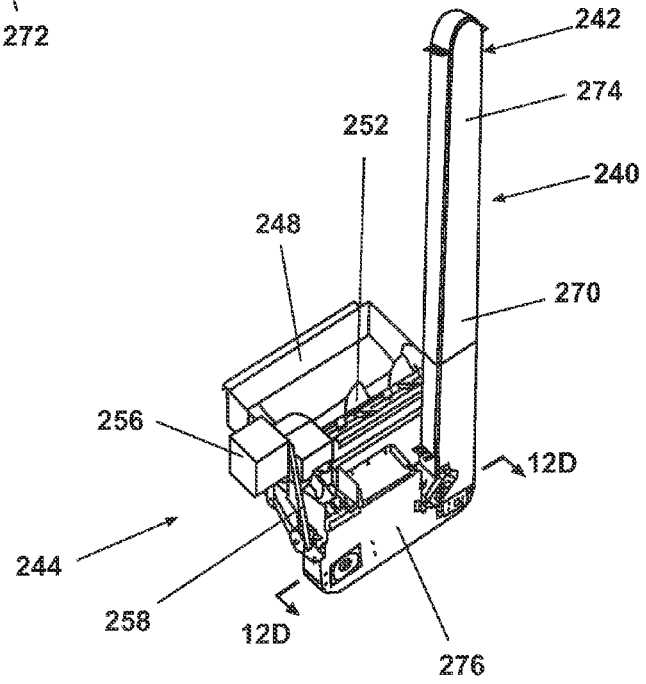
FIG. 12B is a second perspective view of the lifting apparatus illustrated in FIG. 12A.
Figure 12C:
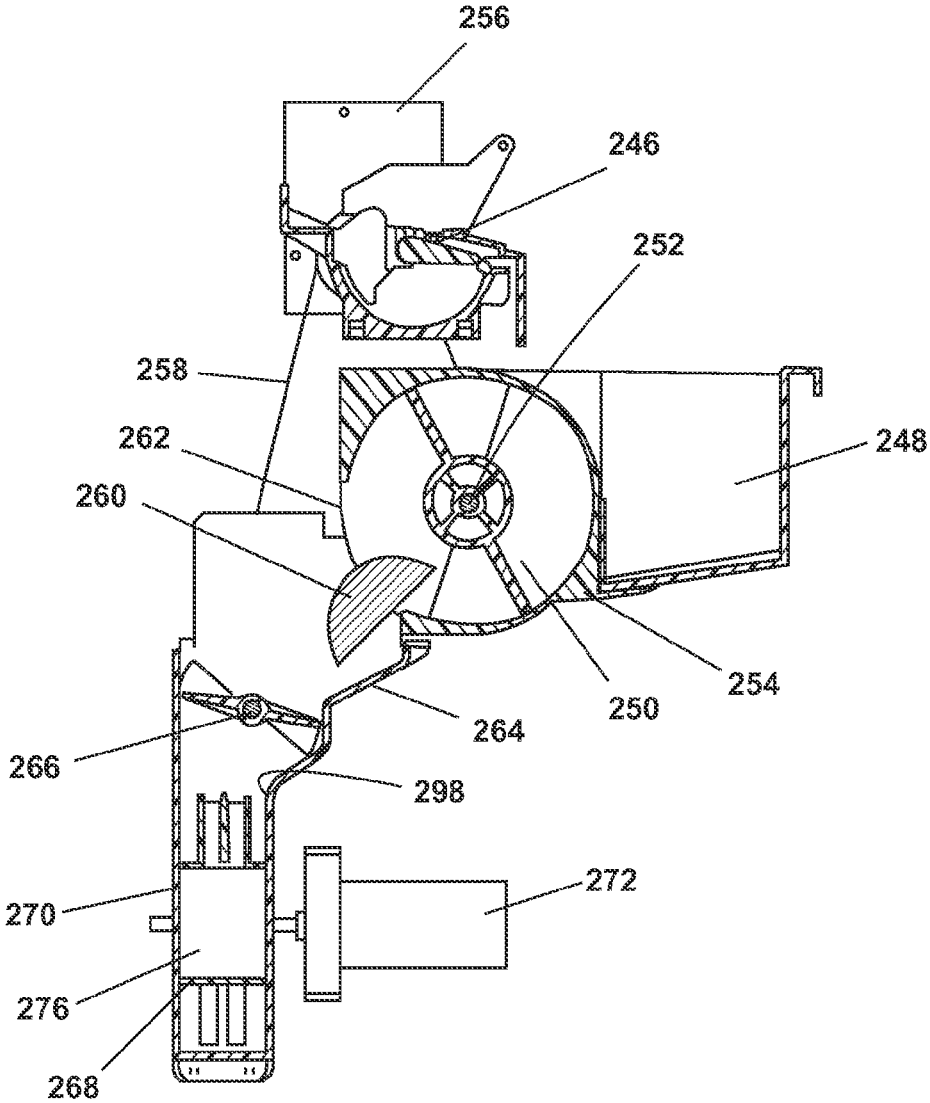
FIG. 12C is a sectional view taken along line 12C-12C of FIG. 12A.

An ice transfer assembly 250 can be operably connected to the ice cube storage bin 248 and can comprise an auger 252, positioned in ice cube storage bin 248. Auger 252 can be driven by an auger motor 256 connected to the auger 252 through a drive belt 258. The auger 252 can be adapted to move ice cubes 260 from the ice cube storage bin 248 to an auger bin outlet 262. The auger bin outlet 262 can be in communication with a dispenser enclosure 264 that can house a 3-blade dispensing auger 266. The dispensing auger 266 can be adapted to manipulate the ice cubes 260 in order to orient each ice cube 260 with a narrow, preferably rectilinear, slot 298 that can extend beneath the dispensing auger 266 and above a dispensing belt 268. The slot 298 can be arranged with its longitudinal axis parallel to the axis of the dispensing belt 268 to enable the passage of an ice cube therethrough having its longitudinal axis parallel to the axis of the dispensing belt 268. Dispensing auger 266 can be driven by auger motor 256 via drive belt 258, as illustrated in FIG. 12B.

Figure 12D:
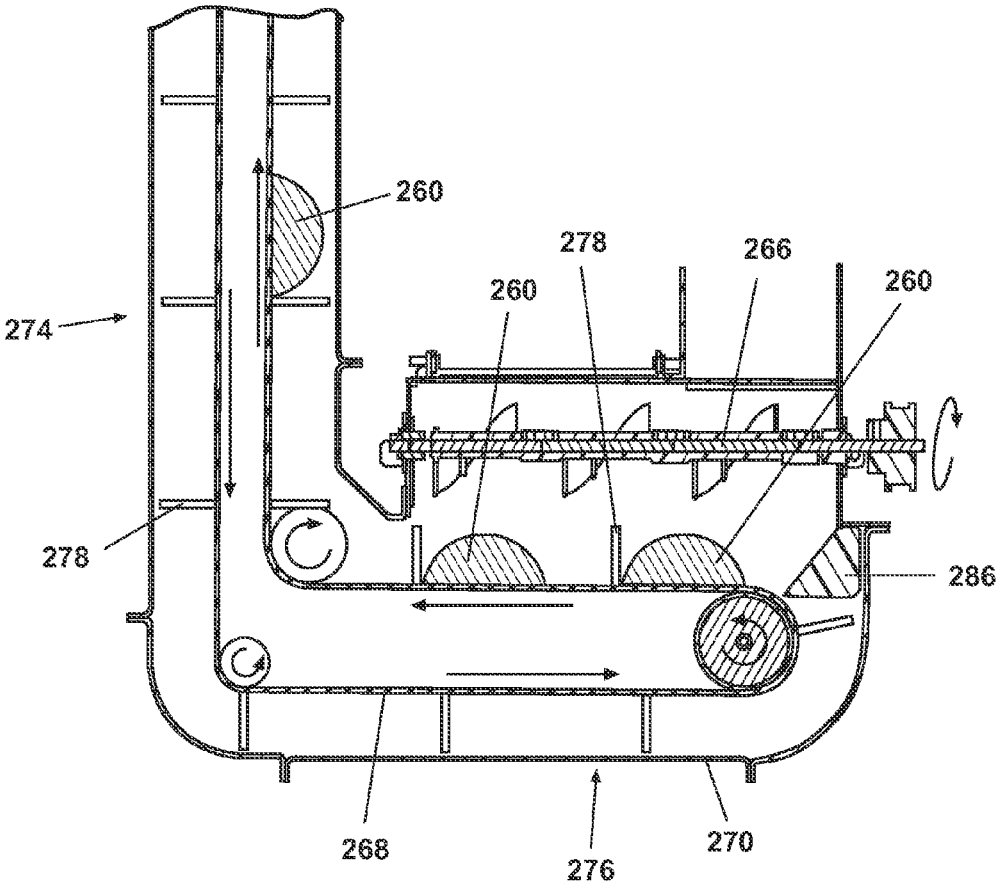
FIG. 12D is a sectional view taken along line 12D-12D of FIG. 12B.

Belt assembly 242 can comprise a dispensing belt 268 enclosed within a belt housing 270, and driven by a belt motor 272. As illustrated in FIGS. 12D and E, the belt assembly 242 can comprise a generally horizontal section 276 transitioning to a generally vertical section 274. The vertical section 274 can be adapted to extend from freezer compartment 56 to refrigerated compartment 54 to deliver ice cubes 260 to an ice and water dispenser 72 or a door-mounted storage container, not shown. Horizontal section 276 can be adapted to receive ice cubes 260 from the dispensing auger 266 for transport up the vertical section 274 to the ice and water dispenser 72. Ice and water dispenser 72 can have a dispenser outlet, not shown.

Figure 12E:
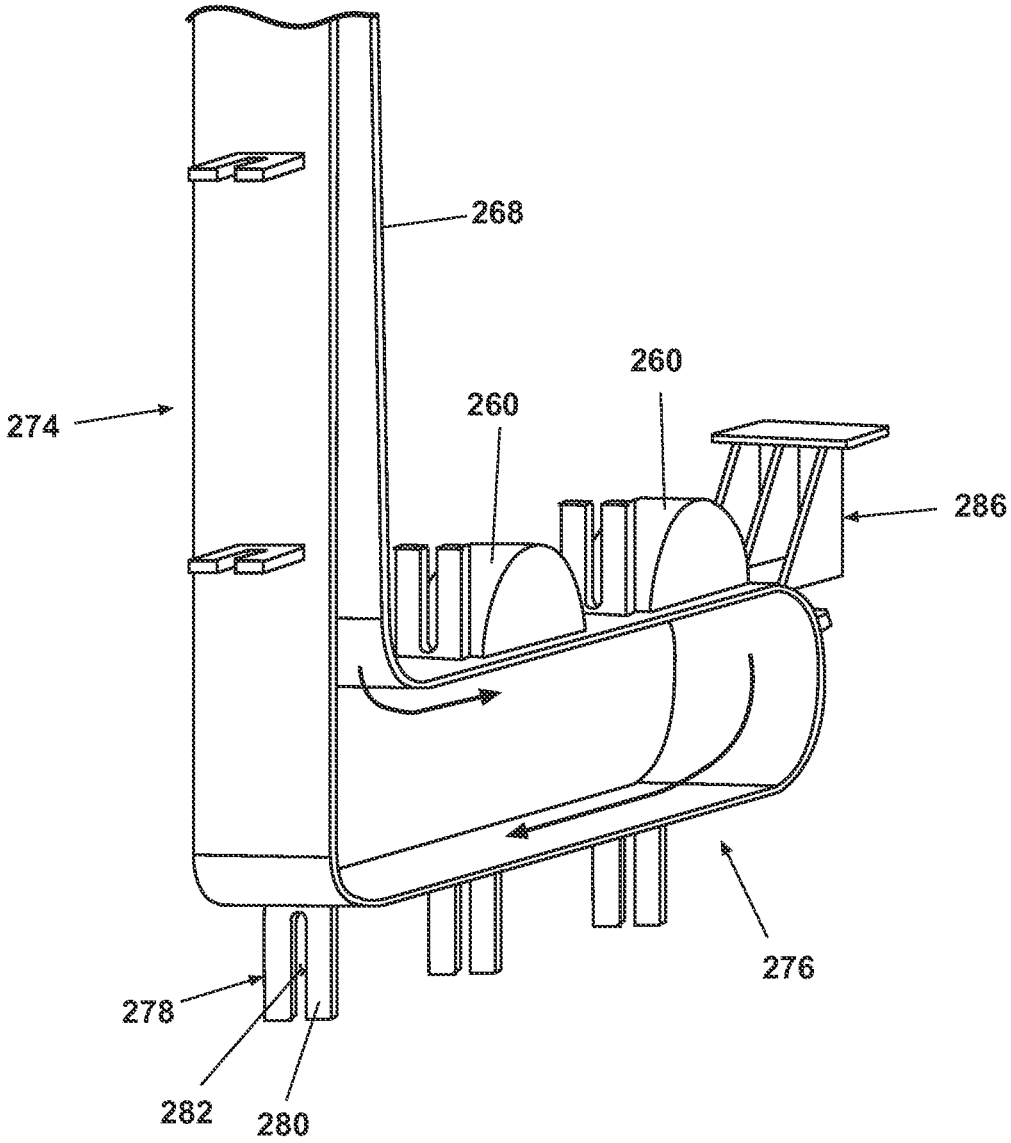
FIG. 12E is a perspective view of a portion of the conveyor belt illustrated in FIG. 12D illustrating a horizontal ice cube remover for removing ice cubes from the conveyor belt.
Figure 12F:
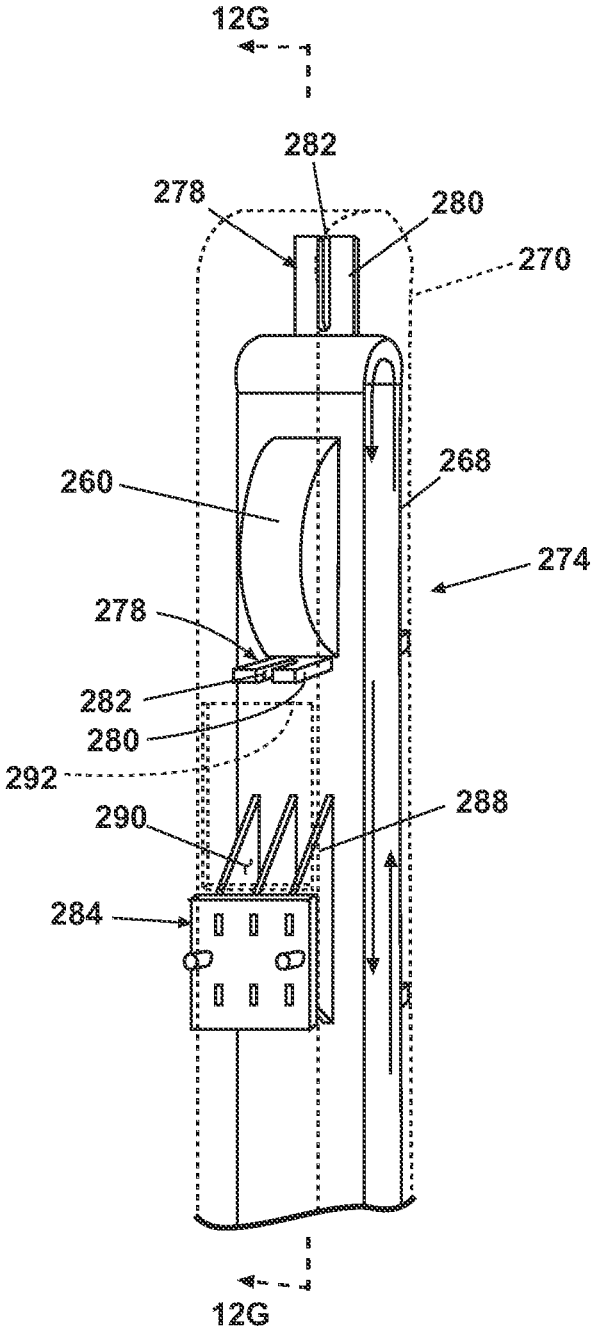
FIG. 12F is a perspective view of a portion of the conveyor belt illustrated in FIG. 12D illustrating a first embodiment of a vertical ice cube remover for removing ice cubes from the conveyor belt.

Referring specifically to FIGS. 12D-F, the dispensing belt 268 can be a flexible, continuous belt approximately the width of an ice cube 260 and comprising a suitable belt material, such as food grade urethane. The belt 268 can be provided with a plurality of lifting cleats 278 adapted to extend orthogonally outwardly for supporting ice cubes 260. The cleats 278 can be comprised of two or more cleat fingers 280 separated by a stripper space 282. The cleats 278 can be spaced along the belt 268 a distance somewhat greater than the length of an ice cube 260, and can have a length somewhat greater than the height of an ice cube 260. The belt 268 can be mounted to a plurality of suitably sized and oriented rollers for translation of the belt 268 along the horizontal and vertical directions.

The belt housing 270 can be somewhat wider than the width of the belt 268 to enable the unrestricted movement of the belt 268 therein. The clearance between the belt 268 and the belt housing 270 can be somewhat greater than the height of the lifting cleats 278. Each ice cube 260 can move through the belt housing 270 within a compartment defined by the belt 268, a pair of adjoining lifting cleats 278, and the housing 270. Thus, ice cubes 260 can be prevented from falling from the belt 268 or becoming lodged between the belt 268 and the housing 270.

Figure 12G:
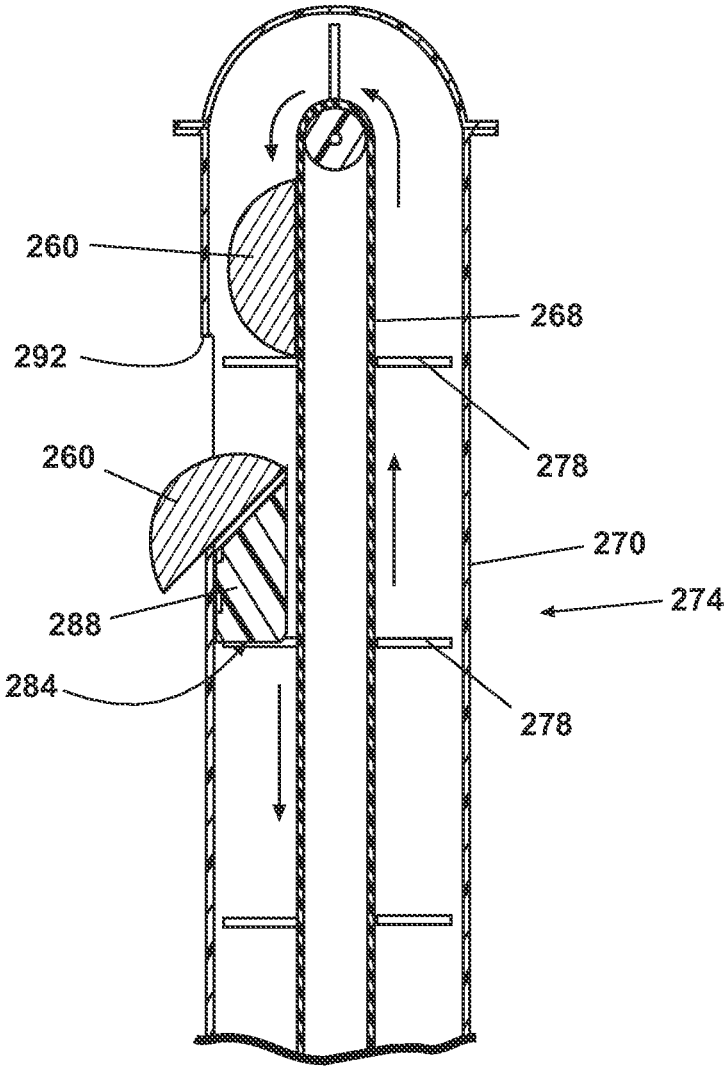
FIG. 12G is a sectional view taken along line 12G-12G of the portion of the conveyor belt illustrated in FIG. 12F.
Figure 12H:
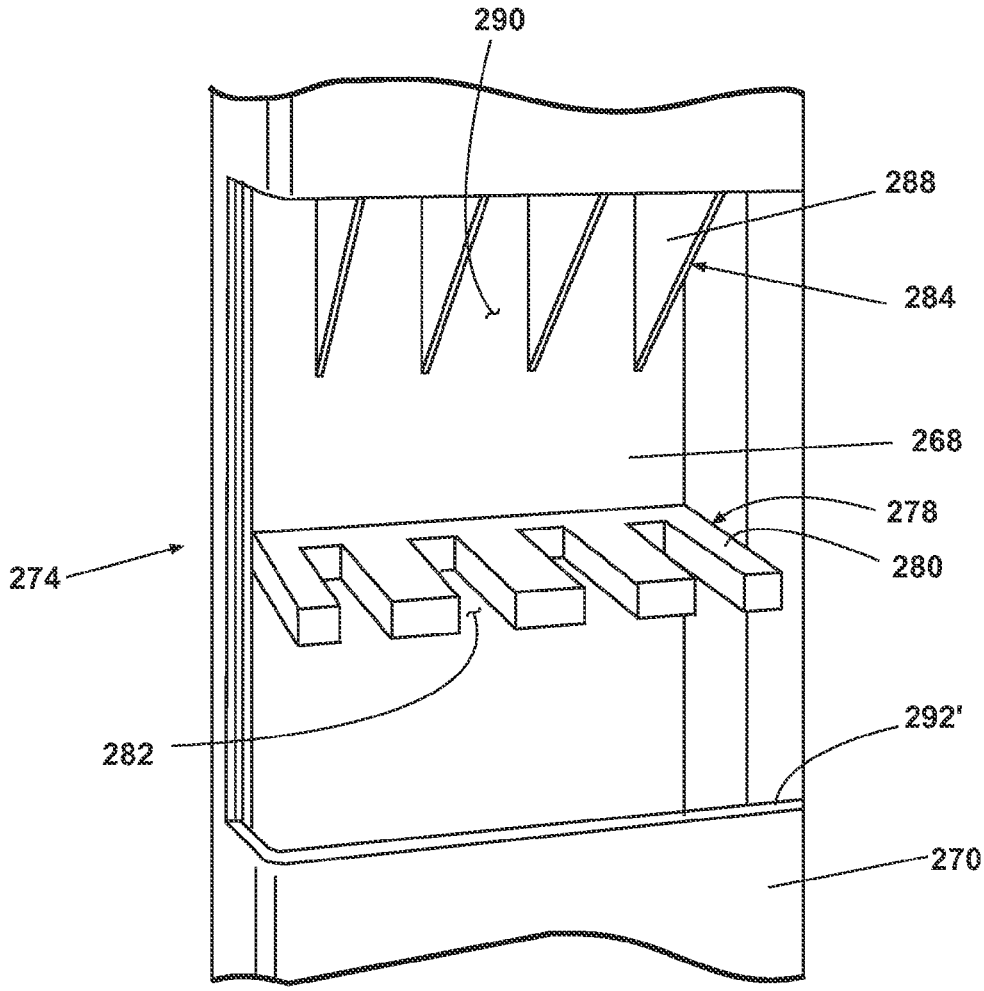
FIG. 12H is an enlarged perspective view of a second embodiment of a vertical ice cube remover for removing ice cubes from the conveyor belt.
Figure 12L:
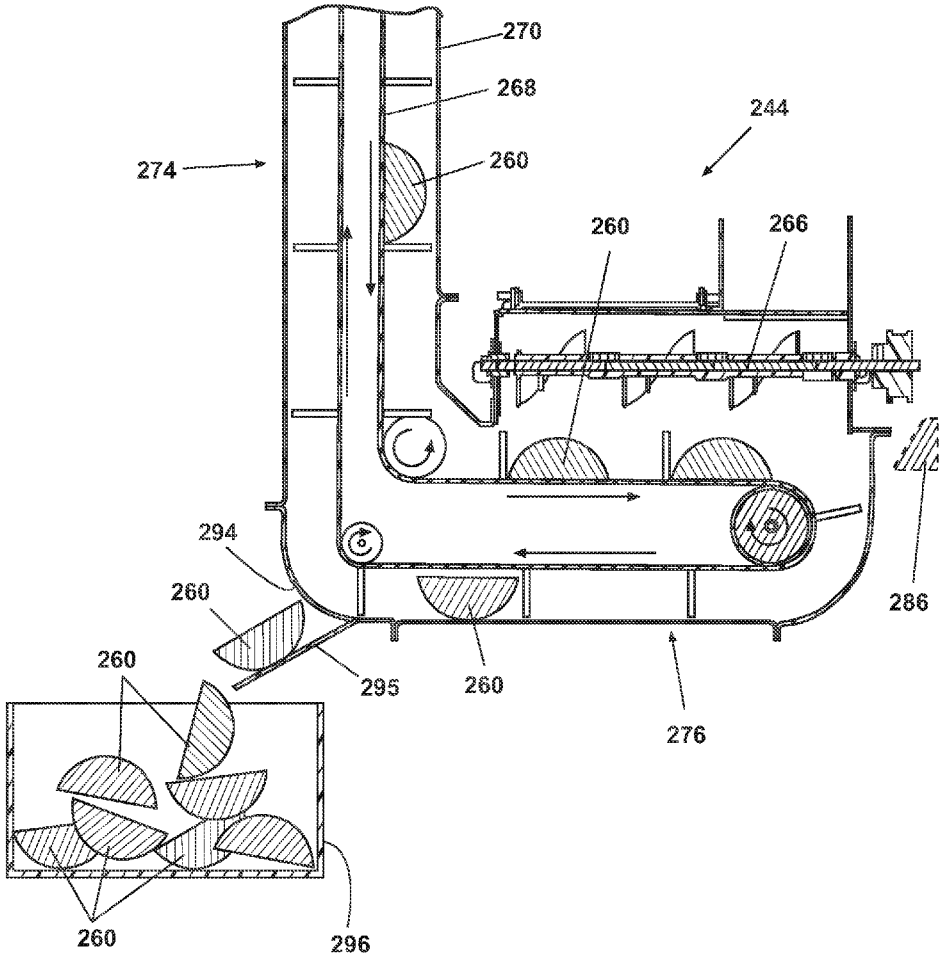
FIG. 12I is a sectional view similar to FIG. 12D illustrating an alternate dispensing arrangement.

An upper ice stripper 284 can comprise a plurality of triangular or wedge-shaped plates 288 fixed in a parallel, spaced-apart relationship co-linearly with the longitudinal axis of the belt 268. The spacing 290 of the plates 288 can be adapted to the width of the cleat fingers 280 to enable cleat fingers 280 to pass through the spaces 290 between adjacent plates 288. The angular or inclined edge of the plates 288 can be oriented against the movement of the belt 268 so that, when a cleat 278 carrying an ice cube 260 passes through the stripper 284, the plates 288 can strip an ice cube 260 laterally off the cleat 278 (FIG. 12G). An upper housing opening 292 can be provided in an upper portion of the vertical section 274 of the belt housing 270 for movement of the ice cubes 260 from the belt 268 to an ice and water dispenser 72. Thus, as illustrated in FIG. 12G, as the lifting cleats 278 move downwardly through the upper ice stripper 284 ice cubes can be removed through upper housing 292 to an ice and water dispenser 72. As illustrated in FIG. 12H, the upper ice stripper 284 can be oriented to remove ice cubes from the lifting cleats 278 through upper housing opening 292' as the lifting cleats 278 move upwardly through the upper ice stripper 284. The choice of selecting a discharge arrangement as illustrated in FIGS. 12G or 12H can depend on the orientation of upper portion 274 and the arrangement of the inlet to the ice and water dispenser 72.

A lower stripper 286, similar in operational respects to the upper stripper 284, can be located adjacent the end of the horizontal section 276, as illustrated in FIG. 12D. The lower stripper 286 can remove ice cubes 260 from the horizontal section 276 when the belt 268 is operated in a reverse direction. At the end of a dispensing operation belt 268 can be operated in a reverse direction to remove ice cubes 260 remaining on conveyor belt 268 in refrigerator compartment 54 when the dispensing operation is completed. Ice cubes 260 removed from belt 268 by lower stripper 286 can accumulate in the space between belt 268 and dispensing auger 266. Those skilled in the art will understand that the space between belt 268 and dispensing auger 266 can be arranged to provide sufficient storage volume for ice cubes 260 remaining on belt 268 at the end of a dispensing operation. Lower stripper 286 can be movably positioned in belt housing 270 to allow movement out of horizontal section 276 (shown in dashed lines in FIG. 12I) and a lower housing opening 294 can be provided in the bottom of the housing enclosing the horizontal section 276 for ice cubes 260 to exit the vertical belt ice lifter 240 to a bulk storage container 296. Thus, to facilitate bulk removal of ice cubes from ice cube storage bin 248, lower stripper 286 can be withdrawn, a closure 295 for lower housing opening 294 can be opened and conveyor belt 268 operated in reverse to dispense ice cubes 260 into a bulk container 296, FIG. 12I. Those skilled in the art will understand that movement of lower stripper 286, opening of closure 295 and operation of conveyor belt 268 in the reverse direction can be accomplished by actuators, not shown, under control of a suitable controller, not shown, that can have a Bulk Dispensing option or setting. In this case closure 295 can be released when conveyor belt 268 is operated in reverse allowing closure 295 to open, or closure 295 can be resiliently biased closed and the presence of an ice cube 260 on closure 295 can be sufficient to cause closure 295 to open discharging the ice cube, see FIG. 12I.

In an alternative embodiment, not shown, the horizontal section 276 can be eliminated and an ice cube transporting device, such as a well-known auger, a separate conveyor belt, or a gravity-based device, can be used to transfer the ice cubes 260 from the ice maker 246 to the vertical section 274.

The belt housing 270 can be insulated and appropriately sealed to prevent the movement of chilled air from the freezer compartment 56 and the vertical belt ice lifter 240 to the refrigerated compartment 54. The belt housing 270 can alternately be installed in insulated side wall 60 of the cabinet 52. The upper housing opening 292 can cooperatively communicate with an inlet opening (not shown) in the ice and water dispenser 72 or a storage container when the door 68 is closed similar to the embodiment illustrated in FIGS. 6 and 7. An appropriate gasket assembly can seal the opening 292 to the inlet to eliminate the flow of chilled air from the vertical belt ice lifter 240 to the refrigerated compartment 54. Ice and water dispenser 72 can include a dispenser outlet as is well known in the art. Also, dispenser 72 could be positioned on a countertop, not shown, and used in conjunction with an undercounter ice maker as described below.

Figure 13A:
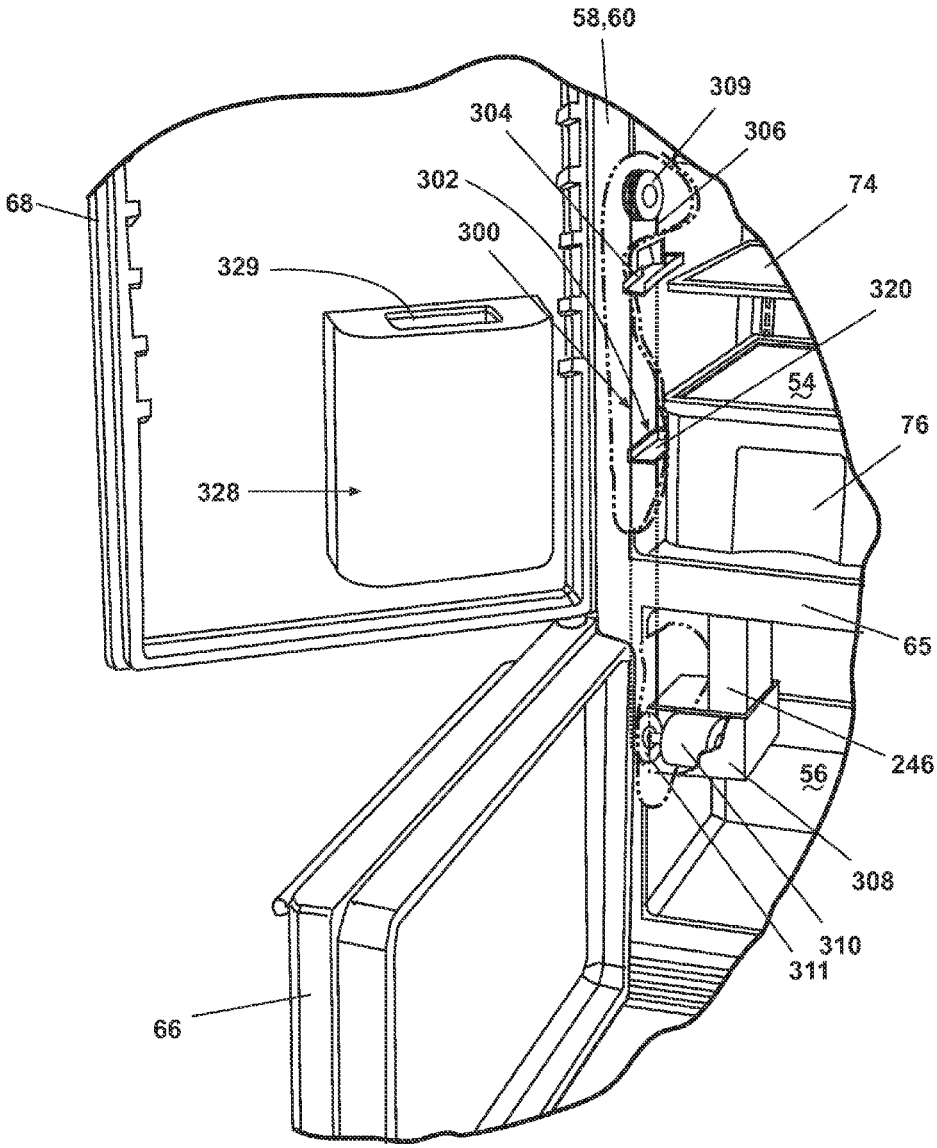
FIG. 13A is a partial perspective view of a bottom-mount refrigerator illustrating an elevator lifting apparatus for lifting ice cubes from a freezer-mounted ice cube forming apparatus to a refrigerator-mounted dispenser.

Another lifting mechanism in the form of an elevating platform ice lifter 300 is illustrated in FIGS. 13A and B for lifting ice cubes from the freezer compartment 56 to an dispensing module 328 in operable communication with a dispenser 72 that can be positioned on a refrigerator compartment door or on a countertop. An ice cube storage bin can be included in module 328 and can be provided with an ice crushing feature as described in the Pastryk et al patent as described above. Those skilled in the art will understand that the dispenser 72 can be arranged to deliver whole ice cubes, or can be arranged to selectively deliver whole or crushed ice cubes and/or water in response to activation of a selection control device (not shown) incorporated into the dispenser 72. If an ice cube storage bin is included in module 328 suitable cooling arrangements can be included to maintain the ice cube storage bin below 0° C. Examples of a cooling arrangement for an ice storage bin on a refrigerator compartment door are described in U.S. patent application Ser. No. 10/973,543, now U.S. Pat. No. 7,188,479, filed by Anselmino et al as described above. Elevating platform ice lifter 300 will be described in conjunction with a bottom freezer refrigerator, but could be used with an undercounter ice maker as described below. The elevating platform ice lifter 300 can comprise an elevating platform assembly 302 comprising a lifting platform 320 which can be incorporated in an elevator housing 326 that can be located adjacent to or in side wall 60. The elevator housing 326 can be similar to the conveyor housing in the embodiment of FIGS. 12A-12I. The embodiment illustrated in FIG. 13A elevating platform lifter 300 can comprise a continuous lifting cable 306 traveling around an upper pulley 309 and a lower pulley 311 and can be driven by a drive motor 310. The cable 306 can extend along the inside of the elevator housing 326 from the freezer compartment 56 to the refrigerated compartment 54. Lifting platform 320 can be attached to the cable 306 in order to raise and lower the lifting platform 320 as the cable 306 travels around the pulleys 309, 311. Other motor-driven lifting mechanisms can be utilized to accomplish the raising and lowering of a platform 320, for example a pole having a tracked portion along which a drive pinion can run to raise and lower the platform 320, a pair of lifting tracks mounted within the elevator housing and a pair of motor-driven pinions traveling along the tracks to raise and lower the platform 320, and the like. While one lifting platform is shown in the embodiment of FIGS. 13A and B, those skilled in the art will understand that more than one platform can be provided if desired.

Figure 13B:
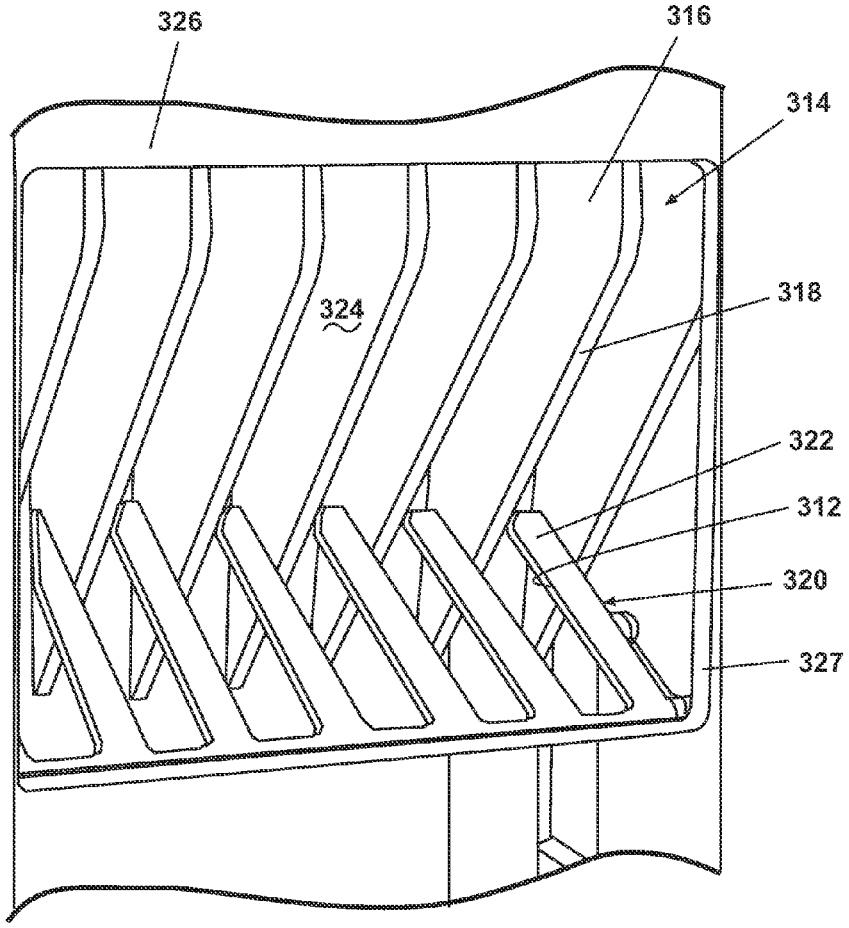
FIG. 13B is an enlarged view of an ice cube remover for removing ice cubes from the elevator lifting apparatus.

Ice cubes can be deposited onto the platform 320 from the ice maker 246 using a well-known delivery mechanism, for example by depositing the ice cubes directly from the ice maker onto the platform 320, delivering ice cubes to the platform 320 from a storage container 308 utilizing a conveyor belt or auger, gravity feed of ice cubes from the storage container 308, and the like. Ice cubes can be removed from the platform 320 to an inlet 329 in the module 328 by utilizing a slotted platform and stripper 314, illustrated in FIG. 13B, similar to the stripper 284 described with respect to FIGS. 12F-H. The platform 320 can be divided into fingers 322 separated by platform slots 312. Stripper 314 can be located adjacent dispensing module inlet 329 and can comprise a plurality of triangular or wedge-shaped plates 316 fixed in a parallel, spaced-apart relationship co-linearly with the longitudinal axis of the elevating platform assembly 302. Stripper 314 can be located partially in opening 327 in elevator housing 326. Each wedge plate can have an inclined face 318. The spacing 324 of the plates 316 can be adapted to the width of the platform fingers 322 to enable a platform fingers 322 to pass through the spaces 324 between adjacent plates 316. The platform slots 312 can be adapted for the passage of the stripper plates 316 therethrough. The angular or inclined edge 318 of the plates 316 can be oriented against the movement of the platform 320 so that, when an ice cube passes through the stripper 314, the plates 316 will urge the ice cube 260 laterally off the platform 320, though opening 327 and into the inlet 329. Alternately, stripper 314 can be eliminated if platform fingers 322 are inclined to allow ice cubes to fall or slide out of opening 327 into inlet 329. A chute 304 can be provided to carry ice cubes from opening 327 to dispenser inlet 329.

Elevating platform ice lifter 300 can be enclosed within a suitable insulated enclosure 326 (illustrated in outlined form in FIG. 13A) in the refrigerated compartment 54. This can comprise an enclosure 326 that can be mounted to side wall 60 extending into the refrigerated compartment 54 and freezer compartment 56, or the lifter 300 can be installed in side wall 60 within the side wall insulation. Suitable flaps or doors can be provided to seal an ice cube discharge outlet 327 from the lifter 300 and the inlet 329 to prevent the flow of chilled air from the lifter 300 into the refrigerated compartment 54. Those skilled in the art will understand that chute 304 can be open as illustrated in FIG. 13A or, if desired, can be an enclosed chute enclosing opening 327 in elevator housing 326. Chute 304 can be enclosed and can be arranged to provide a substantially continuous passage from opening 327 to dispenser inlet 329 when door 68 is closed. The substantially continuous passage can be used to convey below 0° C. air from freezer compartment 56 to module 328 if an ice cube storage bin is incorporated in module 328. A fan (not shown) can be provided in freezer compartment 56 to move below 0° C. air though lifter 300 to module 328. Those skilled in the art will understand that motor 310 can be provided with suitable controls arranged to drive platform 320 from a position adjacent ice maker 246 where ice cubes can be loaded on platform 320 to opening 327 where ice cubes can be stripped off platform 320 into dispenser inlet 329.

An alternate embodiment of an ice cube lifter is illustrated in FIGS. 14A-F comprising an auger ice lifter 330. As illustrated in FIGS. 14A-F, the auger ice lifter 330 can comprise a vertical auger assembly 332 and a horizontal auger assembly 334. The vertical auger assembly 332 can extend from the freezer compartment 56 into the refrigerated compartment 54 and can be adapted to transport ice cubes from the ice maker 246 to a dispenser 72. The vertical auger assembly 332 can comprise an auger 346 adapted for ice cube transport that can be driven by a suitable vertical drive motor 336. Auger 346 can be enclosed within a closely-fitting auger housing 342 to provide sufficient clearance between the auger 346 and the housing 342 to enable the auger 346 to rotate within the housing 342 but prevent ice cubes from moving between the auger 346 and the housing 342. Horizontal auger assembly 334 can comprise an auger 348 adapted for ice cube transport driven by a horizontal drive motor 338, and can be adapted for ice cube transport from the ice maker 246 to the vertical auger assembly 332. Auger 348 can be enclosed within a closely fitting auger housing 344 outside ice cube storage bin 248 to provide sufficient clearance between the auger 348 and the housing 344 to enable the auger 348 to rotate within the housing 344 but prevent ice cubes from moving between the auger 348 and the housing 344. Those skilled in the art will understand that housing 344 need not extend into ice cube storage bin 248. Horizontal auger 348 can operate openly in ice cube storage bin 248 to move ice cubes toward vertical auger 332. Horizontal auger assembly 334 can be replaced with an alternate ice cube transport assembly, for example an open auger as illustrated in U.S. Pat. No. 4,084,725 to Buchser and U.S. Pat. No. 4,942,979 to Lindstromberg et al. incorporated by reference above, a conveyor belt assembly, an inclined chute extending from the ice maker 246 to the vertical auger assembly 332 for gravity feed, and the like.

Figure 14A:
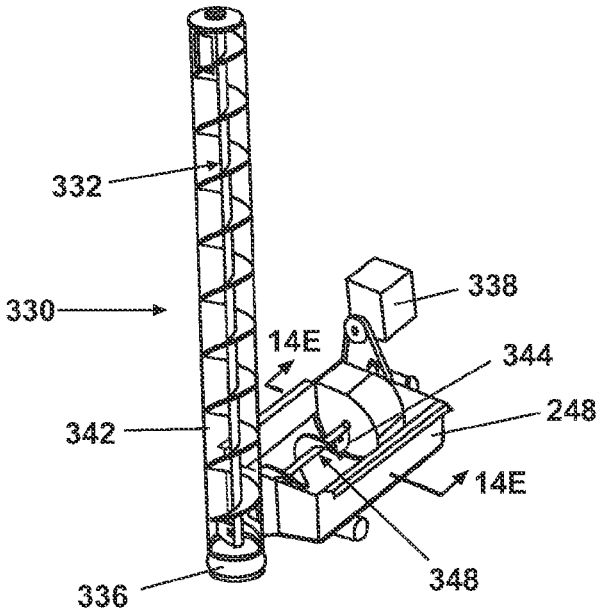
FIG. 14A is a first perspective view of an auger lifting apparatus for lifting ice cubes from a freezer-mounted ice cube forming apparatus to a refrigerator-mounted dispenser.
Figure 14B:
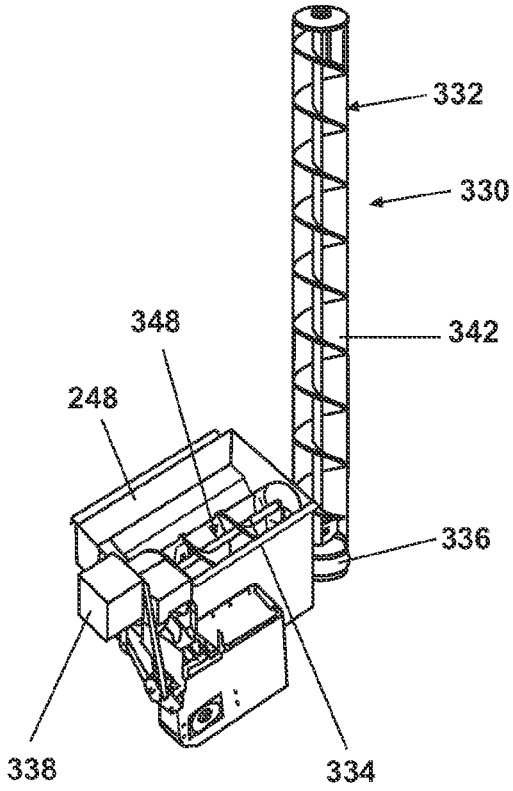
FIG. 14B is a second perspective view of the lifting apparatus illustrated in FIG. 14A.
Figure 14C:
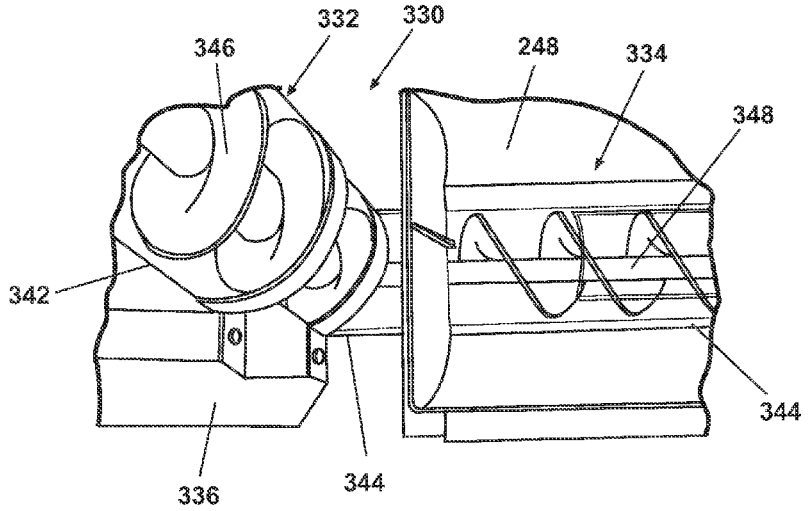
FIG. 14C is an enlarged perspective view of a portion of the lifting apparatus illustrated in FIG. 14A illustrating a vertical auger in cooperative register with a horizontal auger.
Figure 14D:
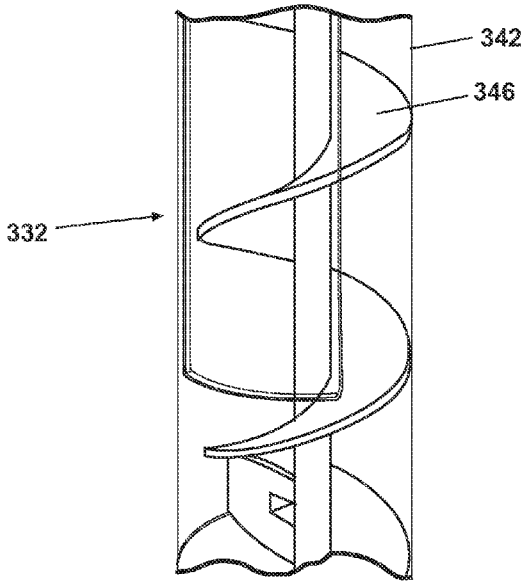
FIG. 14D is an enlarged perspective view of a portion of the vertical auger illustrated in FIGS. 14A-C.
Figure 14E:
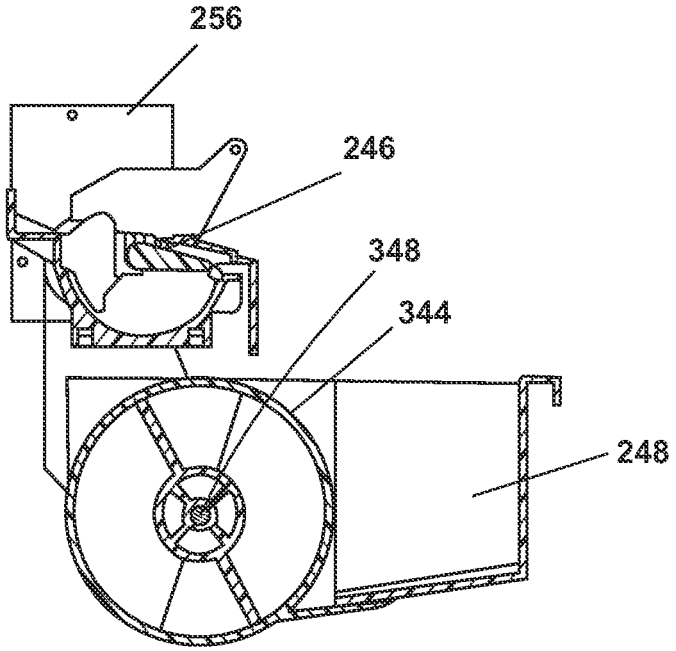
FIG. 14E is a sectional view taken along line 14E-14E of FIG. 14A.
Figure 14F:
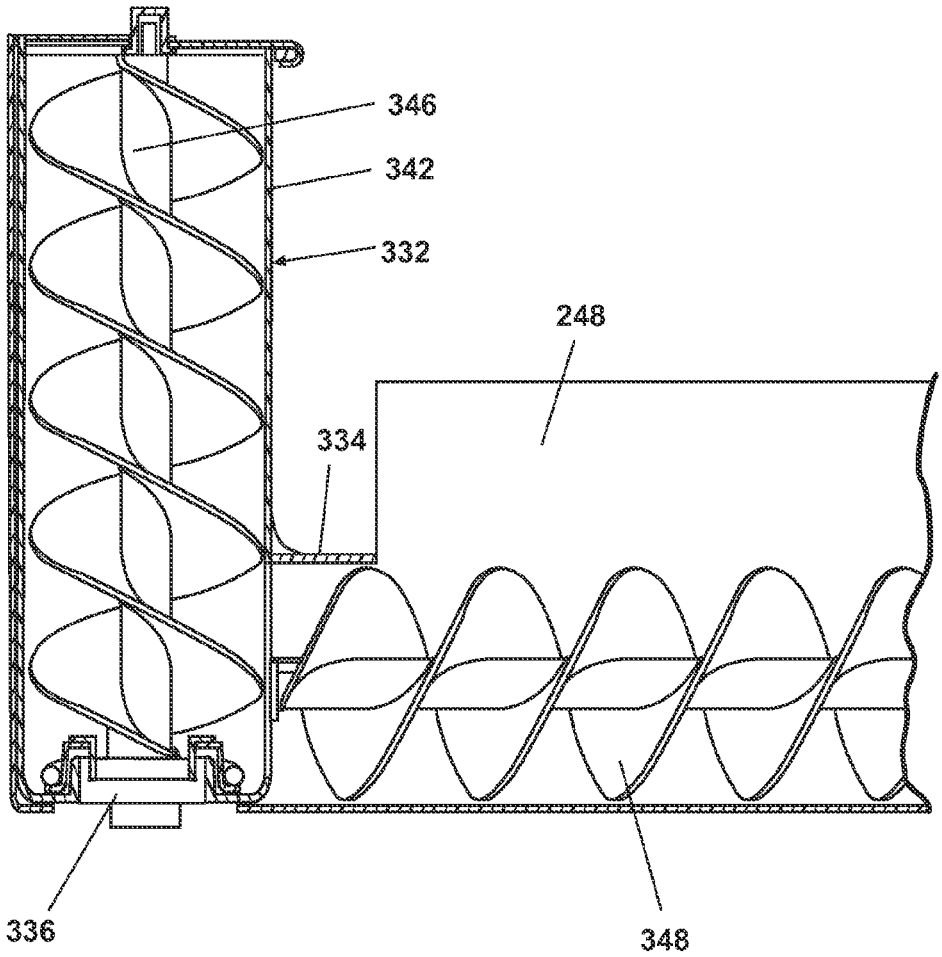
FIG. 14F is a plan view of a portion of the lifting apparatus illustrated in FIG. 14A illustrating the vertical auger and the horizontal auger with an auger enclosure partially removed for clarity.
Figure 15:
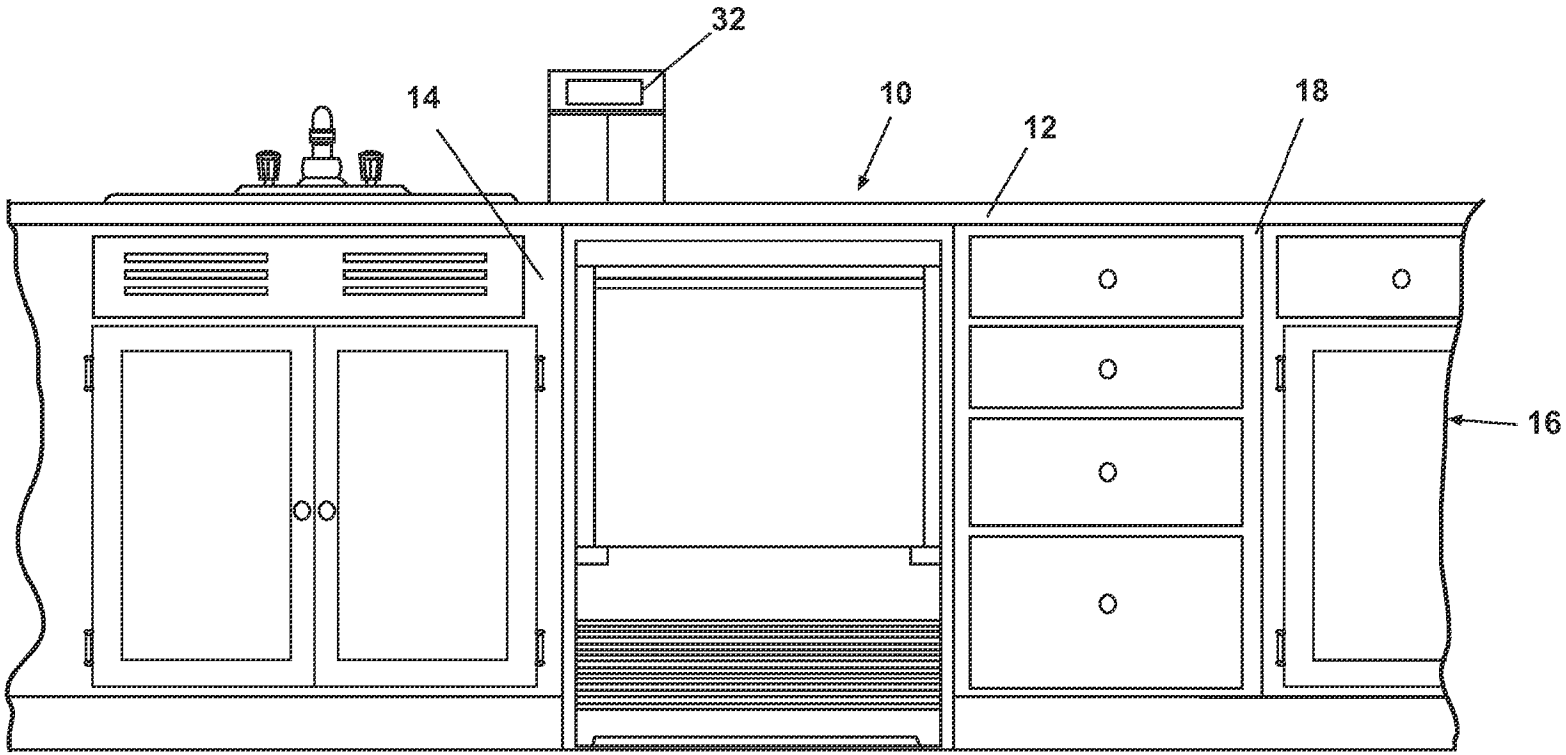
FIG. 15 is an illustration of one embodiment of an undercounter ice maker having a countertop ice dispenser and ice cube lifter apparatus according to the invention.
Figure 16:
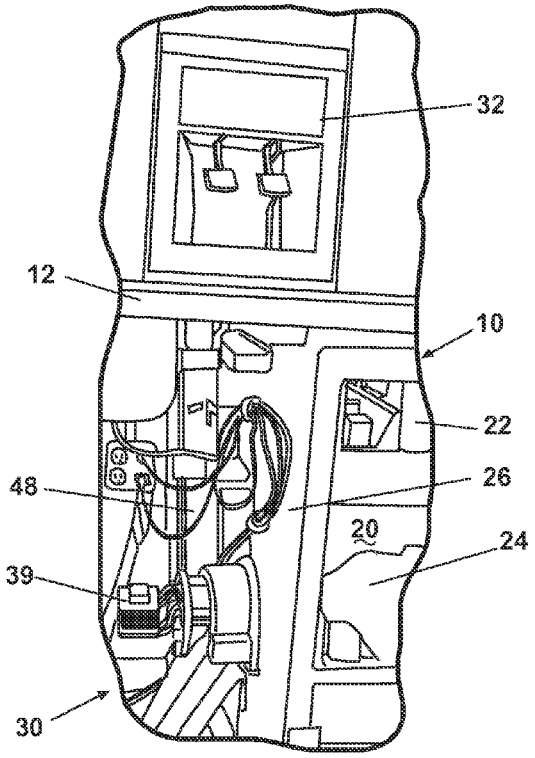
FIG. 16 is a partial perspective view of an embodiment of the undercounter ice maker and countertop ice dispenser of FIG. 15 illustrating the countertop ice dispenser, part of the interior of the ice maker and a portion of the ice lifter apparatus.
Figure 17:
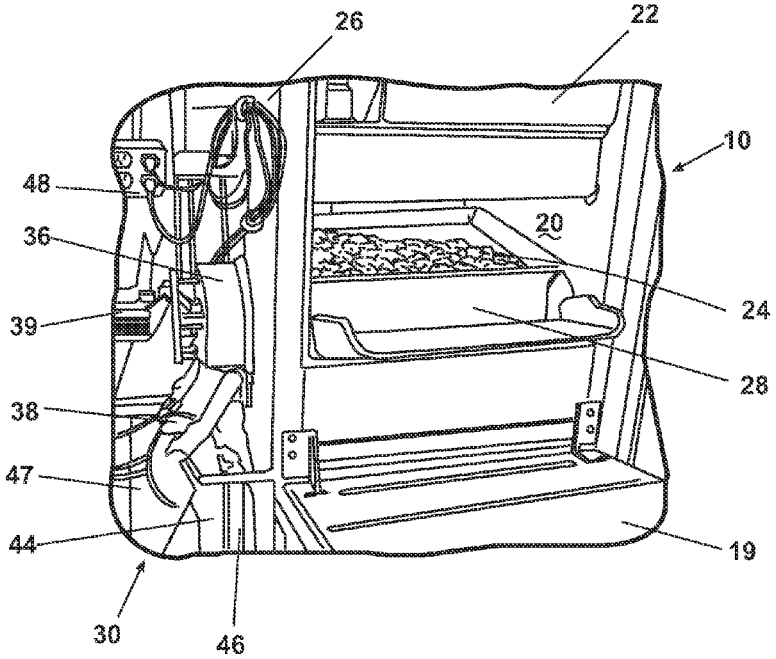
FIG. 17 is a partial perspective view of the undercounter ice maker and countertop ice dispenser of FIG. 16 illustrating the ice cube storage bin and dispenser and a portion of the ice lifter apparatus.
Figure 18:
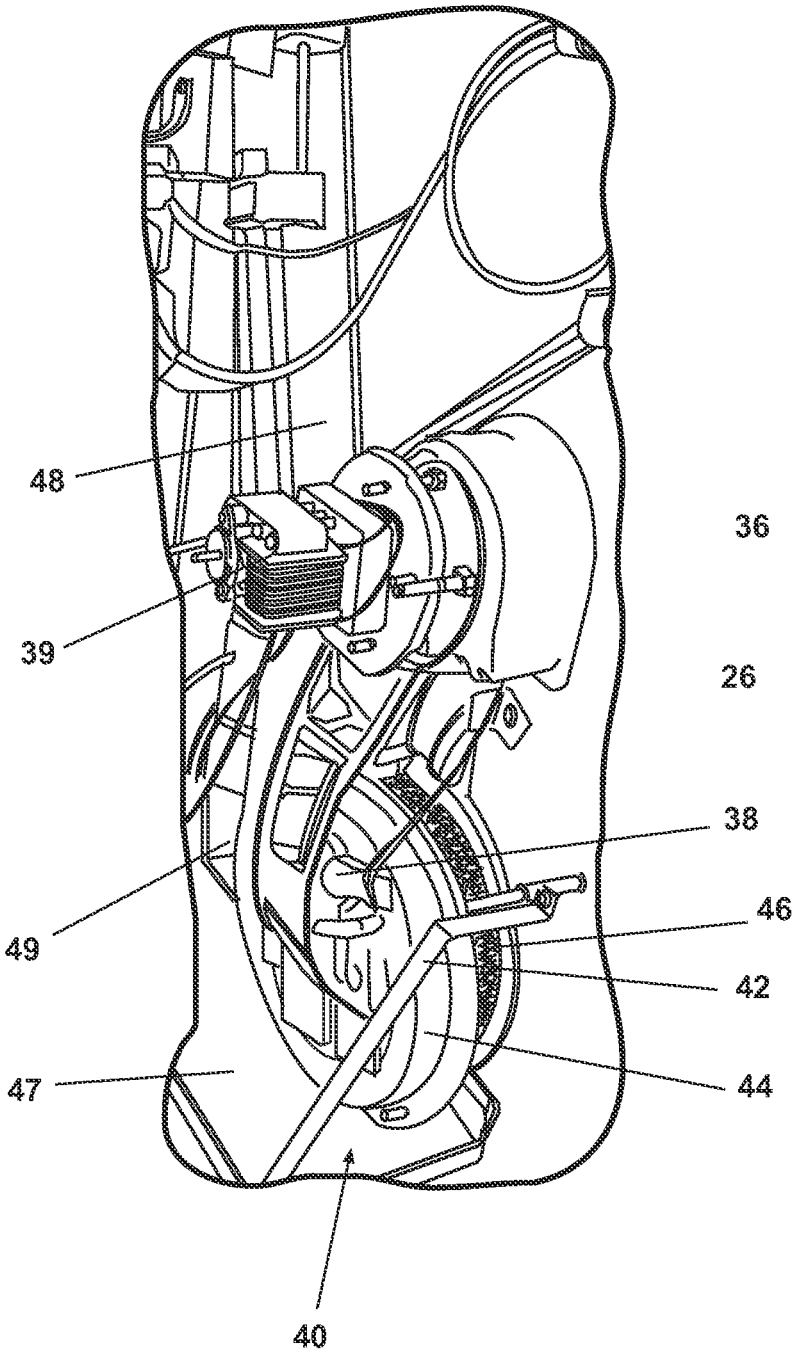
FIG. 18 is a partial perspective view of the undercounter ice maker and countertop ice dispenser of FIG. 16 illustrating the ice dispensing and ice lifter apparatus positioned under the countertop.
Figure 19:
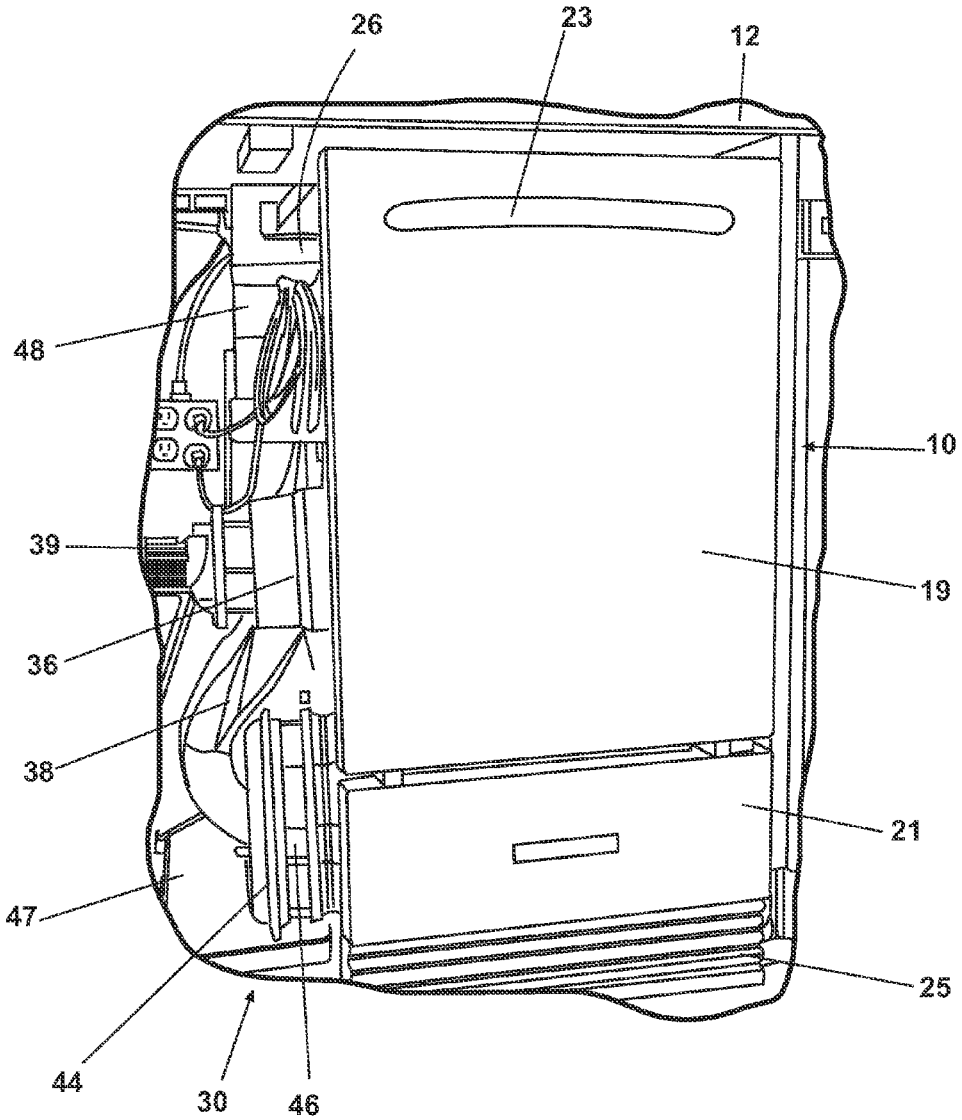
FIG. 19 is a partial perspective view of the undercounter ice maker of FIG. 16 illustrating the ice maker with the door closed.

As illustrated in FIGS. 14A-E, the auger ice lifter 330 can be operably connected to an ice storage and delivery assembly similar to that previously described herein, and can comprise an ice maker 246, and an ice cube storage bin 248. The lifter 330 can receive ice cubes from the ice cube storage bin 248 and deliver the ice cubes to a dispenser 72. As illustrated in FIG. 14E, ice from the ice cube storage bin 248 can contact horizontal auger 348 that can be positioned in a semi-circular trough in the bottom of ice cube storage bin 248. Operation of the horizontal auger assembly 334 can transport ice cubes toward the vertical auger assembly 332. As illustrated in FIG. 14F, the horizontal auger assembly 334 can be operably connected to the vertical auger assembly 332 so that ice cubes traveling to the end of the horizontal auger assembly 334 are transferred to the vertical auger assembly 332. Alternatively, vertical auger assembly 332 can be positioned directly in ice cube storage bin 248. The vertical auger assembly 332 can be adapted, such as with an opening in the auger housing 342, to take ice cubes from ice cube storage bin 248 and transport them vertically upwardly to an ice cube dispenser 72. Ice dispenser 72 can be part of a bottom freezer refrigerator or an undercounter ice maker and positioned on a countertop adjacent the undercounter ice maker. Horizontal auger assembly 334 can be replaced with an alternate ice cube transport assembly, for example a conveyor belt assembly, an inclined chute extending from the ice maker 246 to the vertical auger assembly 332 for gravity feed, and the like.

Vertical auger housing 344 can comprise a suitably insulated enclosure in the refrigerator compartment 54 to maintain a temperature differential between the auger ice lifter 330 and the refrigerated compartment 54, and to prevent the flow of chilled air to the refrigerated compartment 54. Alternatively, the vertical auger assembly 332 can be enclosed within side wall 60 surrounded by insulation, to maintain a sufficiently cold temperature in the vertical auger assembly 332. Flaps or doors cover an ice cube discharge outlet (not shown) from the lifter 330 to prevent the flow of chilled air from the lifter 330 into the refrigerated compartment 54.

In order to avoid melting of ice cubes in the vertical auger assembly 332 extending through the refrigerator cabinet 54, the vertical auger 346 can be reversed after dispensing has been completed to bring ice cubes remaining in the vertical auger assembly 332 back to the freezer compartment 56 by reversing the movement of the vertical auger 346 and the horizontal auger 348 until all ice cubes 260 have been removed from the refrigerated compartment 54.

Referring now to FIGS. 15 to 19, an embodiment of an undercounter ice maker 10, incorporating an ice dispensing apparatus similar to the ice making and dispensing apparatus in FIGS. 9A and B, is illustrated mounted beneath a countertop 12 with conventional kitchen cabinetry 14, 16. Undercounter ice maker 10 can comprise a well-known ice maker such as disclosed in U.S. Pat. Nos. 4,009,595; 6,484,529 and 6,539,742 fully incorporated herein by reference. Alternately, undercounter ice maker 10 can be an undercounter freezer having an ice maker and storage bin in the freezer compartment. Ice maker 10 can include an insulated cabinet 18 defining a ice maker compartment 20 suitable for maintaining a temperature appropriate for forming and storing ice cubes. The temperature in the compartment 20 can be maintained in a well-known manner through the use of a cooling system comprising a motor-driven compressor and evaporator containing a suitable coolant, a ventilation fan, appropriate thermostatic controls, and the like. The freezer compartment 20 can contain an ice making apparatus 22 adapted for continuously making ice cubes 24. Ice making apparatus 22 can be connected to a suitable water supply (not shown) having appropriate flow controls and a drain (not shown) for draining water not used in ice cube formation or from melting ice cubes as is well known. Insulated cabinet 18 can have a side wall 26 that can support ice dispensing apparatus 30 operably connected to ice maker 10 and arranged to elevate ice cubes to dispenser 32 that can be located on countertop 12 for easy access to ice cubes and chilled water.

Ice maker 10 can have a door 19 that can be pivotally mounted to the front of ice maker 10. In the embodiment of FIGS. 15 to 19 door 19 can be arranged to pivot on a horizontal axis to the open position illustrated in FIG. 17. Those skilled in the art will understand that door 19 can be pivotally mounted on a vertical axis if desired. An access panel 21 can be provided below door 19 to afford access to ice maker components under compartment 20. A louvered toe plate 25 can be provided at the bottom of ice maker 10 to provide air flow to refrigeration equipment for ice maker 22. Door 19 can have a suitable handle 23. In addition to providing dispensing of ice cubes 24 on countertop 12, ice cubes can be accessed in bulk by opening door 19 for direct access to ice cube storage bin 28.

Ice maker 22 can be arranged to drop the ice cubes 24 into an ice cube storage bin 28 for delivery to a dispenser apparatus 30. Ice cube storage bin 28 can incorporate a mover, not shown, that can be similar to auger 180 in ice cube storage bin 178 illustrated in FIG. 9B. The mover, not shown, in ice cube storage bin 28 can be arranged to advance ice cubes into discharge collar 36 that can be positioned on side wall 26 through suitable openings in compartment 20 and side wall 26. Those skilled in the art will understand that discharge collar 36 can include a generally cylindrical wall, not shown, extending through side wall 26 and into ice cube storage bin 28 to form a passage for ice cubes and the auger, not shown. Alternately, ice cube storage bin 28 can be arranged for gravity feed of ice cubes to discharge collar 36 for delivery to curved conduit 38. Curved conduit 38 can operatively connect a discharge opening, not shown, in discharge collar 36 with an inlet 42 in accelerator cover 44 for rotating accelerator 40. Accelerator 40 can include an accelerator housing 46 enclosing an accelerator wheel, not shown. Accelerator 40 can be similar to and function like the accelerator shown and described in conjunction with FIGS. 8 to 11. A conduit 48 can extend from accelerator housing 46 to dispenser 32 on countertop 12. Conduit 48 can have a return curve at its top end like the upper conduit 188 that can extend into dispenser 32 as in the embodiment of FIGS. 8 to 11. Accelerator 40 can be arranged, as previously described with respect to the embodiment illustrated in FIGS. 8 to 11, to receive ice cubes 24 from the storage container 28, and propel the ice cubes 24 through conduit 48 to dispenser 32. Accelerator 40 can include an accelerator wheel, not shown, that can be similar to the accelerator wheel 186 in the embodiment of FIGS. 8-11. Accelerator 40 can also include a motor, not shown, that can be integral with accelerator 40, or can be located under compartment 20 in ice maker 10. The operation of accelerator 40 can be similar to accelerator 173 as described above in conjunction with FIGS. 8-11.

As in the embodiment of FIGS. 8 to 11, accelerator 40 can be arranged to propel ice cubes 24 with sufficient velocity to carry the ice cubes over the top of conduit 48, not shown, and into dispenser 32. A return conduit 49 can extend downwardly from the conduit 48 to a drain pan 47 that can be connected to the ice maker drain, not shown. Conduit 48 can extend upwardly and an angle to vertical from the accelerator 40. A return conduit 49 can extend downward from a return duct inlet (not shown) on the underside or bottom wall of conduit 48 to drain pan 47. Thus, ice cubes 24 in the conduit 48 that are not dispensed through the dispenser 32 when accelerator 40 stops can slide down conduit 48 to return conduit 49 and then fall into the drain pan 47. Ice cubes falling into drain pan 47 can melt and flow to the undercounter ice maker drain, not shown. Those skilled in the art will understand that return conduit 49 can be eliminated and ice cubes not dispensed when accelerator stops can fall back into the accelerator 40 or back into the ice cube storage bin 28.

The upper portion of the conduit 48 and dispenser 32 can be at room temperature. Ice dispenser 32 can include a pivotally mounted door (not shown) to close the outlet of conduit 48 when the dispenser is not activated that can be similar to doors for closing the outlet of a through the door ice dispenser are well known in the art. One example of such a door can be seen in U.S. Pat. No. 4,942,979 to Lindstromberg et al referred to above. Thus, the dispenser outlet 32 and conduit 48 can be effectively sealed from compartment 20 in cabinet 18 by a door, accelerator 40 and discharge collar 36 to prevent the loss of chilled air from the compartment 20. A water supply (not shown) can be integrated into the dispenser 32 to selectively provide ice cubes, water, or a combination of both to a user utilizing well-known water delivery devices. A tank, not shown, can be included in compartment 20 to store a quantity of water for the water dispenser. The tank can be chilled by the near freezing temperatures normally existing in compartment 20 to facilitate ice cube storage in ice cube bin 28. Those skilled in the art will understand that ice cube bin 28 can include a suitable drain connection, not shown, on the bottom wall of bin 28 to carry water from melting ice cubes to drain, not shown. While the ice cube lifter described in conjunction with the undercounter ice maker above is an accelerator lifter, those skilled in the art will understand that any of the embodiments of ice cube lifter according to the invention can be used with an undercounter ice maker as well as a bottom freezer refrigerator.

There are three basic configurations of refrigerator freezers for consumers to choose from, a bottom freezer configuration, a top freezer configuration and a side by side configuration. For consumers that desire to have an ice and water dispenser on the exterior of their refrigerator freezer the choice is essentially reduced to the side by side configuration. Bottom Freezer refrigerators are desirable for the easy access to the refrigerator compartment. Thus, many consumers are torn between the easy refrigerator compartment access bottom freezer refrigerators offer and the availability of ice and water dispensing in the side by side configuration. Most refrigerator freezers having ice dispensers are configured with the ice cube storage bin positioned below the ice maker in the freezer compartment and the ice dispenser positioned on the freezer compartment door below the ice cube storage bin. This arrangement is not practical for bottom freezer refrigerators since the ice dispenser would be at the very bottom of the freezer compartment door adjacent to the floor.

Figure 20:
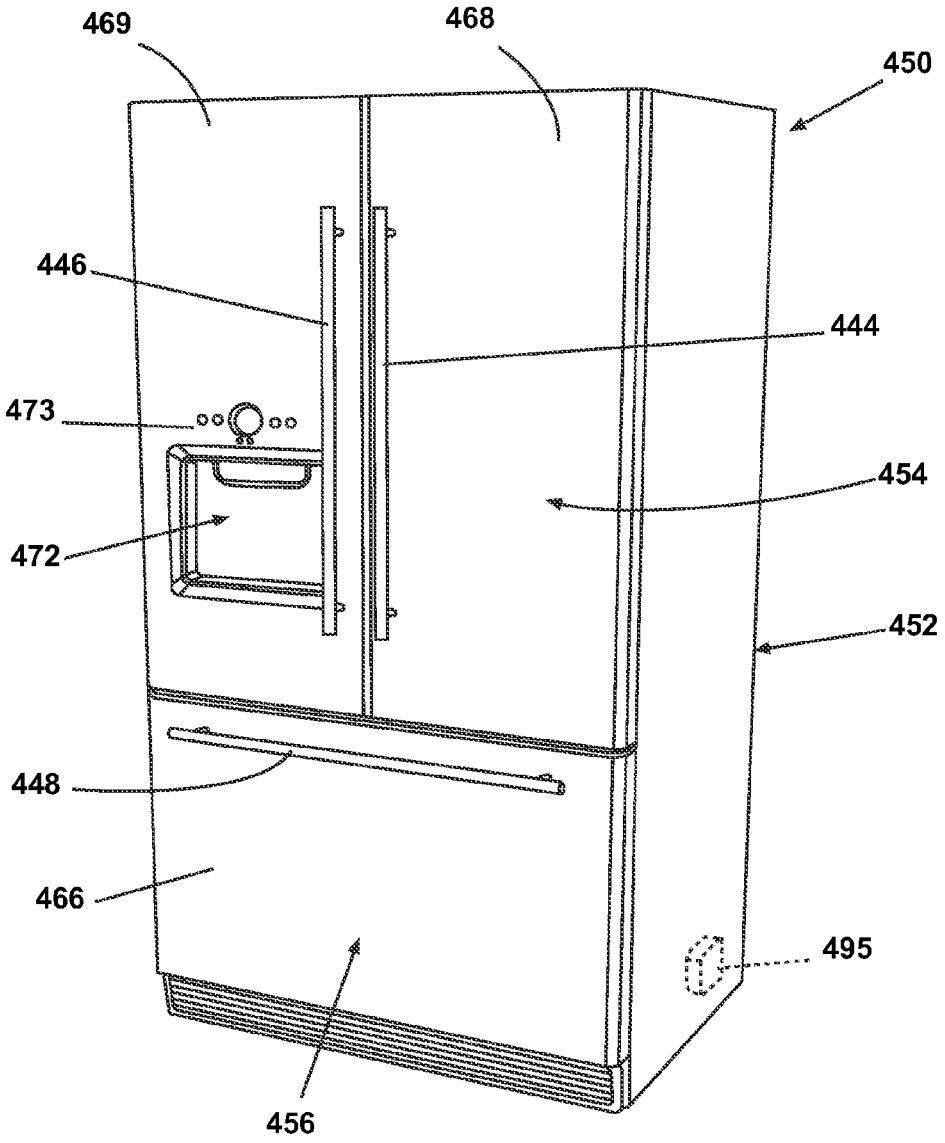
FIG. 20 is a perspective view of a bottom freezer refrigerator having an ice maker and ice and water dispenser according to the present invention positioned on a refrigerator compartment door.
Figure 21:
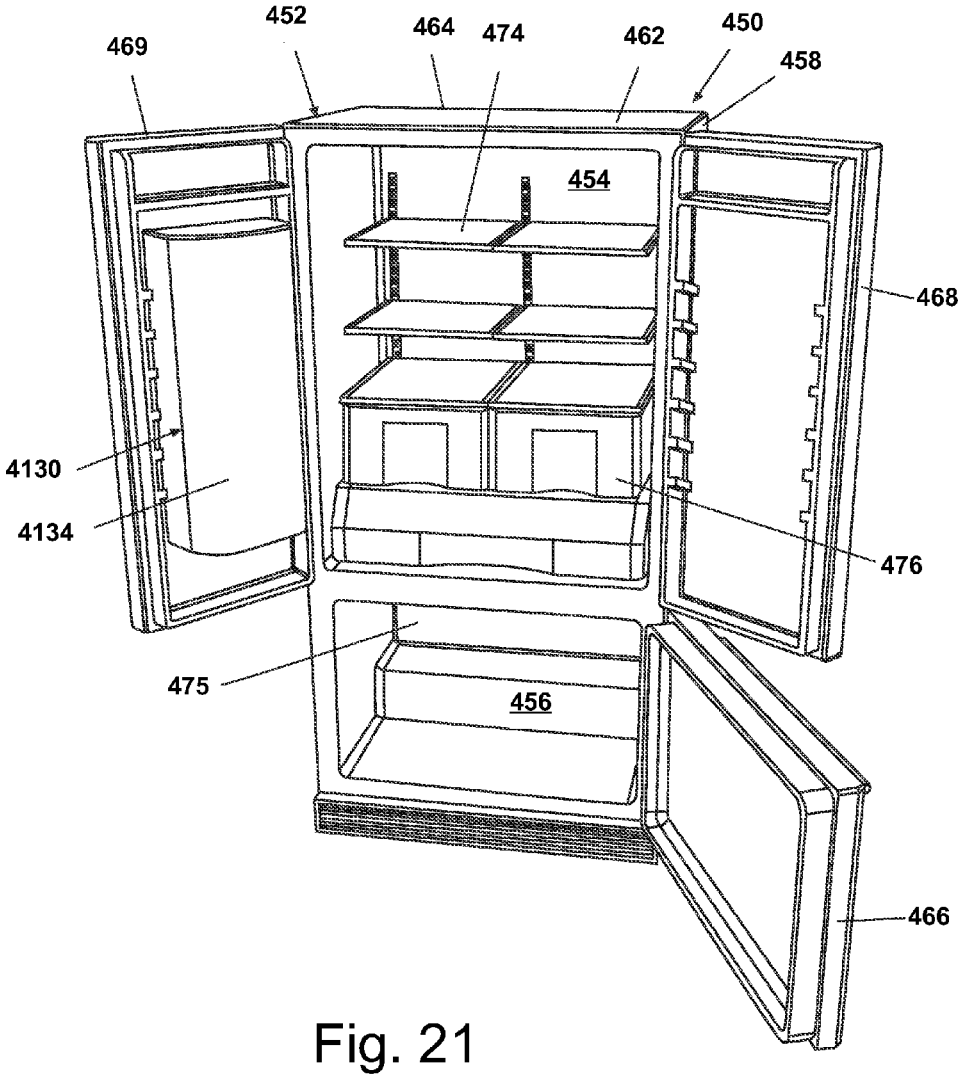
FIG. 21 is a perspective view of the bottom freezer refrigerator shown in FIG. 20 with the refrigerator compartment and freezer compartment doors open.

According to the present invention, the ice maker, ice cube storage bin and ice dispenser can be positioned on a refrigerator compartment door. Turning to FIG. 20 and FIG. 21, a bottom freezer refrigerator having an ice maker and dispenser apparatus according to the invention can be seen. Bottom freezer refrigerator 450 can have a cabinet 452 including a refrigerator compartment 454 maintained at above 0° C. temperatures and a freezer compartment 456 maintained at below 0° C. temperatures. Freezer compartment 456 is positioned in the bottom of cabinet 452 and refrigerator compartment 454 is positioned above freezer compartment 456. In the embodiment of FIG. 20 and FIG. 21, bottom freezer refrigerator 450 can have two refrigerator compartment doors 468 and 469 arranged side by side. The bottom freezer refrigerator 450 configuration shown in FIG. 20 and FIG. 21 is sometimes referred to as a French door bottom mount refrigerator Freezer. Conventional door handles 444, 446 and 448 are shown on refrigerator compartment doors 468 and 469 and freezer compartment door 466. Those skilled in the art will readily understand that different handles, or no handles, can be provided for the doors as is well known in the art. Refrigerator compartment 454 can include a plurality of shelves 474 that can be fixed or can be adjustable as shown in FIG. 21. One or more bins 476 can be provided in refrigerator compartment 454 for storing food items such as meats, vegetables, fruit and other food items that can benefit from storage in a closed receptacle that can be temperature and/or humidity controlled as is well known in the art. Likewise, one or more shelves or baskets (not shown) can be provided in freezer compartment 456, again as well known in the art.

Refrigerator 450 can have a refrigeration system (not shown) for cooling the refrigerator compartment 454 and freezer compartment 456. The refrigeration system can include a compressor, condenser, evaporator, evaporator fan and expansion device, all not shown, as is well known in the art. The compressor can be a variable speed compressor to provide cooling rates, again well known in the art. Refrigerator 450 can also have a control system (not shown) that can include temperature sensors (not shown) for the refrigerator compartment 454 and freezer compartment 456 connected to refrigerator and freezer compartment temperature controllers (not shown) to maintain the temperatures in the respective compartments at user selected temperatures. The evaporator (not shown) can be positioned in an evaporator compartment 475 that can be positioned along the back wall of the freezer compartment as is well known in the art. Refrigerator 450 can also have one or more water valves 495 positioned in the machinery compartment for supplying the ice maker and a water dispenser as is well known in the art. While water valve 495 is illustrated in the machinery compartment as a single valve those skill in the art will understand that more than one valve may be included and may be positioned in other locations in refrigerator 450 as desired. The operation of refrigerator 450 and the control system are described in more detail below in conjunction with FIG. 27 and FIG. 35.

Refrigerator compartment door 469 can include an ice and water dispenser 472 positioned on the face of the door. Ice and water dispenser 472 can be positioned on refrigerator compartment door 469 at a convenient height for user access as is well known in the art. A user interface 473 can be positioned adjacent ice and water dispenser 472 for users to select ice and water dispensing alternatives such as "quick ice" described below, and other refrigerator freezer operation parameters such as described in U.S. patent application Ser. No. 10/861,203, now U.S. Pat. No. 7,201,005, incorporated herein by reference. Ice making, storage and dispensing apparatus 4130 can be positioned on the inside surface of refrigerator compartment door 469 and can include an insulated cover 4134. Ice making, storage and dispensing apparatus 4130 can be positioned to feed ice cubes to the dispenser 472 as is well known in the art. In the embodiment of FIG. 20 and FIG. 21 an air duct (not shown) can be provided leading from a source of below 0° C. air to the insulated enclosure 4134 to facilitate formation and storing ice cubes. When refrigerator compartment door 469 is closed ice making, storage and dispensing apparatus 4130 is positioned in refrigerated compartment 454 that is maintained above 0° C. Insulated enclosure 4134 in effect forms a sub-compartment that can be maintained below 0° C. to facilitate formation and storage of ice cubes without upsetting normal above 0° C. temperatures in the refrigerator compartment 454. Alternately, ice making, storage and dispensing apparatus 4130 can be located on refrigerator compartment door 468 together with ice and water dispenser 472 if desired.

Figure 22:
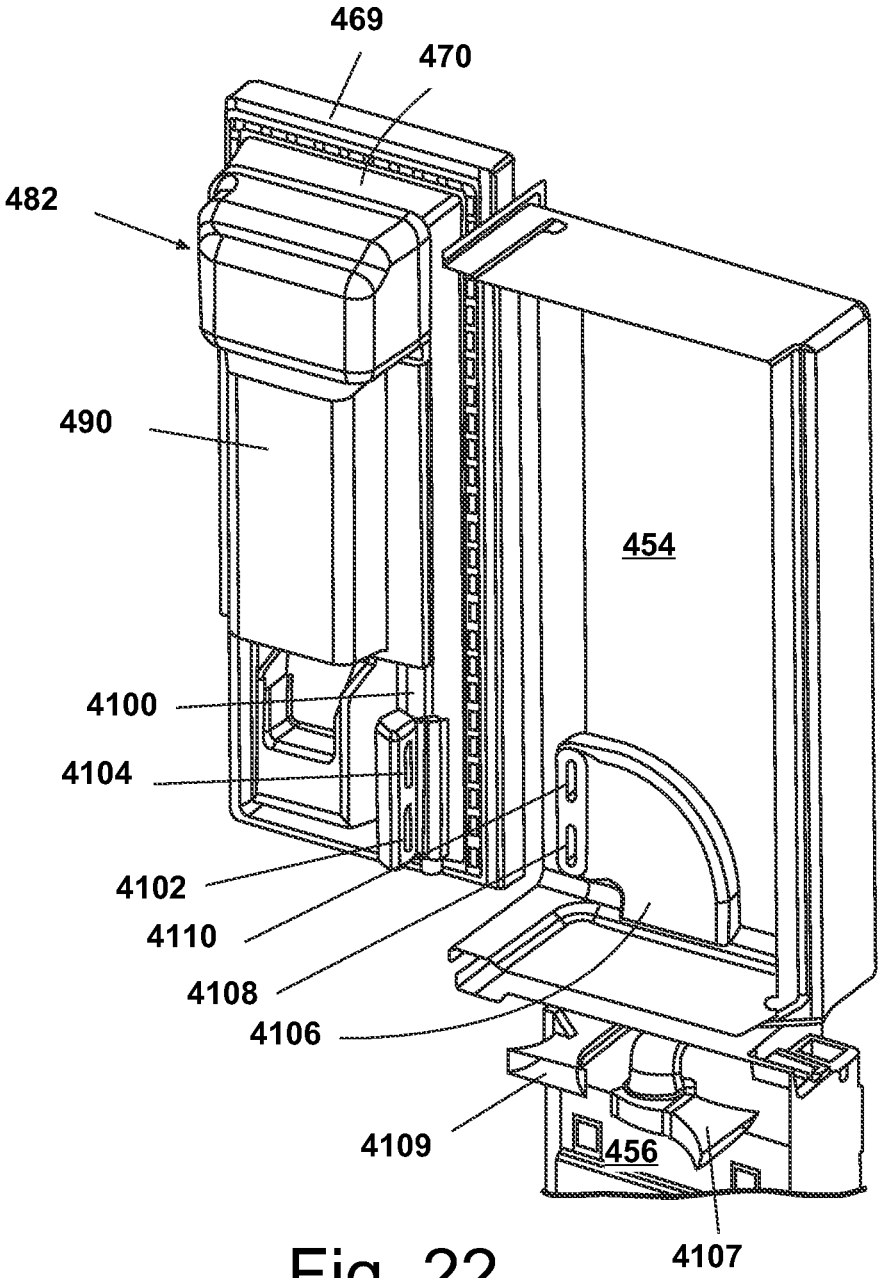
FIG. 22 is a partial perspective view of a bottom freezer refrigerator illustrating an embodiment of an ice maker and ice dispenser according to the present invention positioned on a refrigerator compartment door.
Figure 23:
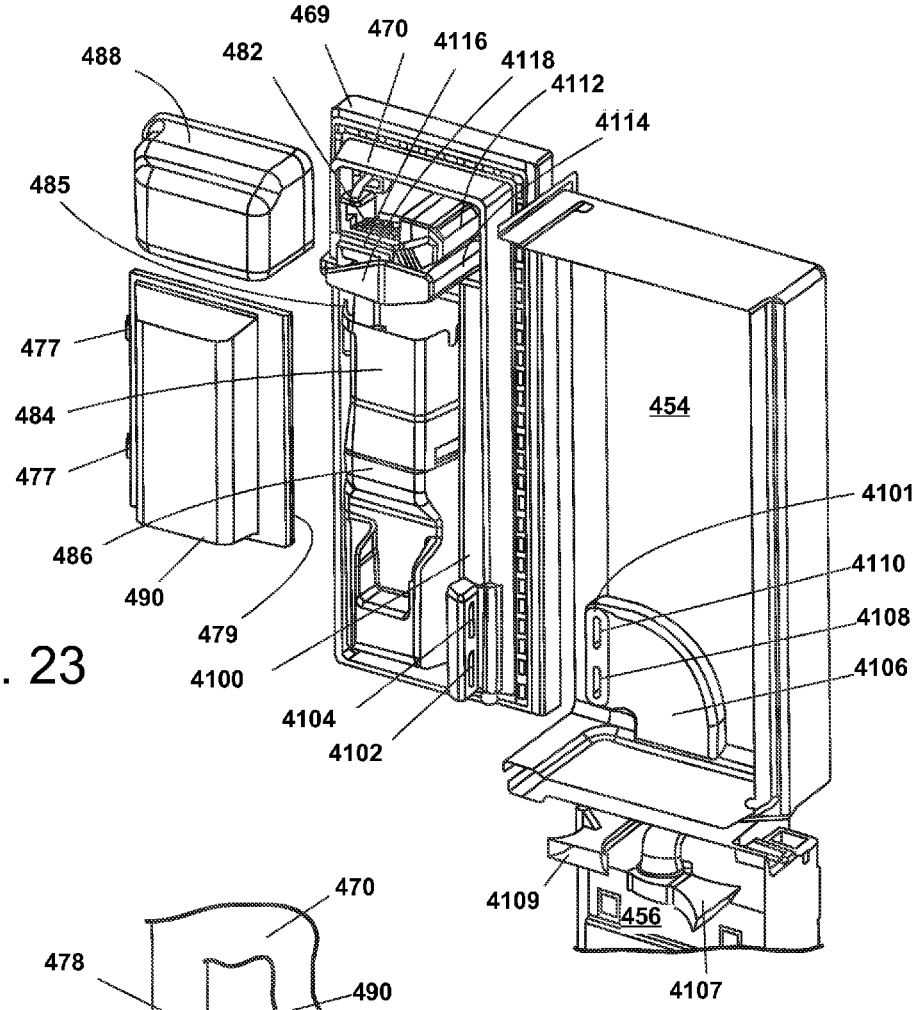
FIG. 23 is a partial perspective view of the embodiment of FIG. 22 with insulated covers moved to show an ice maker, ice cube storage bin ice dispenser mechanism and air passages that can be used with the present invention.
Figure 24:
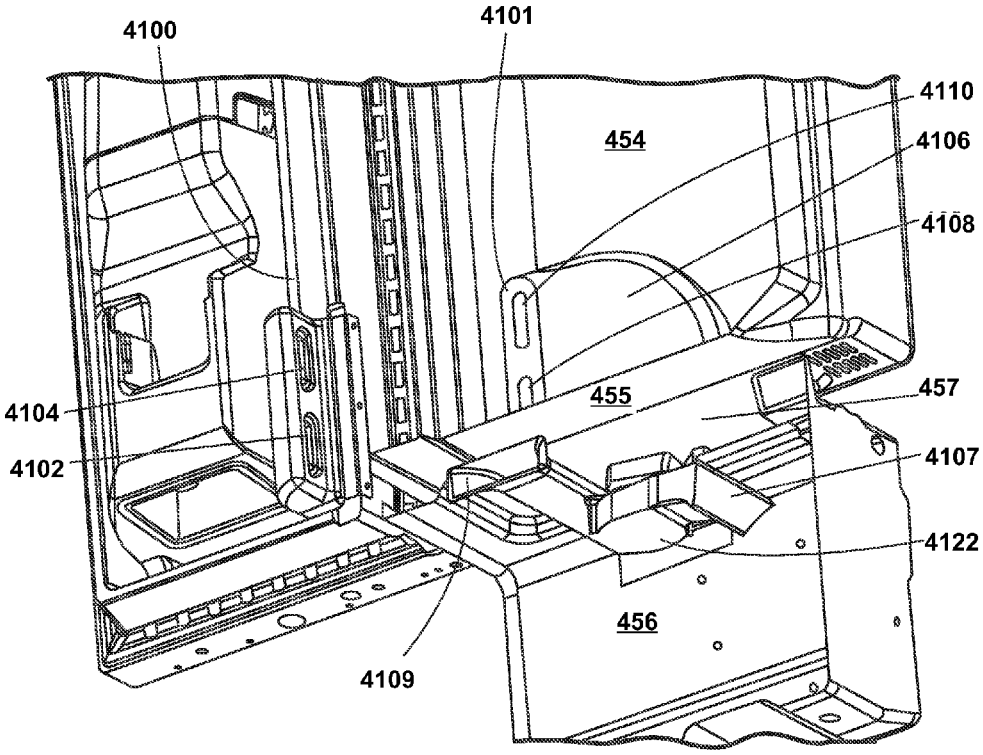
FIG. 24 is a partial perspective view of the embodiment of FIG. 22 showing connection of air passages from the freezer compartment to air passages on the refrigerator compartment door.

Turning to FIGS. 22 to FIG. 24, another embodiment of the invention can be seen. An ice maker 482 can be mounted adjacent to the top of the refrigerator compartment door 469 spaced from inner door panel 470. An ice cube storage bin 484 can be positioned below ice maker 482 and arranged so that ice cubes harvested from ice maker 482 can fall through ice chute 492 (FIGS. 25 and 26) into ice cube storage bin 484. Ice chute 492 can be located between the rear of ice maker 482 and inner door 470 in opening 489 (FIGS. 25 and 26) to direct ice cubes into ice cube storage bin 484. Ice cube storage bin 484 can rest on top of ice dispenser 486. An insulated cover 490 can be provided to substantially enclose ice cube storage bin 484 and ice dispenser 486. Insulated covers 488 and 490 can form sub-compartments that can be maintained below 0° C. to facilitate formation and storage of ice cubes. Insulated cover 488 can include one or more latching surfaces (not shown) arranged to hold cover 488 in place forming a below 0° C. enclosure for ice maker 482 as refrigerator compartment door 469 is opened and closed in use. As described above, insulated cover 488 and insulated cover 490 allow the respective sub-compartments to be maintained at below 0° C. temperatures without upsetting normal above 0° C. temperatures in refrigerator compartment 454.

Figure 23A:
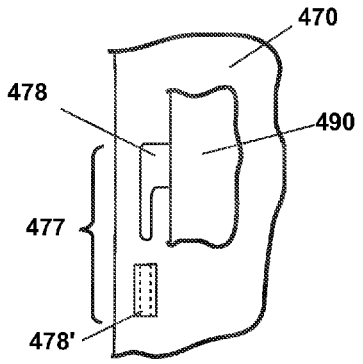
FIG. 23A is a partial detail drawing illustrating hinges for the insulated cover for the ice cube storage bin.

Insulated cover 490 can be pivotally mounted to inner door panel 470 with hinges 477. Hinging insulated cover 490 to inner door panel 470 can allow easy access to ice cube storage bin 484 to, for example, facilitate removal of ice cube storage bin 484 to bulk dispense ice cubes into a cooler or the like. Insulated cover 490 can be arranged so that it can be closed automatically as refrigerator compartment door 469 is closed. Insulated cover 490 can be provided with a gasket 479 on the surface facing inner door panel 470 to seal against a surface of inner door panel 470. Those skilled in the art will understand that gasket 479 can be urethane foam or other suitable resilient gasket material. To facilitate sealing, the surface of inner door panel 470 against which insulated cover 490 closes can be arranged in a plane. A mechanical or magnetic latch (not shown) can be provided to hold insulated cover 490 in a closed position as shown in FIG. 22. Alternately, insulated cover 490 can be provided with a magnetic gasket that can interact with a metal plate or magnet positioned opposite the gasket on the inside surface of inner door 470. The hinges 477 pivotally mounting insulated cover 490 to inner door panel 470 can be two part hinges. Hinges 477 can have one or more pegs 478 carried on insulated cover 490 that insert into mating support holes 478' that can be mounted or formed in inner door panel 470 that can allow removal of the cover 490 without tools, see FIG. 23A. Insulated covers 488 and 490 can be formed of insulting material such as styrobead material or can be formed of double wall plastic sheets with insulating space between the sheets that can be filled with insulating material or gaseous material. Those skilled in the art will understand that the covers 488 and 490 can be transparent, translucent or opaque as desired in order for the ice maker, ice cube storage bin and ice dispenser to be visible or hidden from view when the refrigerator compartment door 469 is opened.

Insulated cover 490 can be omitted if ice cube storage bin 484 is formed of insulating material. In one embodiment, ice cube storage bin 484 can be formed of double wall plastic material with sufficient insulating properties to maintain ice cubes in the bin frozen and sufficiently cold to preclude individual cubes from melting together. Those skilled in the art will readily understand that suitable clear plastic materials such as described above can be used to form an insulated ice cube storage bin 484. Similarly, those skilled in the art will understand that if no insulating cover is provided below 0° C. air flow can be directed into ice cube storage bin 484 in a manner to preclude undesirable leakage to the refrigerator compartment. Below 0° C. air flow for cooling the ice cube storage bin will be described in further detail below.

Ice cube storage bin 484 and ice dispenser 486 can be similar to the ice delivery system disclosed in U.S. Pat. No. 6,082,130, assigned to the assignee of this application and incorporated herein by reference. Patent applications Ser. No. 10/973,556, now U.S. Pat. No. 7,185,508 and Ser. No. 10/973,559, now U.S. Pat. No. 7,437,885, incorporated herein by reference, disclose ice makers that can be used as the ice maker 482 in this invention. Those skilled in the art will understand that an ice delivery system such as disclosed in U.S. Pat. No. 6,082,130 can be used in the embodiment shown in FIGS. 22 and 23, or can be provided with an insulating ice cube storage bin as described above, and can be positioned on refrigerator compartment door to cooperate with ice maker 482 and with ice and water dispenser 472 (as shown on FIG. 20). Ice cube storage bin 484 can have a level sensor 491 (see FIG. 35) that can cooperate with notice 485 in the sidewall of ice cube storage bin 484 as described in U.S. Pat. No. 6,082,130. While one approach to level sensing is described in U.S. Pat. No. 6,082,130, those skilled in the art will understand that many ways to determine the level of ice cubes in an ice storage bin are known and can be used in place of the optical system described in the above identified patent application. Ice maker 482 and the ice and water dispenser 472 can be provided with water under control of a water valve 495 (see FIG. 35) that can be included in the bottom freezer refrigerator as is well known in the art. Control of water to the ice and water dispenser 472 and ice maker 482 can be a variable flow water system as disclosed in U.S. patent application Ser. No. 10/861,569, now U.S. Pat. No. 7,210,601 incorporated herein by reference. Water can be supplied to door 469 for ice and water dispenser 472 and for ice maker 482 as is well known in the art.

In this embodiment of the invention below 0° C. air can be supplied to ice maker 482 and ice cube storage bin 484 by an air delivery system that can lead from freezer compartment 456. The air delivery system can include a first air delivery portion 4100 that can be positioned along one side of refrigerator compartment door 469 against inner door panel 470. The air delivery system can include a second air delivery portion 4106 positioned along a side wall of refrigerator compartment 454 and leading down toward freezer compartment 456. First air delivery portion 4100 can include a supply duct 4102 and a return duct 4104. Those skilled in the art will understand that the first air delivery portion 4100 can be a dual passage tube having two air passages forming supply duct 4102 and return duct 4104. First air delivery portion 4100 can be formed of thermoformed or injection molded plastic material and can be covered or enclosed with insulating material such as rigid styrobead. Second air delivery portion 4106 can similarly comprise a supply duct 4108 and a return duct 4110. Second air delivery portion 4106 can be a dual passage tube formed of plastic material similar to first air delivery portion 4100. The faces of first and second air delivery potions 4100 and 4106 can abut when refrigerator door 469 is closed and can be arranged so that supply ducts 4102 and 4108 and return ducts 4104 and 4110 are opposite one another, and can form a continuous package when refrigerator compartment door 469 is closed. The face of first and second air delivery portions 4100 and 4106 can include suitable sealing surfaces for the supply and return ducts so that substantially air tight connections can be made when refrigerator compartment door 469 is closed. For example, resilient gasket material 4101 such as urethane foam can be provided around the inlets to ducts 4108 and 4110 to form a substantially air tight seal when refrigerator door 469 is closed and first air delivery portion 4100 contacts second delivery portion 4106. Those skilled in the art will understand that other gasket arrangements can be provided to seal the first air delivery portion 4100 and second delivery portion 4106 when refrigerator door 469 is closed. In addition those skilled in the art will understand that first air delivery portion 4100 including supply duct 4102 and return duct 4104 can be formed as part of inner door panel 470. Alternately, first air delivery portion 4100 can be provided between inner door panel 470 and outer panel of refrigerator compartment door 469. Those skilled in the art will also understand that the interface between supply and return ducts 4102 and 4104 and return ducts 4108 and 4110 can be formed as a bellows providing an enclosed passage when door 469 is open in lieu of surface seals.

As mentioned above, the first and second air delivery portions 4100 and 4106 can be insulated to limit heat transfer from the below 0° C. air being delivered to the ice maker 482 and ice cube storage bin 484 to the above 0° C. refrigerator compartment 454. Similarly, insulation can be provided to prevent the refrigerator cabinet 450 from sweating on or near the interface between the first and second air delivery portions 4100 and 4106. Alternately, those skilled in the art will understand that heaters can be provided for the cabinet adjacent the interface between the first and second air delivery portions 4100 and 4106 to prevent condensation or frost buildup inside or outside of refrigerator 450 as is well known in the art.

Turning to FIG. 24, an ice maker fan 4122 can be mounted at the top wall 457 of freezer compartment 456. Insulation can be provided in the space 455 between the refrigerator compartment 454 and freezer compartment 456 as is well understood in the art. Ice maker fan 4122 can be connected to return duct 4110 to draw below 0° C. air from freezer compartment 456 to ice maker 482 and ice cube storage bin 484. Ice maker fan 4122 can be connected to return duct 4110 to draw air from duct 4110 and discharge the air into freezer compartment 456 through an outlet 4107. Outlet 4107 can be aimed to the inlet to the refrigeration system that can include an evaporator compartment along the real wall of freezer compartment 456 as is well known in the art. As ice maker fan 4122 draws air from return duct 4110, below 0° C. air from freezer compartment 456 can flow into supply duct 4108 through an inlet 4109. Those skilled in the art will understand that outlet 4107 and inlet 4109 can be provided with a suitable grill to preclude items from freezer compartment 456 enter outlet 4107 or inlet 4109. Below 0° C. air can flow from supply duct 4108 to supply duct 4102 in the first air delivery portion to ice maker 482 and ice cube storage bin 484. Air from ice maker 482 and ice cube storage bin 484 can flow in return duct 4104 to return duct 4110, and thence to ice maker fan 4122. An advantage of locating ice maker fan 4122 in freezer compartment 456 connected to return duct 4110 is that power input to the ice maker fan 4122 is added to the air stream after it has cooled the ice maker 482 or ice cube storage bin 484. By locating ice maker fan at the discharge of the return duct 4110 the air delivery system for the ice maker and ice cube storage bin can operate at slightly less than atmospheric pressure to help seals sealing the air delivery system make positive contact. However, those skilled in the art will understand that ice maker fan 4122 can be arranged, and can be used, to force air through supply ducts 4108 and 4102 rather than drawing air through return ducts 4110 and 4104 as shown in this embodiment. In addition ice maker fan 4122 can be positioned on refrigerator compartment door 469 rather than in freezer compartment 456 as described in conjunction with FIGS. 32 to 34 below. Those skilled in the art will understand that instead of a separate ice maker fan, a conventional evaporator fan plus a suitable air flow control such as a damper can be used to circulate below 0° C. air to the ice maker and ice cube storage bin.

Figure 25:
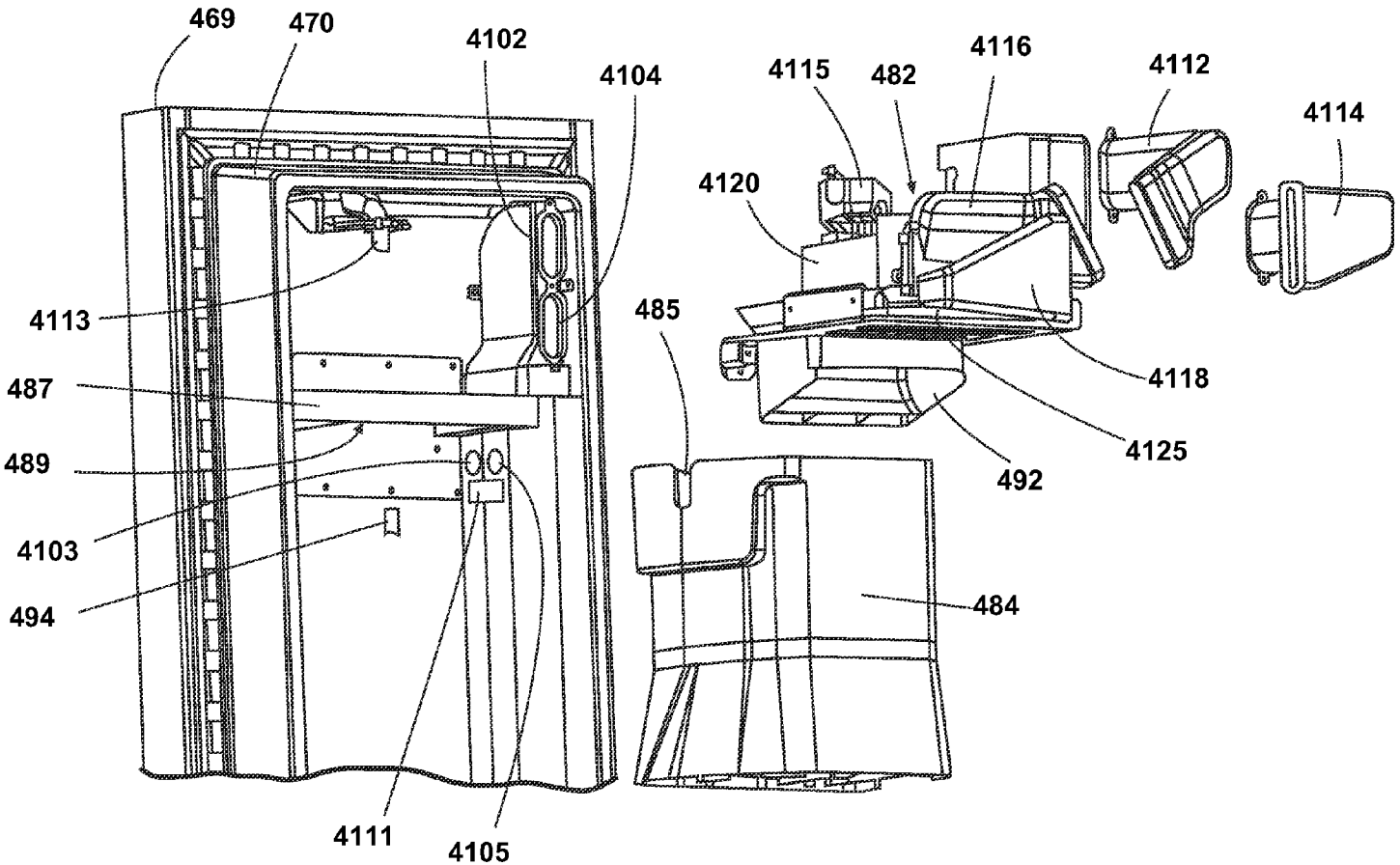
FIG. 25 is a partial exploded view illustrating the ice maker and ice cube storage bin of the embodiment of FIG. 22 spaced from the refrigerator compartment door.
Figure 26:
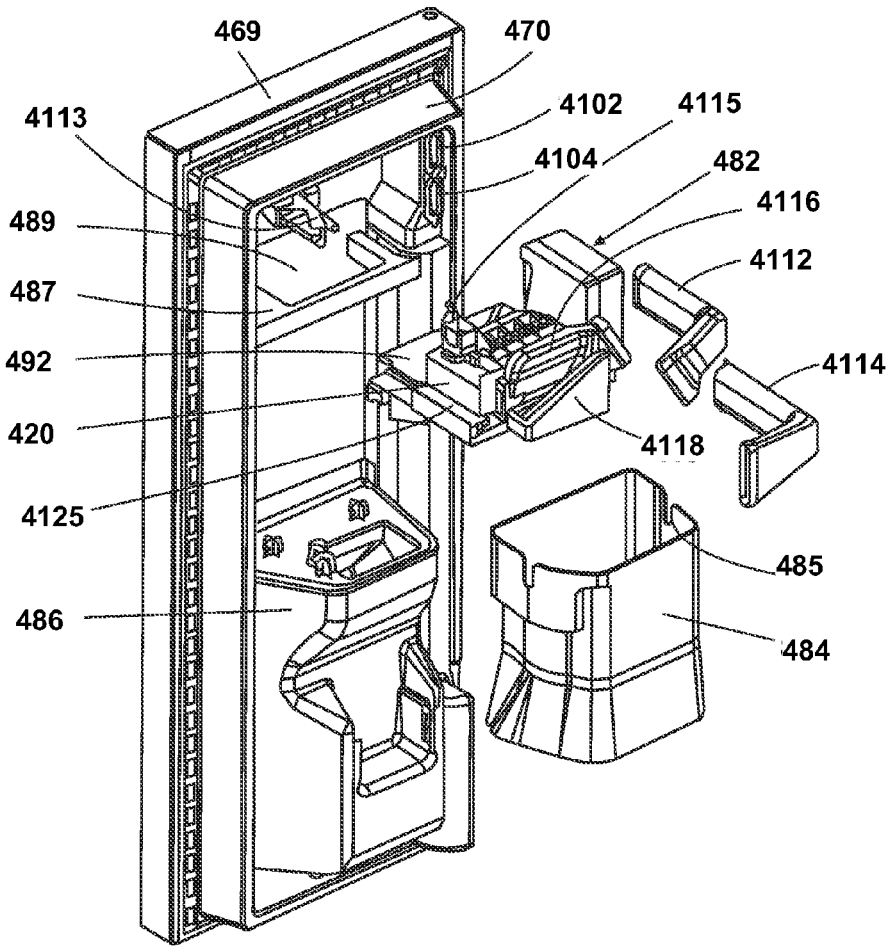
FIG. 26 is another partial exploded view illustrating the ice maker and ice cube storage bin of the embodiment of FIG. 22 spaced from the refrigerator compartment door.
Figure 26A:
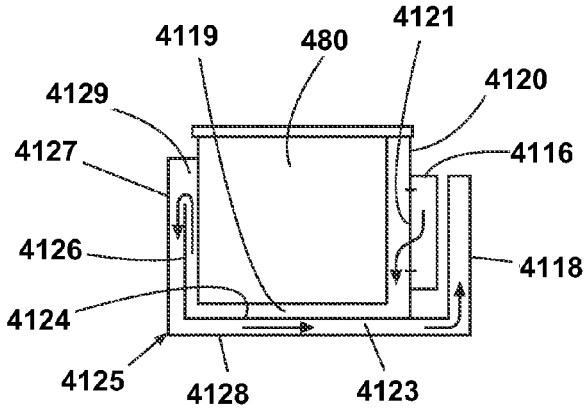
FIG. 26A is a schematic cross view illustrating the ice maker mold, housing and return shroud of the embodiment of FIG. 22.

Turning to FIGS. 25 and 26, ice maker 482 and ice cube storage bin 484 can be seen spaced from inner door 470 in an exploded view. Ice maker 482 can have an ice chute 492 located along the rear edge of the ice mold 480 arranged to direct ice cubes harvested from the ice mold 480 downward into ice cube storage bin 484. Ice maker fill tube 4113 can be provided at the top of inner door 470 arranged to cooperate with water inlet element 4115 to fill ice maker 482. Fill tube 4113 can be supplied with water by water valve 495 as is well known in the art. The entrance into ice chute 492 substantially fills the space between the ice mold 480 and the inner door 470 when ice maker 482 is mounted spaced from the inner door 470 on support 487. Support 487 can include an opening 489 that can accommodate ice chute 492. Ice maker 482 can be arranged to cause harvested ice cubes to fall off the rear edge of ice mold 480 into ice chute 492 into ice cube storage bin 484 as is well known in the art. As described above, ice cube storage bin 484 can be positioned on dispenser 486 as described in U.S. Pat. No. 6,082,130 fully incorporated in this application by reference. Supply duct 4102 and return duct 4104 can be connected to ice maker 482 by a supply connector 4112 and a return connector 4114 that can lead from first air delivery portion 4100 to ice maker 482. Ice maker 482 can have a housing 4120 enclosing the base of ice mold 480 as described in more detail below in connection with FIGS. 30 and 31. Supply connector 4112 can connect to supply inlet 4116 connected to housing 4120 at housing inlet 4121. Return connector 4114 can connect return outlet 4118. Referring to FIG. 26A in addition to FIGS. 25 and 26, a return shroud 4125 can be positioned over bottom wall 4124 and the side wall 4126 of housing 4120 to form a return passage 4123. Thus, return passage 4123 can be the space between housing 4120 and return shroud 4125. Side wall 4126 of housing 4120 can extend part way up the side wall of ice mold 480. Side wall 4127 of return shroud 4125 can extend further up the side wall of ice mold 480 and thus define an outlet 4129 from air passage 4119 described below in connection with FIGS. 30 and 31. Return passage 4123 can be defined by the space between wall 4126 and wall 4127 along the side of ice mold 480 and the space between bottom wall 4124 and return shroud base 4128. As described in this embodiment, return passage 4123 can be a generally "L" shaped passage leading from the side of ice maker 482 opposite housing inlet 4121 to return outlet 4118. Return outlet 4118 can connect to return passage 4123 at return shroud base 4128. Air flow from supply inlet 4116 through housing inlet 4121, through air passage 4119 described below and through return passage 4123 to return outlet 4118 is shown by arrows in FIG. 26A. While housing 4120 and return shroud 4125 are described in this embodiment as a single element those skilled in the art will understand that housing 4120 and return shroud 4125 can be formed of multiple elements if desired.

Figure 30:
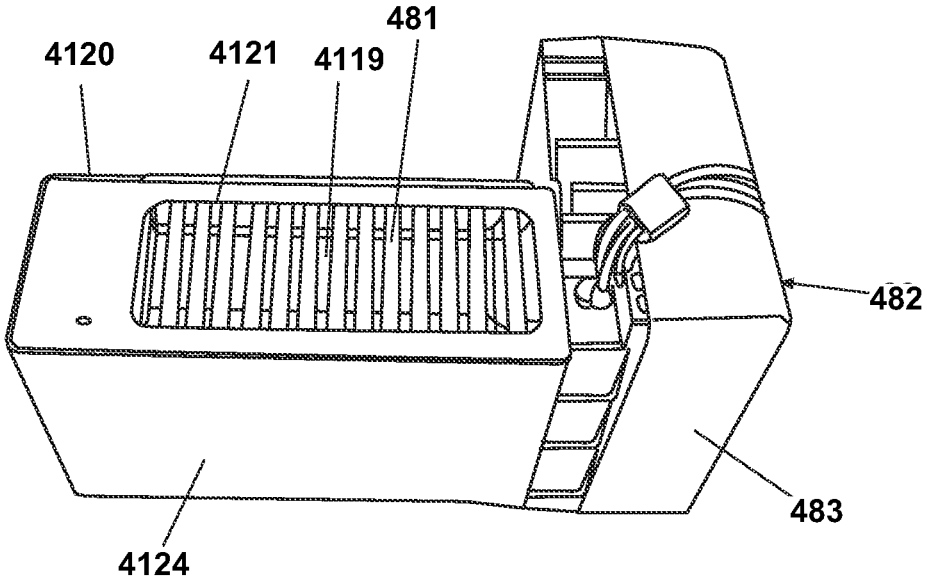
FIG. 30 is a perspective view of an embodiment of an ice maker configured for use according to the present invention.
Figure 31:
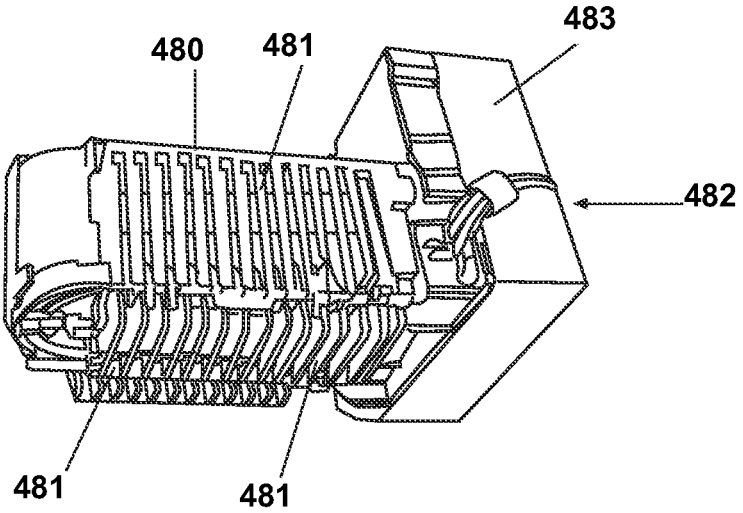
FIG. 31 is a perspective view of the ice maker of FIG. 30 with a housing forming air passages around the ice mold removed.

Turning to FIG. 30 and FIG. 31, ice maker 482 can be seen removed from refrigerator door 469. Ice maker 482 can include a housing 483 for the ice maker control and drive mechanism as is well known in the art. Extending from housing 483 can be an ice mold 480 having a plurality of cavities (not shown) for holding water to be frozen into ice cubes. Ice mold 480 can be an epoxy coated metal mold formed of aluminum or other material having good thermal conductive properties as is well known in the art. In addition, ice mold 480 can have a plurality of fins 481 extending from the side and bottom walls of the ice mold 480 to facilitate heat transfer from the ice mold during ice cube freezing cycles. While only one side wall is shown in FIGS. 30 and 31, the other side wall (not shown) can also have a plurality of fins 481. A housing 4120 can be provided to substantially enclose the bottom and side walls of the ice mold 480. Housing 4120 can include a housing inlet opening 4121. The supply inlet 4116 can be positioned over inlet opening 4121. Return shroud 4125 can overly the side 4126 of housing 4120 (shown in FIG. 26A) opposite housing inlet opening 4121 and bottom wall 4124 as described above. Side 4126 of housing 4120 can define an outlet opening 4129 with return shroud side 4127 to allow chilled air to flow into the return passage 4123 between return shroud 4125 and housing 4120. As described above, return shroud base 4128 can be spaced from housing bottom wall 4124 to define the bottom leg of the return passage leading to return outlet 4118. The spaces between adjacent fins 481, ice mold 480 and housing 4120 can define an air passage 4119 for the below 0° C. air circulating from supply duct 4102 to return duct 4104. Housing 4120, return shroud 4125, supply inlet 4116 and return outlet 4118 can form an air flow circuit around the base of the ice mold 480 to circulate below 0° C. air in air passage 4119. The below 0° C. air from supply inlet 4116 can enter air passage inlet 4121 and flow through air flow passage 4119 between fins 481 to the opposite side of the ice mold 480 and through outlet 4129 and passage 4123 between housing 4120 and return shroud 4125. Thus, air flow passage 4119 and return passage 4123 contain below 0° C. air flow to the substantially enclosed space around the bottom and sides of the ice mold 480. Those skilled in the art will understand that housing 4120 and ice mold 480 can take other forms to provide a contained air flow path around the base of the ice mold within the scope of the invention. The air flow arrangement according to the invention is substantially different from conventional ice makers having air flowing over the top and sides of the ice maker. Advantages of the air flow arrangement of this invention around the base of the ice mold include enhanced ice production rates resulting from greater heat transfer from the ice mold. Containing the below 0° C. air in air flow passage 4119 facilitates temperature control in the refrigerator compartment notwithstanding the below 0° C. air flow to the ice maker 482 and ice cube storage bin 484. Further, cooling the ice mold from the bottom and sides can allow ice to freeze from the bottom up. Freezing ice cubes from the bottom up can help eliminate creation of "ice volcanoes" that can occur when water in the ice mold freezes from the top to the bottom of the mold. When water at the top of an ice mold freezes first when the lower part freezes it expands and can force a channel of water to either the upper or lower surface, possibly damaging the ice mold. Those skilled in the art will understand that below 0° C. air can be delivered to an ice maker without containing the chilled air to the base of the ice mold if the design of the ice maker renders that impractical. When the below 0° C. air is not contained to the base of the ice mold, as in this embodiment, insulating covers such as 488 and 490 can be modified to maintain acceptable above 0° C. temperatures in the refrigerator compartment.

Returning to FIG. 25, supply duct 4102 and return duct 4104 can have an opening adjacent the ice cube storage bin 484 to provide a flow of below 0° C. air for the ice cube storage bin 484. Supply duct 4102 can have a port 4103 and return duct 4104 can have a port 4105 positioned below ice maker 482 and arranged to discharge and collect below 0° C. air from ice cube storage bin 484. A damper 4111 can be provided to regulate the flow of below 0° C. air into and out of the ice cube storage bin 484. To provide satisfactory ice cube storage it can be desirable to control the temperature in the ice cube storage bin to below 0° C. However, applicants have found that it is not necessary to maintain the ice cube storage bin a s cold as freezer compartment 456 for satisfactory ice cube storage. Damper 4111 can be arranged for manual adjustment by a user, or can be operated by a feedback control (not shown) including a temperature sensor, described below, for the ice cube storage bin. Feedback controls capable of operating damper 4111 based on temperature sensed by a temperature sensor are well known in the art. Damper 4111 can be arranged to have two positions, open and closed, or can be arranged to be infinitely adjustable. In either case damper 4111 can be operated by a suitable feedback control as will be readily understood by those skilled in the art. Another alternative can be to size the ports 4103 and 4105 so that no damper is required over the normal range of operating conditions. With this alternative, ports 4103 and 4105 can be sized to provide a sufficient, but not excessive amount of below 0° C. air to maintain satisfactory temperatures in the ice cube storage bin 484. Those skilled in the art will understand that other means can be provided to cool ice cube storage bin 484 including thermoelectric cooling, a separate chilled air supply/return or heat pipes leading to a source of below 0° C. temperatures.

A temperature sensor 494 can be provided for the ice cube storage bin 484 as can be seen in FIG. 25. Temperature sensor 494 can be positioned on inner door 470 adjacent ice cube storage bin 484 when it is installed on refrigerator compartment door 469. Temperature sensor 494 can be a thermister or similar sensor conventionally used to control refrigerator and freezer compartment temperatures and can be connected to ice maker control 4138 as described in more detail below in connection with FIG. 35. While temperature sensor 494 is described herein as a thermister those skilled in the art will readily understand that temperature sensor 494 can be another temperature sensitive device such as a thermocouple or bi-metal thermostat.

Alternately, only a supply duct port 4103 can be provided. After cooling the ice cube storage bin 484 the below 0° C. air can be allowed to enter the refrigerator compartment 454 and return to the refrigeration system with air in the refrigerator compartment. In this embodiment a damper 4111 and feedback control as described above can be provided to control the ice cube storage bin temperature.

Figure 27:
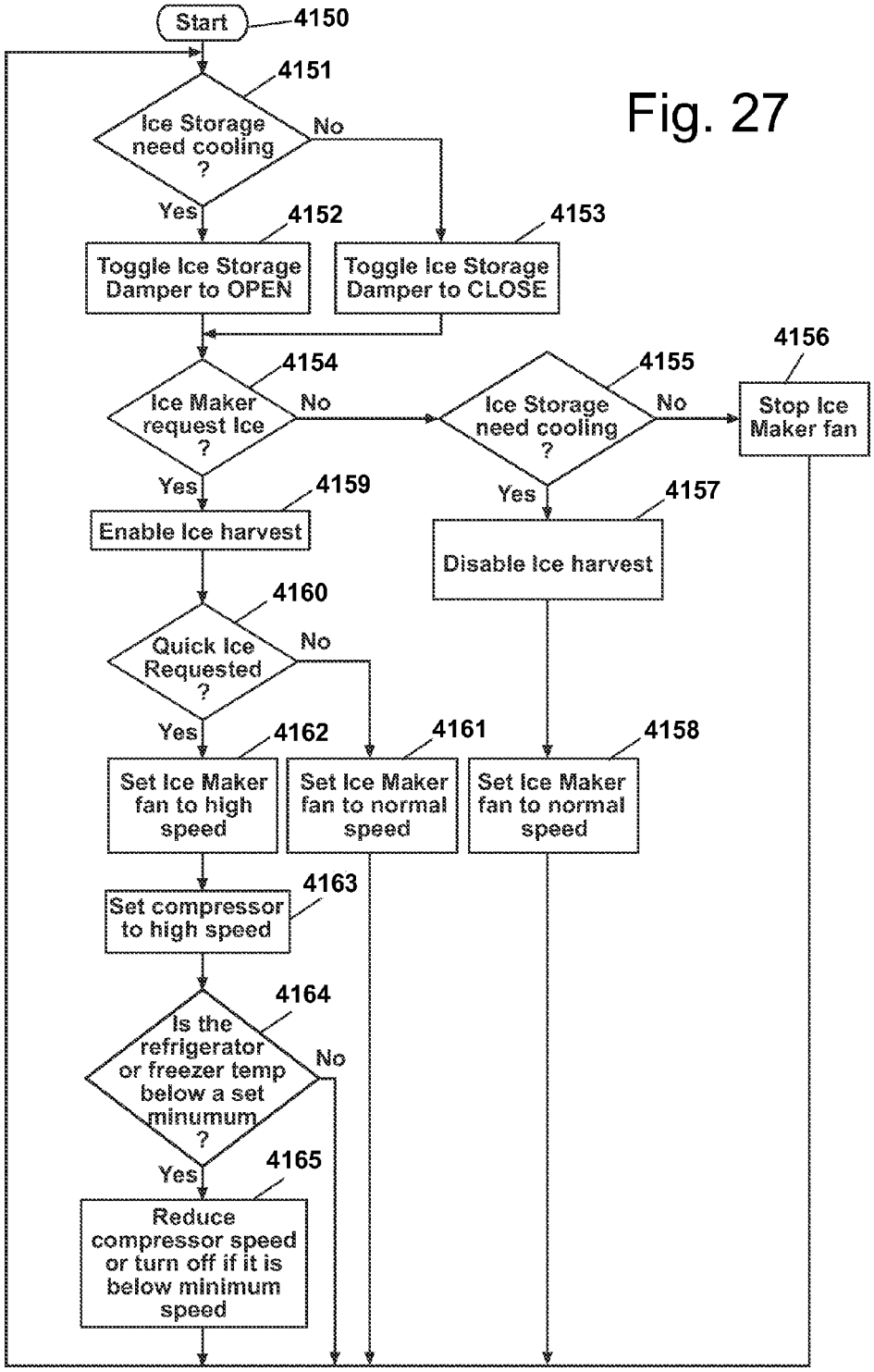
FIG. 27 is a flow chart illustrating the operation of one embodiment of the invention.
Figure 35:
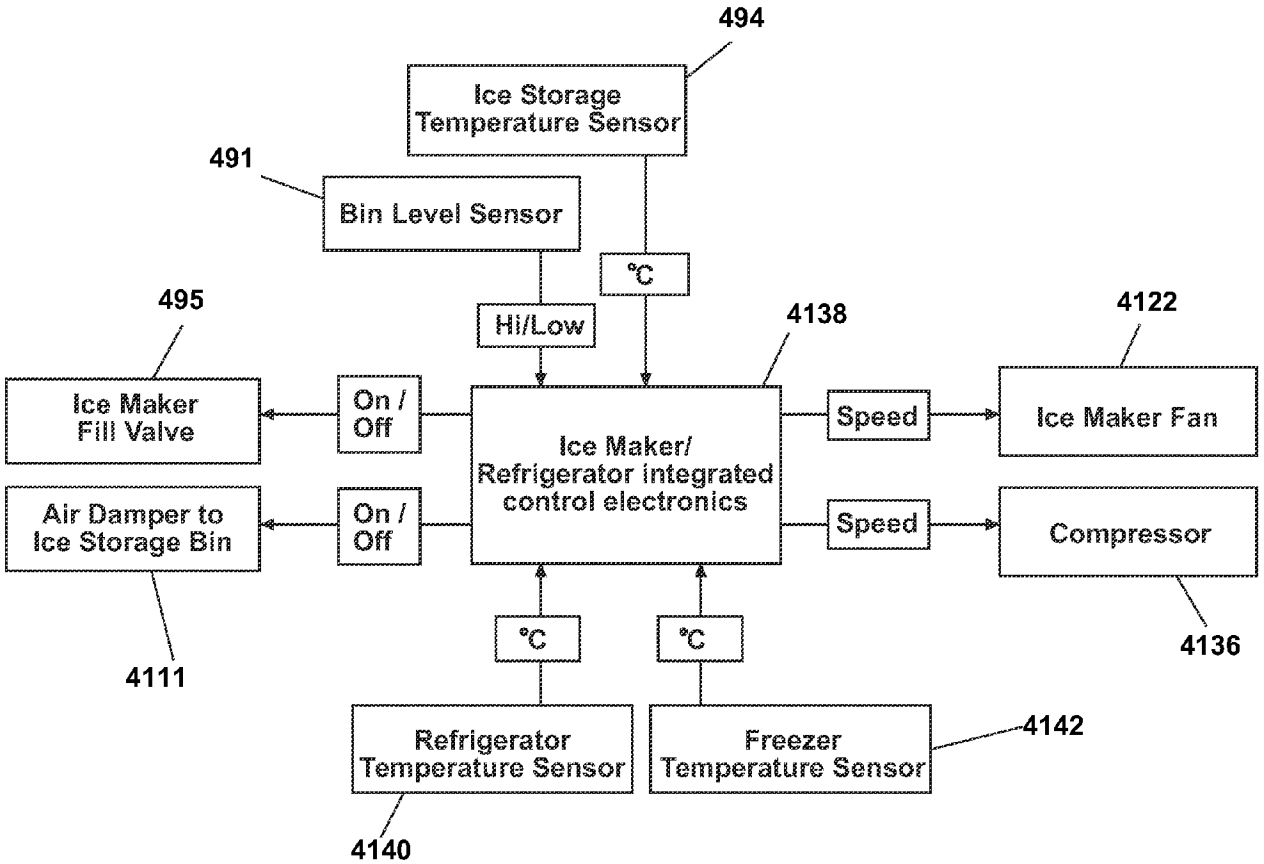
FIG. 35 is a block diagram of a control circuit that can be used with the embodiment of the invention described the flow chart in FIG. 27.

As mentioned above, the ice maker according to the invention can provide enhanced ice production. In one embodiment of the ice maker according to the invention the ice maker control 4138 can be arranged to provide enhanced ("quick ice") and normal ice production rates. Ice maker control 4138 can be a control dedicates to operation of the ice maker and ice dispenser, or can be a portion of an integrated controller for the bottom freezer refrigerator 450 as will be readily understood by those skilled in the art. In order to provide "quick ice" operation, ice maker fan 4122 can be a multiple speed fan having normal and high speed capability. Turning to FIG. 27 and FIG. 35 a flow chart and control circuit for ice maker 482 and control 4138 arranged to provide a "quick ice" feature can be seen. Beginning with Start, 4150, the ice maker control 4138 can determine whether the ice cube storage bin requires cooling, step 4151. If cooling is required the feedback control (not shown) can operate damper 4111 to open supply duct port 4103 and return duct port 4104, step 4152. If cooling is not required the feedback control can operate damper 4111 to close supply duct port 4103 and return duct port 4104, step 4153. Next ice maker control 4138 can determine if the ice maker 482 is requested to make ice, step 4154, for example by an ice cube storage bin level sensor 491 as mentioned above. If ice is not required the ice maker control 4138 can determine if the ice cube storage bin 484 requires cooling, step 4155. If the ice cube storage bin 484 does not require cooling, as determined by a temperature sensor 494 for ice cube storage bin 484 as described above, the ice maker control 4138 can stop the ice maker fan 4122, step 4156. If the ice cube storage bin 484 requires cooling but no ice is requested the ice harvest cycle for the ice maker 482 is disabled, step 4157 and the ice maker fan 4122 is set for normal speed operation, step 4158.

If ice maker control 4138 determines ice is requested in step 4154, an ice maker harvest cycle can be initiated, step 4159. Ice maker operation including filling the ice mold with water, ice cube formation and ice harvesting are all well known in the art. One example of automatic ice maker operation to harvest ice cubes can be found in U.S. Pat. No. 6,082,130 referred to above and incorporated herein by reference. After a harvest cycle is initiated ice maker control 4138 determines if enhanced ice production, or "quick ice" has been selected by the user, step 4160. Those skilled in the art will understand that "quick ice" can be a user selection that can be included on a user interface 473 that can be positioned on the face of the refrigerator compartment door 460 adjacent the ice and water dispenser 472, see FIG. 20. If "quick ice" is not selected the ice maker.

Figure 28:
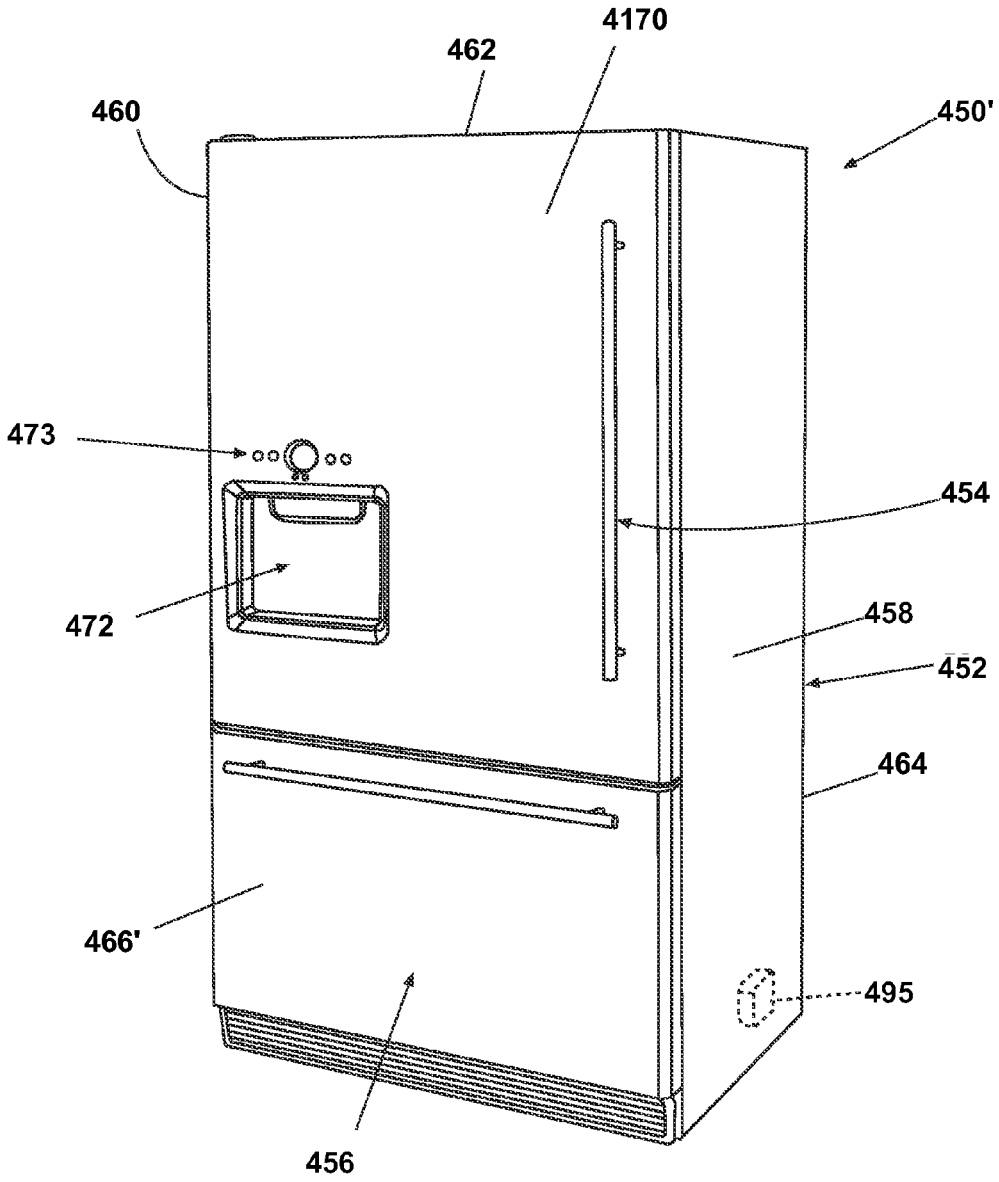
FIG. 28 is a perspective view of another embodiment of bottom freezer refrigerator including an ice maker and ice dispenser according to the present invention.
Figure 29:
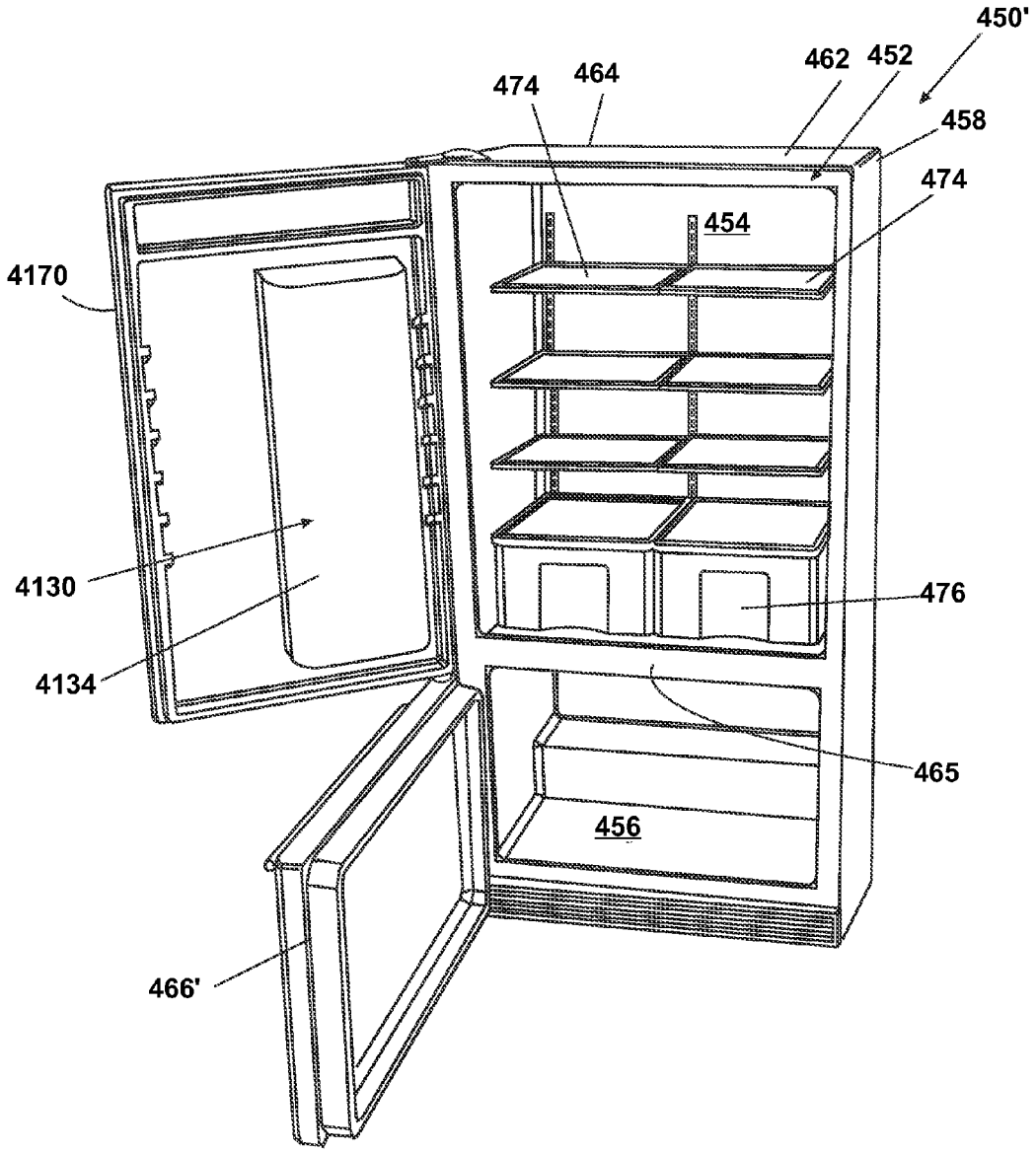
FIG. 29 is a perspective view of the bottom freezer refrigerator embodiment of FIG. 28 with the refrigerator and freezer compartment doors open.

Turning to FIG. 28 and FIG. 29, another embodiment of bottom freezer refrigerator having an ice maker and dispenser apparatus according to the invention can be seen. Bottom freezer refrigerator 450' can have a cabinet 452 including a refrigerator compartment 454 maintained at above 0° C. temperatures and a freezer compartment 456 maintained at below 0° C. temperatures. Freezer compartment 456 is positioned in the bottom of compartment 452 and refrigerator compartment 454 is positioned above freezer compartment 456. In the embodiment of FIG. 28 and FIG. 29, bottom freezer refrigerator 450' can have refrigerator compartment door 4170 to close the refrigerator compartment 454. Bottom freezer refrigerator 450' is generally the same as bottom freezer refrigerator 450 as shown in FIG. 20 and FIG. 21 with the exception of the refrigerator compartment door 4170. Accordingly, the same reference numerals are used for the embodiment of FIG. 28 and FIG. 29 with the exception of the refrigerator doors. While no door handles are shown on refrigerator compartment door 4170 and freezer compartment door 466' those skilled in the art will readily understand that handles for the doors can be provided if desired as is well known in the art. Refrigerator compartment 454 can include a plurality of shelves 474 that can be fixed or can be adjustable as shown in FIG. 29. One or more bins 476 can be provided in refrigerator compartment 454 for storing food items such as meats, vegetables, fruit and other food items that can benefit from storage in a closed receptacle that can be temperature and/or humidity controlled as well known in the art. Likewise, one or more shelves or baskets (no shown) can be provided in freezer compartment 456, again as is well known in the art.

Refrigerator compartment door 4170 can include an ice and water dispenser 472 positioned on the face of the door. Ice and water dispenser 472 can be positioned on refrigerator compartment door 4170 at a convenient height for user access as is well known in the art. As in the embodiment of FIG. 20 and FIG. 21 a user interface 473 can be positioned adjacent 472 for users to select ice and water dispensing alternatives such as "quick ice" described above, and other refrigerator freezer operations parameters such as described in U.S. patent application Ser. No. 10/861,203, now U.S. Pat. No. 7,201,005, incorporated herein by reference. Ice making and dispensing apparatus 4130 can be positioned on the inside surface of refrigerator compartment 469 and can include an insulated enclosure 4134. Ice making and dispensing apparatus 4130 can be positioned to feed ice cubes to the dispenser 472 as is well known in the art. As in the embodiment of FIG. 20 and FIG. 21 an air duct (not shown) can be provided leading from a source of below 0° C. air to the insulated enclosure 4134 to facilitate formation and storing ice cubes in refrigerated space, refrigerated compartment 454, that is maintained above 0° C. Insulated enclosure 4134 in effect forms a sub-compartment that can be maintained below 0° C. to facilitate formation and storage of ice cubes. The ice maker, ice cube storage bin and ice dispenser of the embodiment of FIGS. 22 through 26 can be used in the bottom freezer refrigerator in the embodiment of FIGS. 28 and 29 as will be understood by those skilled in the art. Those skilled in the art will understand that in the embodiment of FIGS. 28 and 29 that the ice cube storage bin and dispenser could be arranged side by side rather than vertically if desired.

Figure 32:
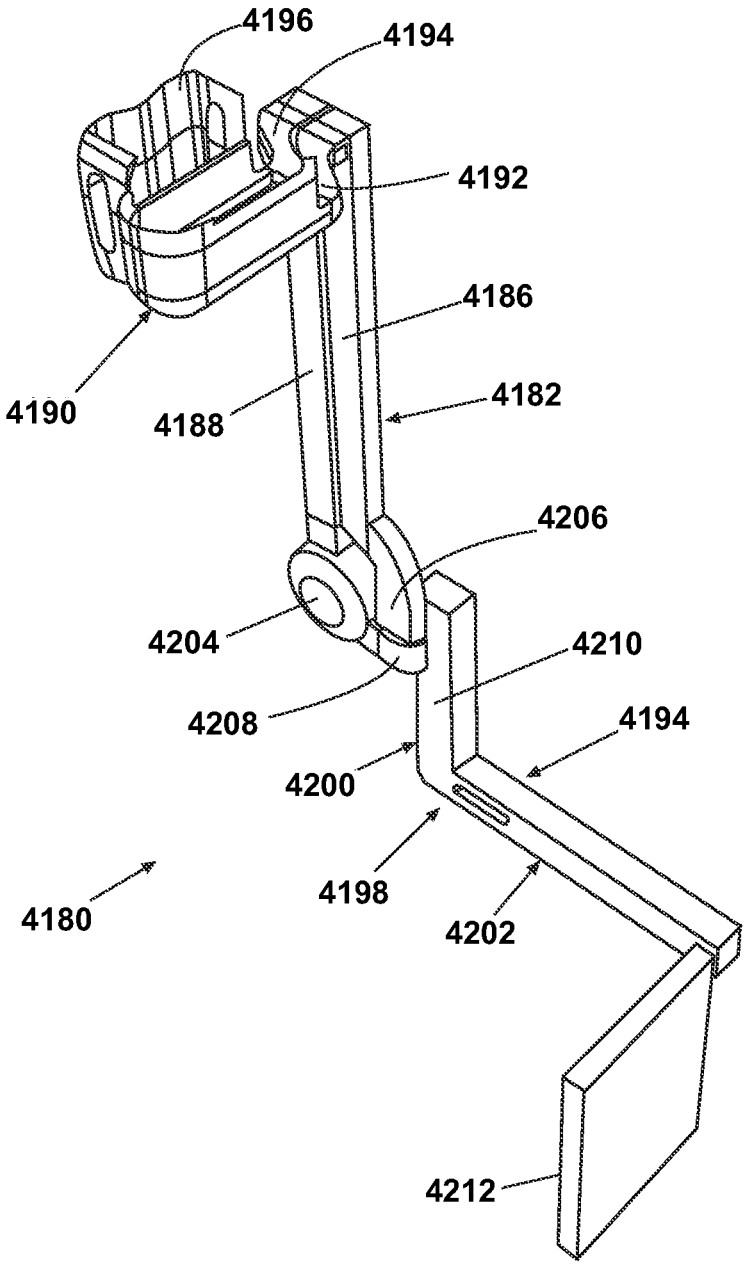
FIG. 32 is a perspective view of another embodiment of an ice maker air delivery system according to the invention removed from a bottom freezer refrigerator.
Figure 33:
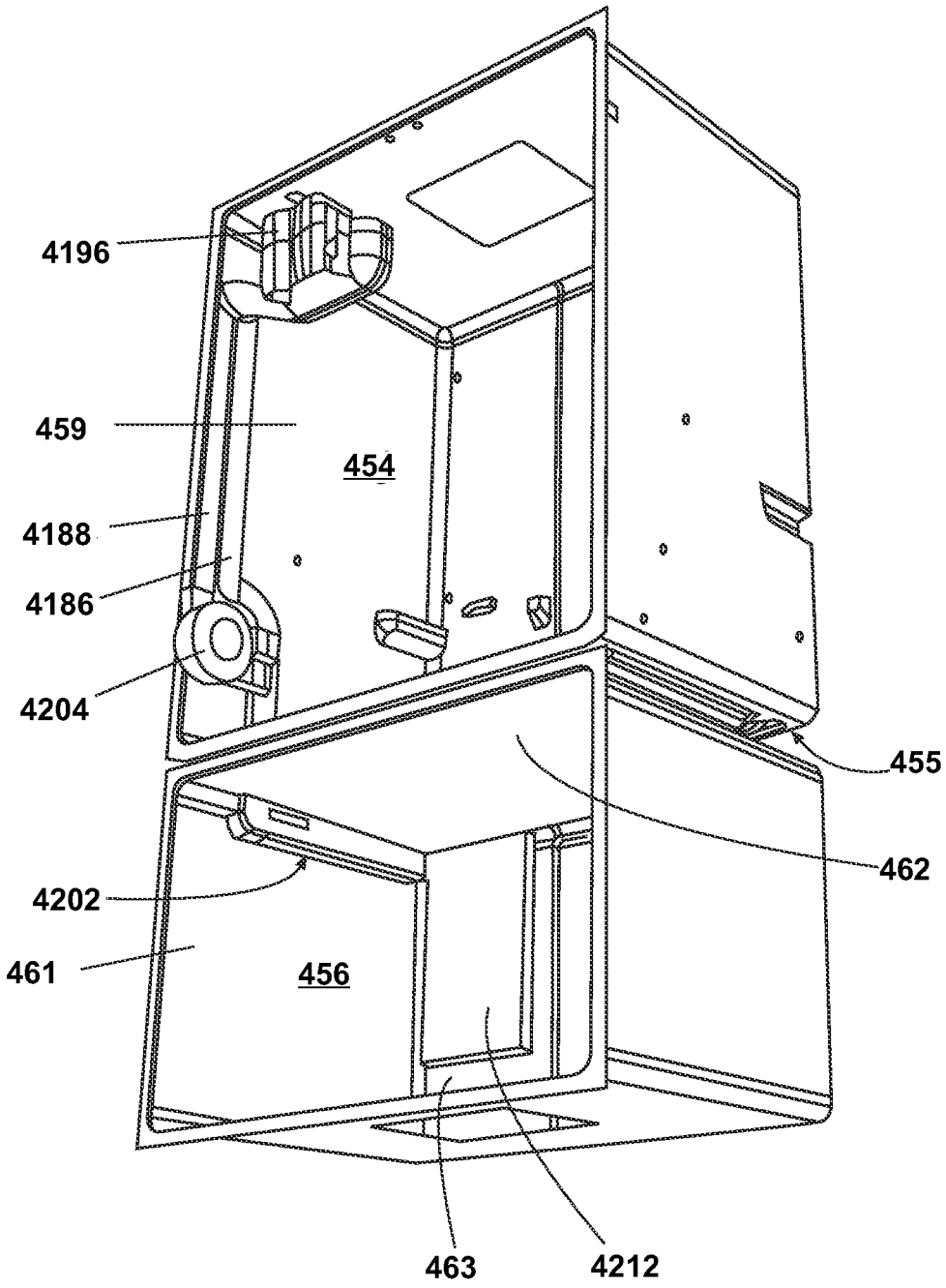
FIG. 33 is a partial front perspective view of a bottom freezer refrigerator liner with an air delivery system as shown in FIG. 32 installed.
Figure 34:
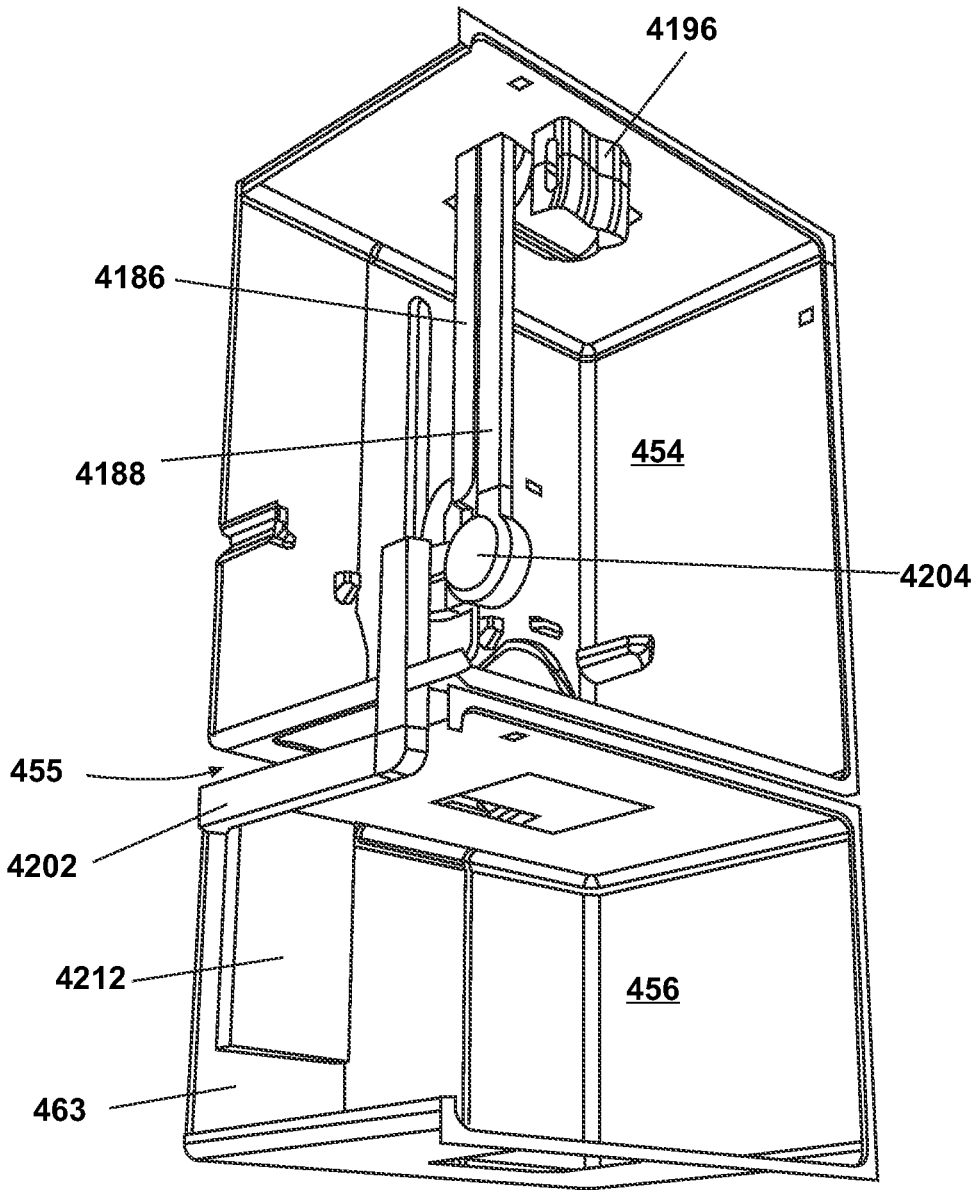
FIG. 34 is a partial front perspective view of a bottom freezer refrigerator with an air delivery system as shown in FIG. 32 installed with portions of the refrigerator compartment and freezer compartment liners removed.

Turning to FIGS. 32 to 34 an alternate embodiment of an ice maker air delivery system can be seen removed from the bottom freezer refrigerator. Air delivery system 4180 can include a first air delivery portion 4182 that can be mounted to or in a refrigerator compartment door (not shown) that can be a door like that shown in the embodiment of FIG. 20 or FIG. 28. Air delivery system 4180 can include a second air delivery portion 4184 that can be mounted to or in the side walls 459 and 461 of the refrigerator compartment 454 and freezer compartment 456 as described above. First air delivery portion 4182 of the air delivery system 4180 can include a supply duct 4186 and a return duct 4188. First air delivery portion 4182 can include a supply duct connector 4192 leading from supply duct 4186 to an ice mold cooling cavity 4190. First air delivery portion 4182 can also include a return duct connector 4194 leading from the ice mold cooling cavity 4190 to return duct 4188. An ice maker 482 (not shown) similar to the ice maker in the embodiment of FIGS. 22 to 26 can be positioned on top of ice mold cooling cavity 4190 with the ice mold 480

(not shown) extending down into the ice mold cooling cavity 4190. Those skilled in the art will understand that the ice maker and ice mold can be arranged to close off the open top of the ice mold cooling cavity to enclose the base of ice mold (not shown) and contain the flow of below 0° C. air around the base of the ice mold as described above in connection with FIGS. 30 and 31. An ice chute 4196 can be positioned at the rear side of ice mold cooling cavity 4190 to direct ice cubes harvested from ice maker (not shown) down in to an ice cube storage bin (not shown) that can be arranged similar to the embodiment shown in FIGS. 22 to 26. Second air delivery portion 4184 can include a cabinet duct 4198 having a first cabinet duct leg 4200 that can be positioned along refrigerator compartment side wall 450 and can extend through insulation space 455 into freezer compartment 456. Duct 4198 can have a second cabinet duct leg 4202 that can extend along freezer compartment side wall 461 adjacent freezer compartment top wall 462 toward freezer compartment rear wall 463. Duct 4198 can include a supply duct and a return duct as described above in connection with FIGS. 22 to 24.

In the embodiment of the air delivery system shown in FIGS. 32 and 34 an ice maker fan 4204 can be positioned on the refrigerator compartment door, not shown. Ice maker fan 4204 can be connected to return duct 4188 and arranged to draw below 0° C. air through the air delivery system 4180 through the supply ducts and ice maker 4190 as described above. First air delivery portion 4182 can be connected to second air delivery portion 4184 when the refrigerator compartment door (not shown) is closed by supply interface 4206 and return interface 4208. The air delivery system is shown in FIGS. 32 and 34 in the refrigerator compartment door closed position. Supply interface 4206 can lead from supply duct 4186 to first cabinet duct leg 4200. Similarly, return interface 4208 can lead from return duct 4188 to first cabinet duct leg 4200. First cabinet duct leg 4200 can have openings (not shown) in surface 4210 that communicate with the supply duct and return duct in first cabinet duct leg 4200. Supply interface 4206 and return interface 4208 can have matching openings (not shown) in the face 4210 adjoining first cabinet duct leg 4200 that can allow below 0° C. air to flow through the ice maker air delivery system 4180 in operation. As described above in connection with FIGS. 22 and 24, supply and return interfaces 4206 and 4208, and first cabinet duct leg 4200 can have a gasket or sealing surface (not visible in FIGS. 32 to 34) for the openings to facilitate effective sealing of the first air delivery portion 4182 to the second air delivery portion 4184 in operation. Second air delivery portion 4184 can extend to the rear of freezer compartment 456 and can connect to an evaporator cover 4212 that can be positioned along the rear wall 463 of the freezer compartment 456. Below 0° C. air can be drawn out the evaporator compartment (not shown) behind evaporator cover 4212 and through the air delivery system 4180 to the ice maker (not shown) and ice cube storage bin (not shown).

The inventive concepts described herein provide the convenience of ice and water dispensing on the refrigerator compartment door of a bottom-mount refrigerator. Since the refrigerated compartment is accessed more frequently than the freezer compartment, the refrigerated compartment occupies the upper portion of the cabinet, improving access to refrigerated items. The less-frequently accessed freezer compartment occupies the lower portion of the cabinet, extending the width of the cabinet. Unlike a side-by-side refrigerator, the full width freezer compartment can accommodate large items. The ice making device can be located in the freezer, and the ice cubes can be transported by a transporting mechanism from the freezer compartment to the through-the-door ice cube dispensing device in order to minimize the loss of refrigerated compartment space. Alternately, the ice making device can be located in the refrigerator compartment door with an ice cube storage bin and through-the-door ice cube dispensing device with an air delivery system leading to the ice maker and ice cube storage bin for supplying air cooled to below 0° C. The ice cube transporting mechanism can be used in conjunction with an undercounter ice maker to supply ice cubes to a dispenser positioned on the countertop.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

We claim:

1. A refrigerator comprising:

a refrigerating compartment maintained at a temperature above 0 degrees C. having top, bottom and opposite side walls;

a freezer compartment maintained at a temperature below 0 degrees C. located below the refrigerating compartment;

a first door and a second door each having a top, bottom and opposite sides, the first and second door operable to open and close the refrigerating compartment;

an ice compartment located on the first door adjacent to the top of the first door;

an ice maker located in the ice compartment, the ice maker operable to freeze liquid water into ice;

an air delivery system connected to the ice compartment and to a source of below 0 degree C. air including:

an air supply interface located on the first door operable to engage an air supply duct on one of the refrigerating compartment side walls when the first door is closed and disengage the air supply duct when the first door is open; and an air return interface located on the first door operable to engage an air return duct on the one of the refrigerating compartment side walls when the first door is closed and disengage the air return duct when the first door is open;

an ice storage bin in the ice compartment for receiving ice from the ice maker; and a dispenser located on the first door spaced upwardly from the bottom of the first door, the dispenser operable to dispense ice from the ice storage bin through the first door.

2. The refrigerator of claim 1, wherein the air supply duct and air return duct extend along the one of the refrigerating compartment side walls to the source of below 0 degree C. air.

3. The refrigerator of claim 2, wherein the air delivery system further comprises an air delivery portion including supply and return ducts extending along one side of the first door to the ice compartment from the air supply interface and the air return interface.

4. The refrigerator of claim 1, wherein the ice storage bin is removable from the ice compartment.

5. The refrigerator of claim 1, wherein the ice storage bin is located below the ice maker.

6. The refrigerator of claim 1, wherein the ice compartment further comprises a cover that is operable to control access to at least one of the ice maker and the ice storage bin.

7. The refrigerator of claim 6, wherein the cover is hingedly connected to the refrigerating compartment door.

8. The refrigerator of claim 6, wherein the cover is an insulated cover.

9. The refrigerator of claim 1, wherein the ice compartment further comprises a cover that is operable to provide access to the ice maker.

10. The refrigerator of claim 9, wherein the cover is held in place by a latch.

11. The refrigerator of claim 10, wherein the cover is an insulated cover.

12. The refrigerator of claim 1, further comprising a chute extending between the ice maker and the refrigerating compartment door to direct ice cubes from the ice maker into the ice storage bin.

13. The refrigerator of claim 1, wherein the ice compartment comprises an ice maker sub-compartment and an ice storage bin sub-compartment.

14. The refrigerator of claim 1, wherein the ice maker is an automatic ice maker.

* * * * *